United States Patent [19]

Goda

[11] Patent Number: 5,037,733

[45] Date of Patent: Aug. 6, 1991

[54] SILVER HALIDE PHOTOGRAPHIC MATERIALS

[75] Inventor: Kensuke Goda, Kanagawa, Japan

[73] Assignee: Fuji Photo Film Co., Ltd., Kanagawa, Japan

[21] Appl. No.: 442,372

[22] Filed: Nov. 28, 1989

[30] Foreign Application Priority Data

Nov. 28, 1988 [JP] Japan ..... 63-300179

[51] Int. Cl.[5] ..... G03C 1/20

[52] U.S. Cl. ..... 430/584; 430/264; 430/567; 430/600; 430/603; 430/607; 430/611

[58] Field of Search ..... 430/264, 567, 584, 600, 430/603, 607, 611

[56] References Cited

U.S. PATENT DOCUMENTS

| | | | |
|---|---|---|---|
| 4,618,570 | 10/1986 | Kadowaki et al. | 430/603 |
| 4,849,324 | 7/1989 | Aida et al. | 430/600 |
| 4,912,029 | 3/1990 | Asami | 430/567 |

*Primary Examiner*—Hoa Van Le

*Attorney, Agent, or Firm*—Sughrue, Mion, Zinn Macpeak & Seas

[57] ABSTRACT

A silver halide photosensitive material comprising a support having thereon at least one silver halide emulsion layer containing silver halide grains. These silver halide grains are obtained by subjecting the surface of silver halide grains to halogen conversion. These silver halide grains are essentially silver iodide free silver chlorobromide. They have a plurality of internal layers of different halogen compositions and contain at least one bridged pentamethine cyanine dye compound represented by the general formula (I) or (I'):

(I)

Xn (I')

X'n and one compound represented by general formula (II):

(II)

The variables in the above formulas are defined in the instant specification.

16 Claims, No Drawings

SILVER HALIDE PHOTOGRAPHIC MATERIALS

FIELD OF THE INVENTION

This invention concerns silver halide photographic materials. More particularly this invention concerns silver halide photographic materials which have a high contrast with high photographic speed, which are improved in such a way that the photographic performance of the emulsions does not change from lot to lot at the time of manufacture, and with which there is little change in the photographic speed of the photosensitive material on long term storage.

BACKGROUND OF THE INVENTION

A strong demand has arisen in recent years for silver halide photographic materials, especially print photosensitive materials, which have increased photographic speed and which can be developed and processed more rapidly, and for the supply of high quality prints without the need for a high degree of skill. In order to respond to these demands the photographic performance of the photosensitive material must be improved and, at the same time, production stability must be achieved. Thus, any differences arising between production lots must be prevented and any changes in performance which may arise on long term storage after manufacture must be minimized.

Silver chlorobromides which are essentially free of silver iodide are used, mainly, in silver halide emulsions for print purposes from the viewpoint of increasing the development rate of these materials. Many attempts have been made in the past to increase the sensitivity of silver chlorobromides, but problems with low contrast and pressure sensitivity still remain.

For example, although emulsions which have been prepared by halogen conversion as disclosed in JP-B-50-36978 have increased photographic speed, it has been found that they are subject to pronounced desensitization when pressure is applied. (The term "JP-B" as used herein signifies an "examined Japanese patent publication".)

Furthermore, techniques involving the so-called lamination type emulsions, i.e., emulsions which have layers of different halogen composition within the silver halide grains, have been proposed in the specifications of, for example, JP-B-56-18939, JP-A-58-9137, JP-A-58-95736, JP-A-58-108533, JP-A-60-222844 and JP-A-60-222845. (The term "JP-A" as used herein signifies an "unexamined published Japanese patent application".) However, a softening of contrast in the toe part of the characteristic curve tends to occur in all of these cases, and there is a further disadvantage in that the materials tend to pressure desensitization.

On the other hand, differences between production lots and changes in performance (especially changes in photographic speed and fog level) on long term storage are a major problem in practice and these factors have been a major weakness, especially where high picture quality has been demanded, in recent years.

Such changes in performance are characteristic of the silver halide emulsions themselves, but at the same time it is thought that the performance of the sensitizing dyes which are used is also a major factor. That is to say, the amount of sensitizing dye adsorbed varies considerably on prolonged ageing of the emulsion's used for coating purposes during manufacture and on long term storage after manufacture.

This problem is especially acute when specified couplers, oils and organic solvents etc. are present in the same emulsion layer. That is to say, the sensitizing dye which should be adsorbed on the silver halide is gradually desorbed with the aging of the emulsions which are being used for coating purposes and with long term ageing after coating and drying.

In general, reported attempts to improve upon the differences which arise between production lots and to improve long term storage properties have included the addition of water soluble bromides (JP-A-52-151026), the addition of iridium salts (JP-A-54-23520), hardening agent selection (JP-A-60-202436 and JP-A-61-123834), the addition of super-sensitizing agents (JP-A-61-203447), and improvement of the method used to add the spectrally sensitizing dyes (JP-A-58-7629).

Moreover, it is suggested in JP-A-60-225147 that improvement of spectral sensitivity and ageing properties on storage, and improvement in respect of differences between emulsion lots, can be achieved by using silver chlorobromides which have (100) surfaces and (111) surfaces.

However, when these methods are used either individually or in combination it is very difficult to achieve improvements which actually provide satisfactory photographic performance, which is to say which provide satisfactory differences between production lots and long term ageing storage properties without loss of photographic speed, contrast and picture quality, etc.

SUMMARY OF THE INVENTION

Thus, an object of this invention is to provide silver halide photographic materials with a photographic performance which provides high picture quality at high photographic speeds, which does not change between production lots and with which the change in performance in respect of photographic speed, fogging etc. on prolonged storage after production is slight.

It has been discovered that the objects of the invention are achieved in the ways indicated below.

(1) A silver halide photosensitive material comprising a support having thereon at least one silver halide emulsion layer containing a silver halide grains obtained by subjecting the surface of silver halide grains which comprise essentially silver iodide free silver chlorobromide and which have a plurality of layers of different halogen compositions within the grains to halogen conversion, and this emulsion layer additionally contains at least one bridged pentamethine cyanine dye represented by the general formula (I) or (I')

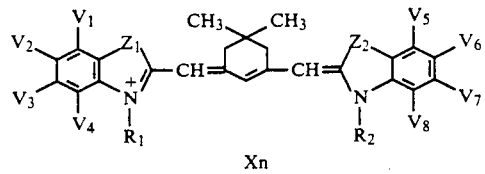

(I)

Wherein, $Z_1$ and $Z_2$, which may be the same or different, each represents sulfur atom or a selenium atom;

$R_1$ and $R_2$ which may be the same or different, each represents an alkyl group, with the proviso that at least one of the groups represented by $R_1$ and $R_2$ is a butyl group, a pentyl group, a hexyl group, a heptyl group or an octyl group;

$V_1$, $V_2$, $V_3$, $V_4$, $V_5$. $V_6$. $V_7$ and $V_8$, which may be the same or different each represents a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group or an aryl group, or two of the groups represented by $V_1$–$V_8$ which are bonded to adjacent carbon atoms may together form a condensed ring;

X represents an electrical charge balancing counter ion, and n is a value required to neutralize the electrical charge,

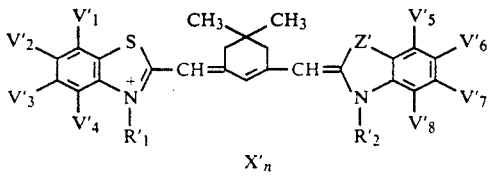

(I')

Wherein Z' represents an oxygen atom or a sulfur atom;

$R'_1$ and $R'_2$ which may be the same or different, each represents a substituted or unsubstituted alkyl groups.

$V'_1$, $V'_2$, $V'_3$, $V'_4$, $V'_5$, $V'_6$, $V'_7$ and $V'_8$, which may be the same or different, each represents a hydrogen atom, an alkyl group, an acyl group, an acyloxy group, an alkoxycarbonyl group a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group or an aryl group, and two of the groups represented by $V'_1$–$V'_8$ which are bonded to adjacent carbon atoms cannot together form a condensed ring, and if the Hammett $\sigma_p$ values are $\sigma_{pi}$ (i= 1 to 8) and $Y=\sigma_{p1}+\sigma_{p2}+\sigma_{p3}+\sigma_{p4}+\sigma_{p5}+\sigma_{p6}+\sigma_{p7}+\sigma_{p8}$, then $Y \leqq -0.08$ when Z' is an oxygen atom and $Y \leqq -0.15$ when Z' is a sulfur atom', X represents an electrical charge balancing counter ion, and n is a value required to neutralize the electrical charge, and at least one compound represented by the general formula (II)

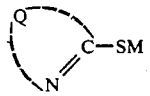

(II)

Wherein, Q represents a group of atoms necessary to form a five or six membered heterocyclic ring which may be condensed with a benzene ring, and M represents a hydrogen atom, an alkali metal atom, an ammonium group or a precursor thereof.

(2) A silver halide photographic photosensitive materials as described in (1) above and wherein the silver halide emulsion additionally contains a dispersion of fine lipophilic particles obtained by emulsification and dispersion of a liquid mixture obtained by dissolving at least one cyan coupler represented by the general formula (III)

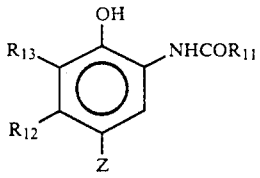

(III)

Wherein, $R_{11}$ represents an alkyl group, a cycloalkyl group, an aryl group or a heterocyclic group, $R_{12}$ represents an acylamino group or an alkyl group which has at least one carbon atom, or $R_{12}$ combins with $R_{13}$ to form a nitrogen containing heterocyclic ring;

$R_{13}$ represents a hydrogen atom, a halogen atom, an alkyl group or an alkoxy group.

With the proviso that $R_{11}$ represents an aryl group when $R_{12}$ represents an acylamino group;

Z represents a hydrogen atom, or a group or atom which can be eliminated in a reaction with the oxidation product of a primary aromatic amine color developing agent; and at least one homopolymer or copolymer which is water insoluble and soluble in organic solvents.

DETAILED DESCRIPTION OF THE INVENTION

The invention is described in greater detail below.

According to the present invention, the compounds represented by formulae (I), (II), (III) and (I') are generally added in a red-sensitive layer in a conventional color photographic material having a blue-, green- and red-sensitive emulsion layers.

Useful silver halide emulsions which can be used in the silver halide photographic materials of the present invention are essentially silver iodide free silver chlorobromide emulsions. Here, the term "essentially silver iodide free" signifies that the silver iodide content is not more than 1 mol %, preferably not more than 0.5 mol %, and most desirably the emulsion contains no silver iodide at all.

The silver chlorobromide is preferable for defining a Br/Cl ratio required to form different partial constitutions in grains, thereby providing sufficient core/shell constitution therein in view of a gist of the present invention that silver halide particles have a different core/shell type constitution in certain parts.

The silver chloride and silver bromide content ratio in the emulsion used in this invention can have any value from almost pure silver chloride to almost pure silver bromide, but a silver chloride content is less than 100 mol % whereas a silver bromide content of at least 0.3 mol % but not more than 97 mol % is preferred. Most desirably, the silver bromide content is at least 0.5 mol % but not more than 90 mol %. The silver bromide content is low where the silver halide photographic materials of the invention are used in applications where rapid processing is required, and emulsions which have a silver bromide content of not more than 20 mol %, or not more than 10 mol %, for example, can be used in such applications. Not only are rapid processing properties improved with silver bromide contents of 3 mol % or less, but the equilibrium bromide ion concentration in the development bath which is determined in connection with the rate of replenishment when running these photosensitive materials through a development bath, is also reduced. Moreover, this enables more rapid processing to be achieved by the development bath itself.

An emulsion which has a high silver bromide content is preferred for obtaining photographic photosensitive materials which are stable from the standpoint of fog level, photographic speed and gradation using the techniques of the present invention, and in this respect silver bromide contents of at least 45 mol %, and most desirably of at least 60 mol %, are preferred.

The crystalline grains which are present in such silver chlorobromide emulsions of the present invention must have a part structure comprising at least two parts in which the silver; bromide content differs by at least 10 mol %. Here, the term "part structure" may signify a so-called core/shell type structure in which the interior and surface parts of the crystal grains have different halogen compositions, or it may signify a multi-layer core/shell type structure.

The part structures formed in this way may be, for example, grains which have a core/shell structure in which the core part has a high silver bromide content and the shell part has a low silver bromide content, or in which the core has a low silver bromide content and the shell has a high silver bromide content. Furthermore, the boundary between the part structures which have different halide compositions in crystal grains which have these structures may, depending on the composition, be definite boundaries, or mixed crystals of varying composition may be formed to provide a boundary of the type in which a continuous change in composition occurs.

No particular limitation is imposed upon the structure ratio in the crystal grains which have a part structure with at least two parts of different halogen compositions, but the core:shell structure ratio in crystal grains which have a core/shell structure, for example, is preferably between 2:98 and 98:2, more desirably between 5:95 and 95:5, even more desirably between 7:93 and 90:10, and most desirably between 15:85 and 80:30.

The difference in the silver bromide contents of the core and shell parts differs according to the core:shell structure mol ratio, but a difference of at least 10 mol % but less than 100 mol % is required. The difference is preferably at least 10 mol % but not more than 80 mol %, and most desirably at least 10 mol % but not more than 50 mol %. If there is little difference between the silver bromide content of the part structure comprising of two or more parts, then the grains are much the same as grains which have a uniform structure and, conversely, if the difference in composition is too great then problems tend to arise with performance, for example, with pressure desensitization, and this is undesirable. The appropriate difference in composition depends on the structure ratio of the part structure, but a large difference in composition is preferred as the structure ratio approaches 0:100 or 100:0, and a small difference in composition in the range of 10 mol.% or above is preferred as the structure ratio approaches 1:1.

The term "halogen conversion" as used in this present invention is defined as conversion, by adding a substance which contains halide ions which can form a less soluble silver salt, of the composition of a silver halide crystal which has already been formed". As regarding a halogen conversion, it is specifically disclosed in U.S. Pat. No. 3,622,318, which is considered as a reference of the present invention. The halogen conversion according to the present invention is carried out for sensitizing silver halide.

In general, where silver halide crystals which are subjected to halogen conversion are mixed crystals such as silver chlorobromides, the conversion can be achieved by introducing into the solution a concentration of bromide ions greater than the bromide ion concentration which is present when the crystals are at equilibrium, whereupon a reaction in which the silver halide at the surface is replaced by a composition which is richer in silver bromide takes place.

To carry out the halogen conversion on silver bromochloride, following compounds are generally used. These are KBr, NaBR, 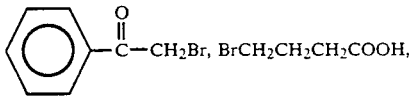

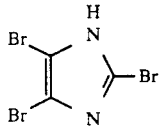

and a fine particle of AgBr.

The required amount of bromide ion can be added easily in the form of a water soluble salt to subject the surface of such grains to halogen conversion, but donors with which it is possible to control the amount of bromide ion supplied, or the rate of supply of the bromide ion, can also be used. Organic bromides, inorganic bromides which have an appropriate solubility in water, and bromides which are covered with an encapsulating film or a semi-permeable membrane can be used, for example, as such donors. The compounds represented by the general formula [S] disclosed in the specification of Japanese Patent Application No. 63-116240, can be employed and are preferred compounds with which the rate of supply can be controlled. The compound of formula [S] is an organic bromide compound which is disclosed in EP 0,341,728 as a compound of formula (S), for use as a scavenger of bromine or bromine ion. Moreover, fine grained silver halides which have a higher silver bromide content than the surface of the grains prior to halogen conversion can also be used for this purpose.

The extent of halogen conversion in this present invention involves preferably at least 0.5 mol % but not more than 20 mol %, and most desirably at least 1 mol % but not more than 15 mol %, of all the silver halide. It is difficult to achieve the effect of the invention if the extent of halogen conversion is less that 0.5 mol %, and desensitization by pressure as mentioned earlier becomes more pronounced if the extent of the conversion is greater than 20 mol.%, and this is undesirable.

The preparation of the silver halide emulsion in this present invention comprises a process in which silver halide grains are formed by reacting a water soluble halide with a water soluble silver salt, a de-salting process, and a chemical ripening process, and these processes are generally well known. The time at which the halogen conversion is carried out among the aforementioned processes in the present invention is preferably prior to the chemical ripening, more desirably prior to the de-salting process, and most desirably it is carried out as a continuation of the grain formation process.

The silver chlorobromide used in the invention may have a cubic or octahedral form, a tetradecahedral form or rhombododecahedral form, or it may be some other form such as a spherical form, for example. The use of grains which have an octahedral form or a tetradecahedral form is preferred in the present invention, and the use of cubic grains is especially desirable.

Tabular grains can also be used, and emulsions in which tabular grains of which the value of the aspect ratio of the diameter of the grain calculated as a circle to the grain thickness is at least 5, but not more than 8, account for at least 50 mol % of the projected area of all the grains are useful in that they have excellent rapid development properties. The use of grains which have a structure of the type described earlier is also most desirable in the case of such tabular grains.

The average size (the average diameter of spheres of corresponding calculated volume) of the grains of the silver halide emulsions used in this present invention is preferably not more than 2μ but at least 0.1μ. Most desirably, the average grain size is not more than 1.4μ but is at least 0.15μ. The grain size distribution may be narrow or wide, but the use of mono-disperse emulsions is preferred. As mentioned earlier, the use of cubic, octahedral or tabular grain, mono-disperse emulsions is most desirable in this present invention. Emulsions in which at least 85% of all the grains by number or by weight are of a size within ±20% of the average grain size are preferred, and those emulsions in which at least 90% of the grains satisfy this requirement are more desirable, while emulsions in which this value is at least 95% are the most desirable. Moreover, the use of two or more mono-disperse emulsions of this type either in the form of mixtures or as laminated coatings provide the preferred results. In those cases where mixtures of two or more types of mono-disperse emulsion are used, the use of mixtures in which the mixing ratio, calculated as silver, is at least 5% but not more than 95% is preferred. The average grain sizes of the mixed emulsions preferably differ by at least 1:1.1 but not more than 1:8, and preferably by at least 1:1.2 but not more than 1:6, calculated in terms of volumes. In those cases in which two types of mono-disperse emulsion are used, the mixing ratio, in the same way as described above, is preferably from 0.05:0.95 to 0.95:0.05, and most desirably within the range from 0.1:0.9 to 0.1:0.1, calculated as silver.

The photographic emulsions used in the invention can be prepared, for example, using the methods described in P. Glafkides, "*Chimie et Physique Photographique*" (Paul Montel, 1967), in G. F. Duffin, "*Photographic Emulsion Chemistry*" (Focal Press, 1966) and in V. L. Zelikmann et al. in "*Making and Coating Photographic Emulsions*" (Focal Press, 1964). That is to say, single sided mixing methods, simultaneous mixing methods and any combination of these methods can be used for the system in which the soluble halide is reacted with the soluble silver salt, and methods in which the grains are formed in the presence of excess silver ion (the so-called reverse mixing methods) can be used. The method in which the silver halide ion concentration is held constant in the liquid phase in which the silver halide is being formed, i.e., the so-called controlled double jet method, can be used as one simultaneous mixing method type system. This method is preferred for obtaining mono-disperse silver halide emulsions which have a narrow grain size distribution with a uniform crystal form. The grains described earlier which are preferably used in this present invention are preferably prepared on the basis of a simultaneous mixing method, including this method.

The pH during the grain formation process of the silver halide emulsions may have any value, and grain formation can be carried out using the so-called acidic methods, neutral methods, ammonia methods or under conditions of pH above 7.0 in which there is essentially no ammonia present. Emulsion in which at least 10% of the grain formation is carried out under conditions of a pH at least 7.6 but not more than 10.8 are especially desirable from the standpoint of improved latent image retaining properties of these emulsion after exposure.

The silver halide emulsions used in this present invention may be surface latent image type emulsions with which the latent image is formed principally at the surface of the grains, or of the internal latent image type with which the latent image is formed principally within the grains, but use of the former type is preferred for achieving the objects of the present invention.

Cadmium salts, zinc salts, lead salts, thallium salts, iridium salts or complex salts thereof, rhodium salts or complex salts thereof, or iron salts or complex salts thereof can be present during the processes of silver halide grain formation or physical ripening.

Iridium salts or complex salts thereof can be used at a rate of from $10^{-9}$ to $10^{-4}$ mol, and preferably at a rate of from $10^{-8}$ to $10^{-5}$ mol, per mol of silver halide. The iridium salts may be concentrated and doped in just one part of the silver halide grains which have a part structure comprising two or more parts in the emulsions used in this present invention, or it may be doped in each of the parts of the part structure. Iridium salt doped emulsions are particularly useful for realizing rapid processing properties and stability when making exposures under conditions of high or low brightness rather than in the appropriate exposure brightness range when compared to emulsions which have been prepared without using iridium salts or complex salts thereof.

Mono-disperse silver halide emulsions which have a uniform crystalline form and a narrow grain size distribution are obtained when grain formation or physical ripening is carried out in the presence of a known silver halide solvent (for example, potassium thiocyanate or the thione compounds and thioethers disclosed, for example, in U.S. Pat. No. 3,271,157, JP-A-51-12360, JP-A-53-82408, JP-A-53-144319, JP-A-54-100717 or JP-A-54-155828) and this is desirable.

Noodle washing, flocculation/precipitation methods or ultra-filtration methods can be used, for example, to remove the soluble salts from the emulsions after physical ripening.

The silver halide emulsions which can be used in the present invention can be chemically sensitized using sulfur sensitization or selenium sensitization, reduction sensitization and precious metal sensitization either independently or in combination. More specifically, sulfur sensitization using active gelatin or compounds which contain sulfur which can react with silver ions (for example, thiosulfates, thiourea compounds, mercapto compounds, rhodanine compounds) are used, and reduction sensitization methods in which reducing substances (for example, stannous salts, amines, hydrazine derivatives, formamidinesulfinic acid, silane compounds) are used, and precious metal sensitization methods in which precious metal compounds (for example, gold complex salts, and complex salts of metals of group VIII of the periodic table, such as platinum, iridium, palladium, rhodium and iron) are used can be used individually or conjointly. The use of sulfur sensitization or selenium sensitization is especially desirable for the silver chlorobromides used in this present invention since this is less liable to promote fogging, and in many cases more desirable results are obtained without the combined use of gold sensitization. Furthermore, the presence of nitrogen containing heterocyclic compounds, for example azaindene compounds as exemplified by 4-hydroxy-6-methyl-1,3,3a,7-tetra-azaindene, and/or mercapto compounds as exemplified by 1-phenyl-5-mercaptotetrazole or 2-amino-5-mercapto-1,3,4-thiadiazole, as described hereinafter, during the chemical sensitization of the emulsions of this present invention is preferred.

The compounds of the general formula (I) are described in detail below.

$Z_1$ and $Z_2$ each represents sulfur atom or a selenium atom, and they are both preferably a sulfur atom.

Preferred alkyl groups for $R_1$ and $R_2$ are unsubstituted alkyl groups which have not more than 18 carbon atoms (for example, methyl, ethyl, propyl, butyl, pentyl, hexyl, heptyl, octyl, decyl, dodecyl, octadecyl) and substituted alkyl groups {in which alkyl groups which have not more than 18 carbon atoms are substituted with, for example, carboxyl groups, sulfo groups, cyano groups, halogen atoms (for example, fluorine, chlorine, bromine), hydroxyl groups, alkoxycarbonyl groups which have not more than 8 carbon atoms (for example, methoxycarbonyl, ethoxycarbonyl), arylcarbonyl groups (for example, phenoxycarbonyl), aralkyloxycarbonyl groups (for example, benzyloxycarbonyl), alkoxy groups which have not more than 8 carbon atoms (for example, methoxy, ethoxy, benzyloxy, phenethyloxy), single ring aryloxy groups which have not more than 15 carbon atoms (for example, phenoxy, p-tolyloxy), acyloxy groups which have not more than 8 carbon atoms (for example, acetyloxy, propionyloxy), acyl groups which have not more than 8 carbon atoms (for example, acetyl, propionyl, benzoyl), carbamoyl groups (for example, carbamoyl, N,N-dimethylcarbamoyl, morpholinocarbonyl, piperidinocarbonyl), sulfamoyl groups (for example, sulfamoyl, N,N-dimethylsulfamoyl, morpholinosulfonyl, piperidinosulfonyl) or aryl groups which have not more than 15 carbon atoms (for example, phenyl, 4-chlorophenyl, 4-methylphenyl, α-naphthyl)}.

Of these groups, unsubstituted alkyl groups (for example, methyl, ethyl, propyl, butyl, pentyl, hexyl, heptyl, octyl) and sulfoalkyl groups (for example, 2-sulfoethyl, 3-sulfopropyl, 4-sulfobutyl) are preferred.

However, at least one of $R_1$ and $R_2$ is a butyl group, pentyl group, hexyl group, heptyl group or octyl group. Most desirably, at least one of these groups is a pentyl group.

$V_1$, $V_2$, $V_3$, $V_4$, $V_5$, $V_6$, $V_7$ and $V_8$ each preferably represents a hydrogen atom, a halogen atom (for example, fluorine, chlorine, bromine), an unsubstituted alkyl group which has not more than 10 carbon atoms (for example, methyl, ethyl), a substituted alkyl group which has not more than 18 carbon atoms (for example, benzyl, α-naphthylmethyl, 2-phenylethyl, trifluoromethyl), an acyl group which has not more than 8 carbon atoms (for example, acetyl, benzoyl), an acyloxy group which has not more than 8 carbon atoms (for example, acetyloxy), an alkoxycarbonyl group which has not more than 8 carbon atoms (for example, methoxycarbonyl, ethoxycarbonyl,benzyloxycarbonyl), a carbamoyl group (for example, carbamoyl, N,N-dimethylcarbamoyl, morpholinocarbonyl, piperidinocarbonyl), a sulfamoyl group (for example, sulfamoyl, N,N-dimethylsulfamoyl, morpholinosulfonyl, piperidinosulfonyl), a carboxyl group, a cyano group, a hydroxyl group, an amino group, an acylamino group which has not more than 8 carbon atoms (for example, acetylamino), an alkoxy group which has not more than 10 carbon atoms (for example, methoxy, ethoxy, benzyloxy), an alkylthio group which has not more than 10 carbon atoms (for example, ethylthio), an alkylsulfonyl group which has not more than 5 carbon atoms (for example methylsulfonyl), a sulfonic acid group, or an aryl group which has not more than 15 carbon atoms (for example, phenyl, tolyl).

Furthermore, any two of the groups $V_1$ to $V_8$ which are bonded to adjacent carbon atoms may together form a benzene ring. Furthermore, they may be joined together to form a heterocyclic ring (for example, pyrrole, thiophene, furan, pyridine, imidazole, triazole, thiazole).

$V_1$ to $V_8$ are, most desirably, hydrogen atoms, unsubstituted alkyl groups (for example, methyl) or alkoxy groups (for example, methoxy).

$X_n$ is present in the formula to indicate the presence or absence of an anion or cation when such is required to neutralize any ionic charge on the dye. Hence, n can have an appropriate value of 0 or above.

Typical examples of cations include inorganic and organic ammonium ions and alkali metal ions, while the anions may be typically inorganic or organic anions, for example, halide ions (fluoride, chloride, bromide, iodide), substituted arylsulfonate ions (for example, p-toluenesulfonate, p-chlorobenzenesulfonate,), aryldisulphonate ions (for example, 1,3-benzenedisulfonate, 1,5-naphthalenedisulfonate), alkylsulfate ions (for example, methylsulfate ion), sulfate ions, thiocyanate ions, perchlorate ions, tetrafluoroborate ions, picrate ions, acetate ions or trifluoromethanesulfonate ions. The iodide ion is preferred.

The compounds of the general formula [I'] are described in detail below.

In general formula [I'], Z' represents an oxygen atom or a sulfur atom. Preferred alkyl groups for $R'_1$ and $R'_2$ are unsubstituted alkyl groups which have not more than 18 carbon atoms (for example, methyl, ethyl, propyl, butyl, pentyl, hexyl, heptyl, octyl, decyl, dodecyl, octadecyl) and substituted alkyl groups {in which alkyl groups which have not more than 18 carbon atoms are substituted with, for example, carboxyl groups, sulfo groups, cyano groups, halogen atoms (for example, fluorine, chlorine, bromine), hydroxyl groups, alkoxycarbonyl groups which have not more than 8 carbon atoms (for example, methoxycarbonyl, ethoxycarbonyl), arylcarbonyl groups (for example, phenoxycarbonyl), aralkyloxycarbonyl groups (for example, benzyloxycarbonyl), alkoxy groups which have not more than 8 carbon atoms (for example, methoxy, ethoxy, benzyloxy, phenethyloxy), single ring aryloxy groups which have not more than 15 carbon atoms (for example, phenoxy, p-tolyloxy), acyloxy groups which have not more than 8 carbon atoms (for example, acetyloxy, propionyloxy), acyl groups which have not more than 8 carbon atoms (for example, acetyl, propionyl, benzoyl), carbamoyl groups (for example, carbamoyl, N,N-dimethylcarbamoyl, morpholinocarbonyl, piperidinocarbonyl), sulfamoyl groups (for example, sulfamoyl, N,N-dimethylsulfamoyl, morpholinosulfonyl, piperidinosulfonyl) and aryl groups which have not more than 15 carbon atoms (for example, phenyl, 4-chlorophenyl, 4-methylphenyl, α-naphthyl)}.

Of these groups, the unsubstituted alkyl groups (for example, methyl, ethyl, propyl, butyl, pentyl, hexyl, heptyl, octyl) and the sulfoalkyl groups (for example, 2-sulfoethyl, 3-sulfopropyl, 4-sulfobutyl) are preferred.

$V'_1$, $V'_2$, $V'_3$, $V'_4$, $V'_5$, $V'_6$, $V'_7$ and $V'_8$ each preferably represents a hydrogen atom, a halogen atom (for example, fluorine, chlorine, bromine), an unsubstituted alkyl group which has not more than 10 carbon atoms (for example, methyl, ethyl), a substituted alkyl group which has not more than 18 carbon atoms (for example, benzyl, α-naphthylmethyl, 2-phenylethyl, trifluoromethyl), an acyl group which has not more than 8 carbon atoms (for example, acetyl, benzoyl), an acyloxy group which has not more than 8 carbon atoms (for example, acetyloxy), an alkoxycarbonyl group which has not more than 8 carbon atoms (for example, methoxycarbonyl, ethoxycarbonyl,benzyloxycarbonyl), a carbamoyl group (for example, carbamoyl, N,N-dimethylcarbamoyl, morpholinocarbonyl, piperidinocarbonyl), a sulfamoyl group (for example, sulfamoyl, N,N-dimethylsulfamoyl, morpholinosulfonyl, piperidinosulfonyl), a carboxyl group, a cyano group, a hydroxyl group, an amino group, an acylamino group which has not more than 8 carbon atoms (for example, acetylamino), an alkoxy group which has not more than 10 carbon atoms (for example, methoxy, ethoxy, benzyloxy), an alkylthio group which has not more than 10 carbon atoms (for example, ethylthio), an alkylsulfonyl group which has not more than 5 carbon atoms (for example methylsulfonyl), a sulfonic acid group, or an aryl group which has not more than 15 carbon atoms (for example, phenyl, tolyl).

$V_1$ to $V_8$ are, most desirably, hydrogen atoms, unsubstituted alkyl groups (for example, methyl) or alkoxy groups (for example, methoxy).

None of the groups represented by $V'_1$-$V'_8$ which are bonded to adjacent carbon atoms can form condensed rings, and if these groups have Hammett $\sigma_p$ values $\sigma_{pi}$ (i=1 to 8) and $Y=\sigma_{p1}+\sigma_{p2}+\sigma_{p3}+\sigma_{p4}+\sigma_{p5}+\sigma_{p6}+\sigma_{p7}+\sigma_{p8}$, then $Y \leqq -0.08$ if Z' is an oxygen atom and $Y \leqq -0.15$ if Z' is a sulfur atom. When Z' is an oxygen atom, a value of $Y \leqq -0.15$ is preferred, and when Z' is a sulfur atom, a value of $Y \leqq -0.30$ is preferred. Most desirably, the value of Y is such that $-0.90 \leqq Y \leqq -0.17$ when Z' is an oxygen atom and such that $-1.05 \leqq Y \leqq -0.34$ when Z' is a sulfur atom.

The $\sigma_p$ values used herein are those disclosed in "*Structure/Activity Correlation for Drugs—A Policy for Drug Design and Mode of Action Research*" pages 69-103 in *Structure Activity Correlation Meeting Publication Realms of Chemistry series No.* 122, published by Nankodo, and in Corwin Hansch and Albert Leo, pages 69-161 in "*Substituent Constants for Correlation Analysis in Chemistry and Biology* published by John Wiley and Sons. The method for measuring $\sigma_p$ values is described *Chemical Reviews,* Volume 17 pages 125-136 (1945).

According to the above mentioned references, the $\sigma_p$ value for a hydrogen atom is zero, the $\sigma_p$ value for a methyl group is −0.17 and the $\sigma_p$ value for a methoxy group is −0.27.

$X'_n$ has the same significance as $X_n$ in general formula (I).

Specific examples of dyes represented by the general formulae (I) and (I') of the present invention are indicated below, but the invention is not to be construed as being limited to just these examples.

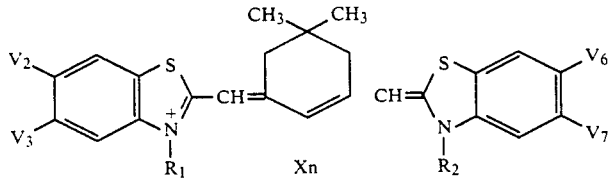

| "Compound Number" | $R_1$ | $R_2$ | $V_2$ | $V_3$ | $V_6$ | $V_7$ | X | n |
|---|---|---|---|---|---|---|---|---|
| I-1 | $(CH_2)_3CH_3$ | $C_2H_5$ | H | H | H | H | $I^-$ | 1 |
| I-2 | $(CH_2)_4CH_3$ | $C_2H_5$ | H | H | H | H | $I^-$ | 1 |
| I-3 | $(CH_2)_5CH_3$ | $C_2H_5$ | H | H | H | H | $I^-$ | 1 |
| I-4 | $(CH_2)_6CH_3$ | $C_2H_5$ | $CH_3$ | H | $CH_3$ | H | $I^-$ | 1 |
| I-5 | $(CH_2)_7CH_3$ | $C_2H_5$ | $CH_3$ | H | $CH_3$ | H | $I^-$ | 1 |
| I-6 | $(CH_2)_4CH_3$ | $C_2H_5$ | $CH_3$ | H | $CH_3$ | H | $I^-$ | 1 |
| I-7 | $(CH_2)_3CH_3$ | $C_2H_5$ | $CH_3$ | H | $CH_3$ | H | $I^-$ | 1 |
| I-8 | $(CH_2)_4CH_3$ | $C_2H_5$ | $CH_3$ | $CH_3$ | H | H | $I^-$ | 1 |
| I-9 | $(CH_2)_4CH_3$ | $C_2H_5$ | H | H | $CH_3$ | $CH_3$ | $I^-$ | 1 |
| I-10 | $(CH_2)_4CH_3$ | $(CH_2)_4CH_3$ | $CH_3$ | H | $CH_3$ | H | $I^-$ | 1 |
| I-11 | $(CH_2)_4CH_3$ | $C_2H_5$ | $OCH_3$ | H | $OCH_3$ | H | $Br^-$ | 1 |
| I-12 | $(CH_2)_4CH_3$ | $C_2H_5$ | $OCH_3$ | $OCH_3$ | H | H | $Cl^-$ | 1 |
| I-13 | $(CH_2)_4CH_3$ | $(CH_2)_3SO_3^-$ | H | H | H | H | — | — |
| I-14 | $(CH_2)_3CH_3$ | $(CH_2)_4SO_3^-$ | H | H | H | H | — | — |
| I-15 | $(CH_2)_4CH_3$ | $CH_2CO_2H$ | $CH_3$ | H | $CH_3$ | H | 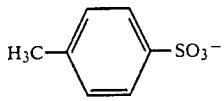 | 1 |
| I-16 | $(CH_2)_4CH_3$ | $(CH_2)_3SO_3^-$ | $CH_3$ | H | $CH_3$ | H | — | — |
| I-17 | $(CH_2)_4CH_3$ | $(CH_2)_4SO_3^-$ | $CH_3$ | H | $CH_3$ | H | — | — |

-continued
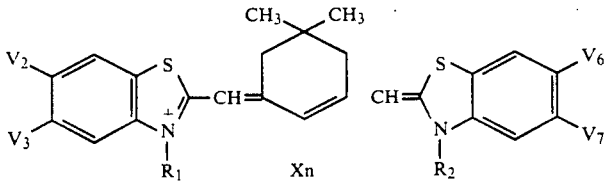
| | | | | | | | | |
|---|---|---|---|---|---|---|---|---|
| I-18 | $(CH_2)_5CH_3$ | $(CH_2)_2SO_3^-$ | $CH_3$ | $CH_3$ | H | H | 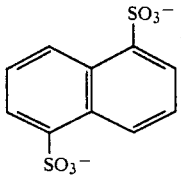 | ½ |
| I-19 | $(CH_2)_3CH_3$ | $(CH_2)_2OCH_3$ | Cl | H | Cl | H | $I^-$ | 1 |
| I-20 | $(CH_2)_4CH_3$ | $(CH_2)_2CN$ | H | Cl | H | Cl | $I^-$ | 1 |
| I-21 | $(CH_2)_4CH_3$ | 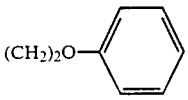 | H | $CO_2H$ | H | $CO_2H$ | $Br^-$ | 1 |
| I-22 | $(CH_2)_3CH_3$ | $(CH_2)_2OH$ | $CH_3$ | $CH_3$ | $CH_3$ | $CH_3$ | $I^-$ | 1 |
| I-23 | $(CH_2)_4CH_3$ | $CH_3$ | $O(CH_2)_2OH$ | H | H | H | $Br^-$ | 1 |
| I-24 | $(CH_2)_7CH_3$ | $(CH_2)_7CH_3$ | H | H | H | H | $ClO_4$ | 1 |
| I-25 | $(CH_2)_4CH_3$ | $C_2H_5$ | H | $CH_3$ | H | $CH_3$ | $I^-$ | 1 |
(I-26)
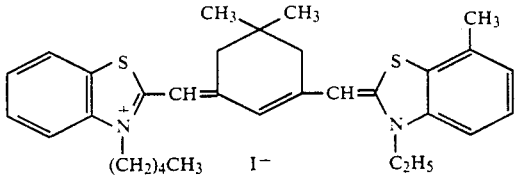
(I-27)
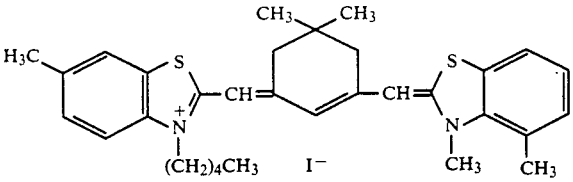
(I-28)
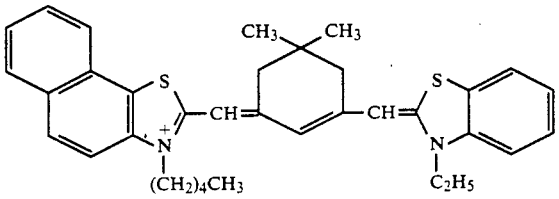
(I-29)
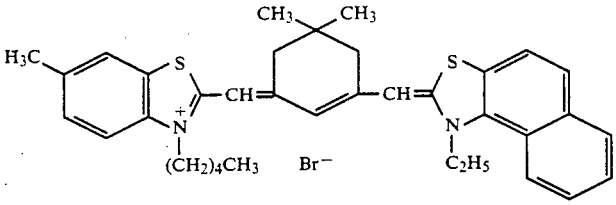

-continued
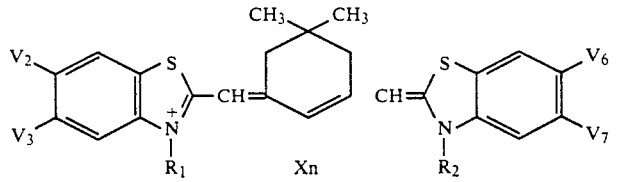
(I-30)
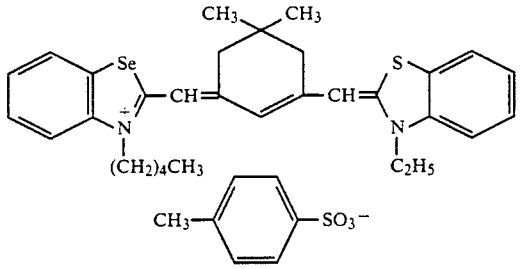
(I-31)
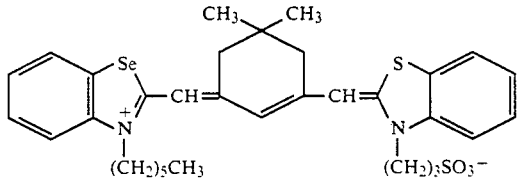
(I-32)
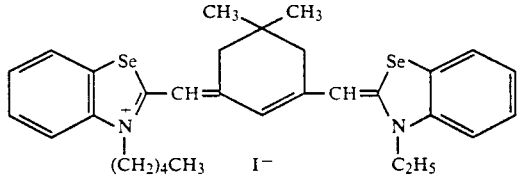
(I-33)
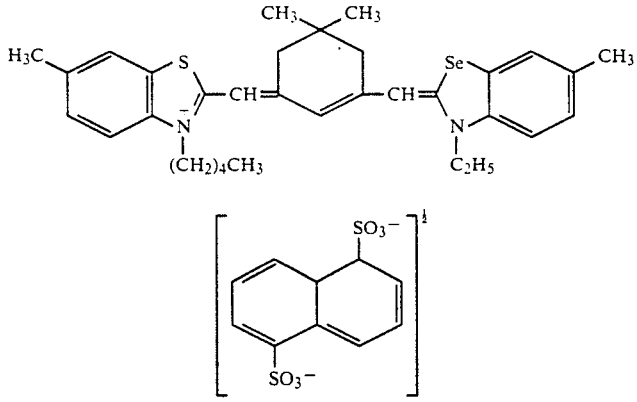
(I-34)
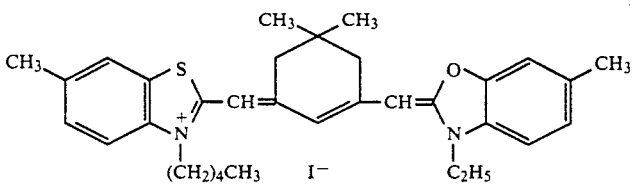
(I-35)
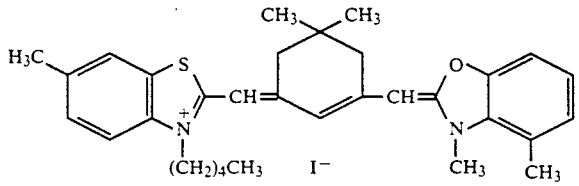
The compounds represented by general formulae (I) and (I') which are used in the present invention can be prepared on the basis of the methods described, for example, in F. M. Hamer, *Heterocyclic Compounds—Cyanine Dyes and Related Compounds,* Chapter IX, pages 270–287 (John Wiley & Sons, New York, London, 1946), and in D. M. Sturmer, *Heterocyclic Compounds—Special Topics in Heterocyclic Chemistry,* Chapter 8, Section 4, pages 482–515 (John Wiley & Sons, New York, London, 1977).

The methods well known in a variety of fields can be used for adding the compounds (I) or (I') the silver halide emulsion layers in accordance with the present invention. Normally, the compounds are dissolved in a water miscible solvent such as methanol, ethanol, pyridine, methylcellosolve or acetone, for example, or in a mixture of such solvents, and added to the silver halide emulsion. Furthermore, they can be dissolved in mixtures of the above mentioned solvents with water for addition to the silver halide emulsions.

The addition can be made at any time during the production of the silver halide emulsion, but the addition is preferably made during the chemical ripening of the emulsion, or after chemical ripening has been completed and before or after the addition of stabilizers and fog suppressing agents.

No particular limitation is imposed upon the amount of compound (I) or (I') which can be added in accordance with the invention, but an amount within the range from $1\times10^{-1}$ to $1\times10^{-6}$ mol, and preferably within the range from $1\times10^{-3}$ to $3\times10^{-5}$ mol (sic), per mol of silver halide can be selected.

The compounds of formula (I) or (I') of the present invention can be used alone or combinations of two or more such compounds can be used. Furthermore, up to 50 mol % of the sensitizing dye used in one emulsion layer may be a sensitizing dye which is outside the scope of the present invention.

Furthermore, super-sensitizing agents can also be used.

Super-sensitizing agents are described in *Photographic Science and Engineering,* Vol. 13, pages 13–17 (1969), ibid, Vol. 18, pages 418–430 (1974), and in James, "*The Theory of the Photographic Process*", Fourth Edition, page 259, published by Macmillan in 1977, and it is well known that high photographic speeds can be obtained by selecting appropriate sensitizing dyes and super-sensitizing agents.

Any type of super-sensitizing agent can be used, but the use of compounds of general formula (A) is especially desirable.

General Formula (A)

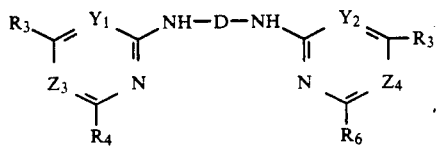

(A)

In the formula (A), D represents a divalent aromatic residual group, and $R_3$, $R_4$, $R_5$ and $R_6$, which may be the same or different, each represents a hydrogen atom, a hydroxyl group, an alkoxy group, an aryloxy group, a halogen atom, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group.

$Y_1$ and $Z_3$ each represents —N= or —CH=, but at least one of these groups is an —N= group.

$Y_2$ and $Z_4$ have the same significance as $Y_1$ and $Z_3$.

The compounds of the general formula (A) are described in detail below.

D represents a divalent aromatic residual group (for example, a single aromatic ring residual group, a residual group derived from at least two condensed aromatic rings or a residual group in which at least two aromatic rings are joined either directly or via an atom or group of atoms, for example a group which has a biphenyl, naphthalene, stilbene or bibenzyl structure), and preferred examples of $D_1$ and $D_2$ are indicated below.

$D_1$:

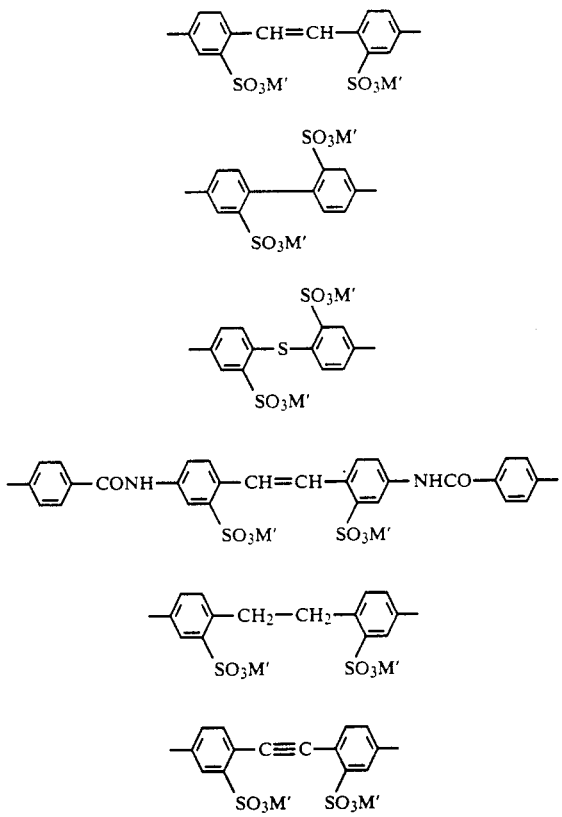

Here, M' represents a hydrogen atom or a cation which imparts water solubility {for example, an alkali metal ion (for example, Na, K), or an ammonium ion}.

$D_2$;

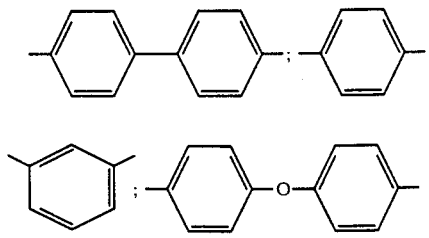

-continued

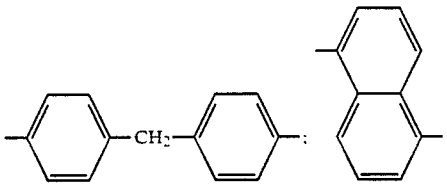

However, at least one of $R_3$, $R_4$, $R_5$ and $R_6$ in the case of $D_2$ has a substituent group which includes an $-SO_3M$ group where M' has the same significance as before.

$R_3$, $R_4$, $R_5$ and $R_6$ each represents a hydrogen atom, a hydroxyl group, an alkoxy group (for example methoxy, ethoxy), an aryloxy group (for example, phenoxy, naphthoxy, o-toloxy, p-sulfophenoxy), a halogen atom (for example, chlorine, bromine), a heterocyclic group (for example, morpholinyl, piperidyl), a mercapto group, an alkylthio group (for example, methylthio, ethylthio), an arylthio group (for example, phenylthio, tolylthio), a heterocyclylthio group (for example, benzothiazolylthio, benzimidazolylthio, phenyltetrazolylthio), an amino group, an alkylamino group (for example, methylamino, ethylamino, propylamino, dimethylamino, diethylamino, dodecylamino, β-hydroxyethylamino, di-β-hydroxyethylamino, β-sulfoethylamino), a cyclohexylamino group, an arylamino group (for example, anilino, o-, m- or p-sulfoanilino, o-, m- or p-chloroanilino, o-, m-, or p-anisidino, o-, m- or p-toluidino, o-, m- or p-carboxyanilino, hydroxyanilino, sulfonaphthylamino, o-, m-, or p-aminoanilino, o-acetaminoanilino), a heterocyclylamino group (for example, 2-benzothiazolylamino, 2-pyridylamino), an aralkylamino group (for example, benzylamino), or an aryl group (for example, phenyl).

Those compounds in which at least one of the groups $R_3$, $R_4$, $R_5$ and $R_6$ in the compounds represented by the general formula [A] is an aryloxy group, a heterocyclylthio group or a heterocyclylamino group are especially desirable.

Typical examples of compounds which can be represented by general formula (A) are shown below, but the present invention is not limited to just those compounds shown herein.

(A-1) 4,4'-bis[2,6-di(benzothiazolyl-2-thio)pyrimidin-4-yl-amino]stilbene-2,2'-disulfonic acid, di-sodium salt (A-2) 4,4'-bis[2,6-di(benzothiazolyl-2-amino)pyrimidin-4-ylamino]stilbene-2,2'-disulfonic acid, di-sodium salt (A-3) 4,4'-bis[2,6-di(1-phenyltetrazolyl-5-thio)pyrimidin-4-ylamino]stilbene-2,2'-disulfonic acid, di-sodium salt (A-4) 4,4'-bis[2,6-di(benzimidazolyl-2-thio)pyrimidin-4-ylamino]stilbene-2,2'-disulfonic acid, di-sodium salt (A-5) 4,4'-bis[2-chloro-6-(2-naphthyloxy)pyrimidin-4-yl-amino]biphenyl-2,2'-disulfonic acid, di-sodium salt (A-6) 4,4'-bis[2,6-di(naphthyl-2-oxy)pyrimidin-4-yl-amino]stilbene-2,2'-disulfonic acid, di-sodium salt (A-7) 4,4'-bis[2,6-di(naphthyl-2-oxy)pyrimidin-4-yl-amino]bibenzyl-2,2'-disulfonic acid, di-sodium salt (A-8) 4,4'-bis[2,6-diphenoxypyrimidin-4-ylamino)stilbene-2,2'-disulfonic acid, di-sodium salt (A-9) 4,4'-bis(2,6-diphenylthiopy:rimidin-4-ylamino)-stilbene-2,2'-disulfonic acid, di-sodium salt (A-10) 4,4'-bis(2,6-dichloropyrimidin-4-ylamino)stilbene-2,2'-disulfonic acid, di-sodium salt (A-11) 4,4'-bis(2,6-dianilinopyrimidin-4-ylamino)stilbene-2,2'-disulfonic acid, di-sodium salt (A-12) 4,4'-[4,6-di(naphthyl-2-oxy)triazin-2-ylamino]-stilbene-2,2'-disulfonic acid, di-sodium salt (A-13) 4,4'-bis(4,6-dianilinotriazin-2-ylamino)stilbene-2,2'-disulfonic acid, di-sodium salt (A-14) 4,4'-bis(2,6-dimercaptopyrimidin-4-ylamino)-biphenyl-2,2'-disulfonic acid, di-sodium salt (A-15) 4,4'-bis[4,6-di(naphthyl-2-oxy)pyrimidin-2-ylamino]stilbene-2,2'-disulfonic acid, di-sodium salt (A-16) 4,4'-bis[di(benzothiazolyl-2-thio)pyrimidin-2-ylamino]stilbene-2,2'-disulfonic acid, di-sodium salt (A-17) 4,4'-bis[4,6-di(1-phenyltetrazolyl-2-amino)-pyrimidin-2-ylamino]stilbene-2,2'-disulfonic acid, di-sodium salt (A-18) 4,4'-bis[4,6-di(naphthyl-2-oxy)pyrimidin-2-ylamino]bibenzyl-2,2'-disulfonic acid, di-sodium salt Either the aforementioned compound (I) or the aforementioned compound (A) may be added first, or both compounds can be added at the same time. Furthermore, the compound (I) and the compound (A) can be added in the form of a mixed solution.

The amount of compound (A) which is present is within the range from $1\times10^{-6}$ to $1\times10^{-1}$ mol, and preferably within the range from $5\times10^{-5}$ to $1\times10^{-2}$ mol, per mol of silver halide. Moreover, the preferred mol ratio of the compound (I) and the compound (A) which are present is within the range from 1/50 to 10/1.

The compounds of the general formula (II) are described in detail below.

In formula (II), the heterocyclic ring which may be formed condensed with the benzene ring which is formed by Q may be, for example, an imidazole, tetrazole, thiazole, oxazole, selenazole, benzimidazole, naphthoimidazole, benzothiazole, naphthothiazole, benzoselenazole, naphthoselenazole, benzoxazole, pyridine, pyrimidine or quinoline ring, and these heterocyclic groups may also have substituent groups.

Preferred mercaptotetrazole based compounds can be selected from compounds represented by the general formula (B) shown below.

General Formula [B]

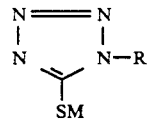

(B)

In the formula (B), R represents an alkyl group, an alkenyl group or an aryl group. M represents a hydrogen atom, an alkali metal atom, an ammonium group or a precursor thereof. The alkali metal atom may be, for example, sodium or potassium, and the ammonium group may be, for example, a trimethylammonium chloride group or a di-methyl-hexylammonium chloride group. Furthermore, the precursors are groups such that M becomes hydrogen or alkali metal under alkaline conditions, such as an acetyl group, a cyanoethyl group or a methanesulfonylethyl group.

Of the aforementioned R groups, suitable alkyl groups and alkenyl groups include both unsubstituted and substituted groups, and they also include alicyclic groups. Examples of substituent groups for the substituted alkyl groups include halogen atoms, alkoxy groups, aryl groups, acylamino groups, alkoxycarbonylamino groups, ureido groups, hydroxyl groups, amino groups, heterocyclic groups, acyl groups, sulfamoyl groups, sulfonamido groups, thioureido groups and carbamoyl groups, and carboxylic and sulfonic acid groups and salts of these groups.

The above mentioned ureido groups, thioureido groups, sulfamoyl groups, carbamoyl groups and amino groups include unsubstituted groups, N-alkyl substituted groups or N-aryl substituted groups. Examples of aryl groups include a phenyl group and substituted phenyl groups, and the substituent groups may be alkyl groups or those substituted alkyl groups described above.

Furthermore, preferred mercaptothiadiazole compounds can be selected from the compounds represented by the general formula (C) shown below.

General Formula [C]

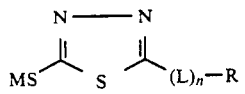

(C)

In this formula, L represents a divalent linking group, n is 0 or 1, and R represents a hydrogen atom, an alkyl group, an alkenyl group or an aryl group. The alkyl groups and alkenyl groups represented by R, and M, can be the same as those described in connection with general formula (B).

Specific examples of the above mentioned divalent linking groups represented by L include

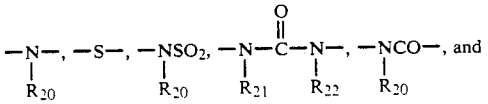

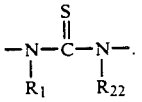

Moreover, n represents 0 or 1, and $R_{20}$, $R_{21}$, and $R_{22}$ each represents a hydrogen atom, an alkyl group or an aralkyl group.

Furthermore, the mercaptobenzimidazole, mercaptobenzoxazole and mercaptobenzothiazole compounds are preferably selected from compounds represented by the general formula (D) shown below.

General Formula [D]

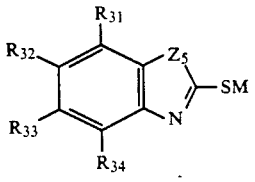

(D)

In the formula (D), $Z_5$ represents

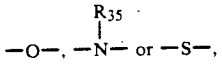

$R_{31}$, $R_{32}$, $R_{33}$ and $R_{35}$ each represents hydrogen atoms, halogen atoms or substituent groups, and M has the same significance as M in general formula (B).

Specific examples of groups represented by $R_{31}$, $R_{32}$, $R_{33}$, $R_{34}$ and $R_{35}$ include hydrogen atoms, halogen atoms (for example, fluorine, chlorine, bromine), substituted or unsubstituted alkyl groups (for example, methyl, trifluoromethyl, ethyl, 2-ethylhexyl, 2-ethylbutyl, 3-methylpentyl), substituted or unsubstituted aryl groups (for example, phenyl, 4-chlorophenyl), substituted or unsubstituted alkoxy groups and aryloxy groups (for example, methoxy, phenoxy, 2-ethylhexyloxy, 3,3-dimethylbutoxy, 3-methylpentyloxy), substituted or unsubstituted sulfonyl groups (for example, methanesulfonyl, p-toluenesulfonyl, 2-ethylhexylsulfonyl, 2-methylpentylsulfonyl), substituted or unsubstituted sulfonamido groups (for example, methanesulfonamido, p-toluenesulfonamido, 2-ethylhexylsulfonamido), substituted or unsubstituted sulfamoyl groups (for example, diethylsulfamoyl, 4-chlorophenylsulfamoyl, 1,3-dimethylbutylsulfamoyl, 2-ethylhexylsulfamoyl, 1-methylpentylsulfamoyl), substituted or unsubstituted carbamoyl groups (for example, ethylcarbamoyl, 4-cyanophenylcarbamoyl, 2-ethylhexylcarbamoyl, 1-methylhexylcarbamoyl), substituted or unsubstituted amido groups (for example, acetamido, benzamido, 2-ethylhexylamido, 2-phenoxybutanamido, 3,5,5-trimethylhexanamido), substituted or unsubstituted ureido groups (for example, 3-methylureido, morpholinecarbonylamino, 3-(2-dimethylbutyl)ureido, 3-(1,5-dimethylhexyl)ureido, 3-(2-methylheptyl)ureido), substituted or unsubstituted aryloxycarbonylamino groups and alkoxycarbonylamino groups (for example, ethoxycarbonylamino, phenoxycarbonylamino, 2-ethylhexylcarbonylamino), substituted or unsubstituted aryloxycarbonyl groups and alkoxycarbonyl groups (for example, methoxycarbonyl, phenoxycarbonyl, 2-ethylhexyloxycarbonyl, 1-methyloctyloxycarbonyl, 2,4-diethylheptyloxycarbonyl, 1-ethylpentyloxycarbonyl), substituted or unsubstituted arylcarbonyloxy groups and alkylcarbonyloxy groups (for example, acetyloxy, benzoyloxy, 2-ethylhexanoyloxy), substituted or unsubstituted arylaminocarbonyloxy groups and alkylaminocarbonyloxy groups (for example, phenylaminocarbonyloxy, 2-ethylhexylaminocarbonyloxy), cyano groups, substituted or unsubstituted arylthio groups and alkylthio groups (for example, methylthio, ethylthio, phenylthic, 2-ethylhexylthio, 2,4,4-trimethylpentylthio, 3-methylpentylthio), substituted or unsubstituted carbonyl groups (for example, acetyl, benzoyl, 2-ethylhexanoyl), substituted or unsubstituted amino groups (for example, unsubstituted amino, methylamino, diethylamino, anilino), carboxyl groups, sulfo groups, hydroxyl groups, and nitro groups. Here, $R_{31}$, $R_{32}$, $R_{33}$ and $R_{34}$ may be the same or different, and it is desirable that at least one of the groups represented by $R_{31}$, $R_{32}$, $R_{33}$ and $R_{34}$ should be a substituted or unsubstituted alkyl group which has from 1 to 3 carbon atoms, or an aryl group, which is bonded directly or via a divalent linking group. Amido bonds, sulfonamido bonds, ureido bonds, ether bonds, thioether bonds, sulfonyl bonds, carbonyl bonds and urethane bonds are especially desirable as the divalent linking groups.

Specific examples are shown below.

(B-1)
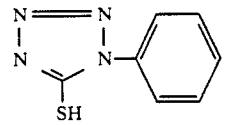
(B-2)
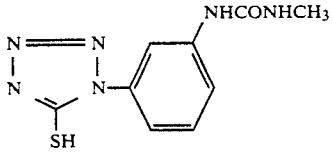
(B-3)
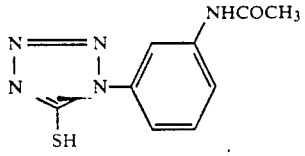
(B-4)
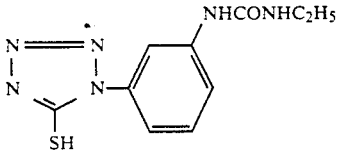
(B-5)
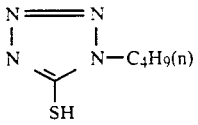
(B-6)
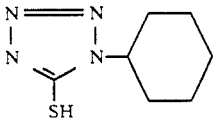
(B-7)
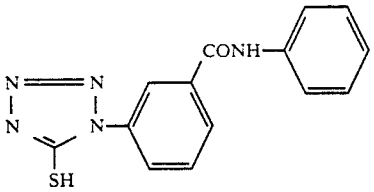
(B-8)
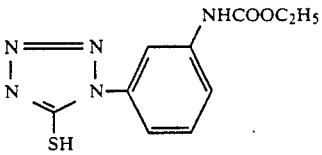
(B-9)
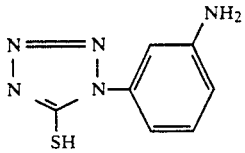
(B-10)
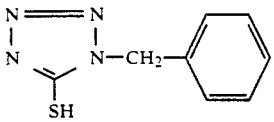
-continued
(B-11)
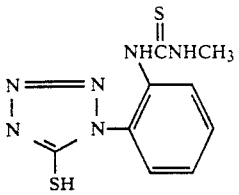
(B-12)
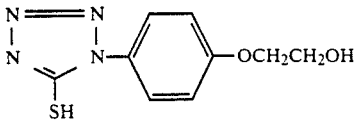
(C-1)
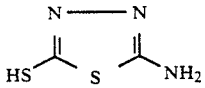
(C-2)
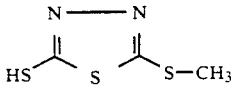
(C-3)
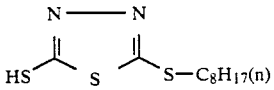
(C-4)
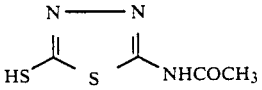
(C-5)
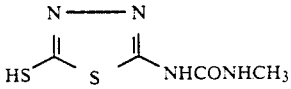
(C-6)
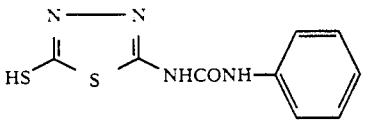
(D-1)
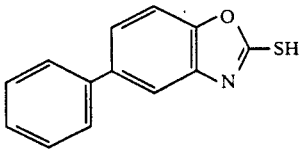
(D-2)
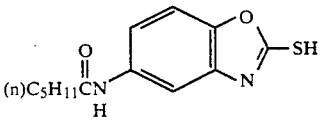
(D-3)
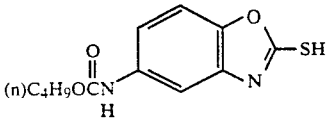
(D-4)
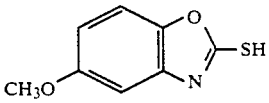

-continued
(D-5)
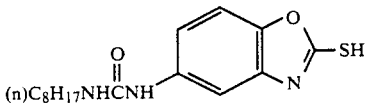
(D-6)
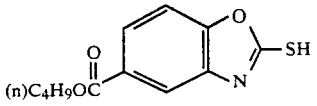
(D-7)
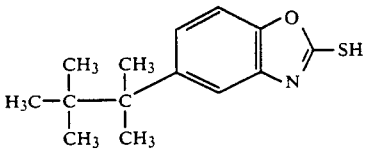
(D-8)
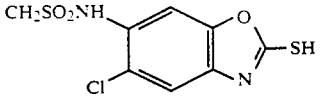
(D-9)
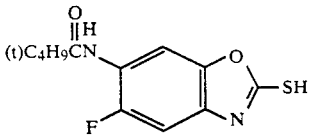
(D-10)
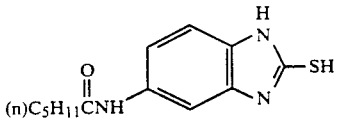
(D-11)
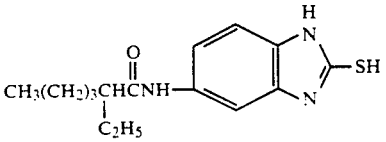
(D-12)
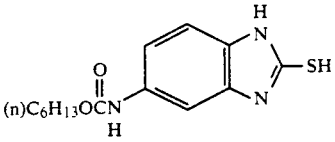
(D-13)
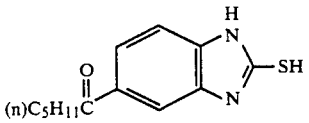
(D-14)
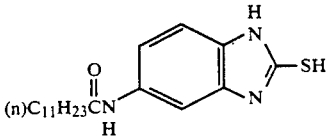
(D-15)
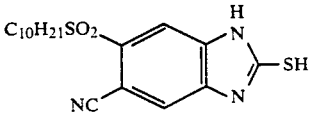
(D-16)
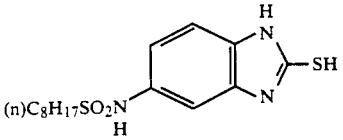
-continued
(D-17)
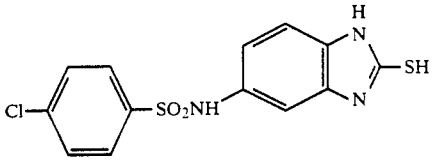
(D-18)
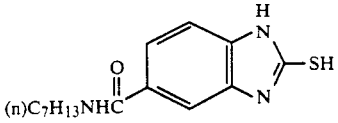
(D-19)
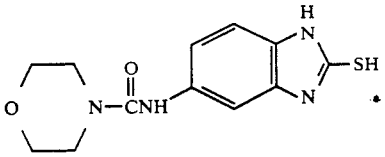
(D-20)
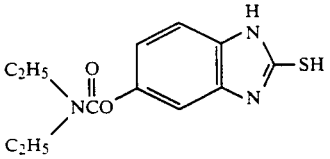
(D-21)
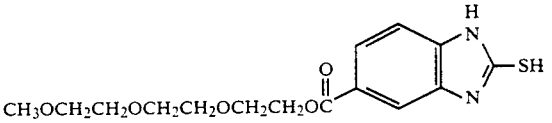
(D-22)
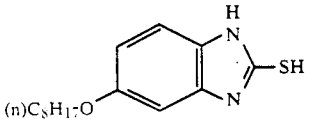
(D-23)
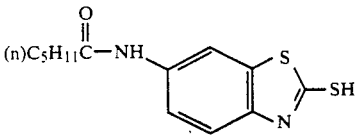
(D-24)
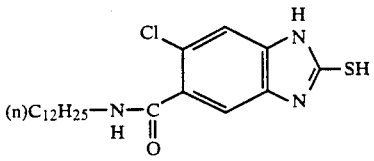
(D-25)
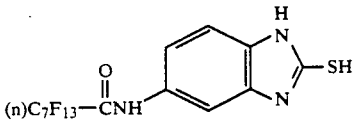
(D-26)
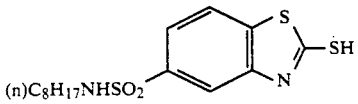
(D-27)
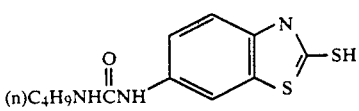

-continued (D-28)

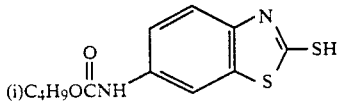

(D-29)

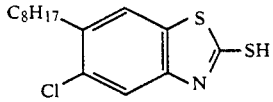

(D-30)

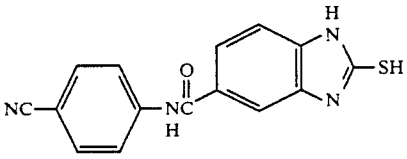

(D-31)

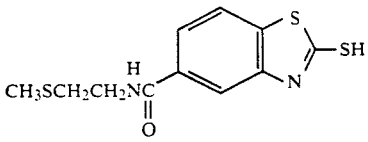

(D-32)

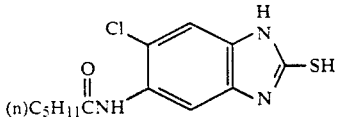

(D-33)

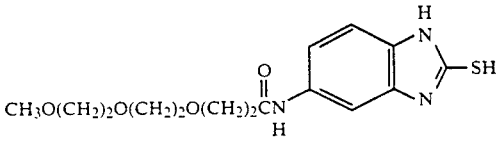

(D-34)

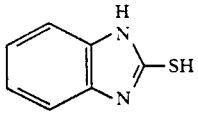

(D-35)

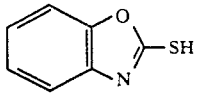

(D-36)

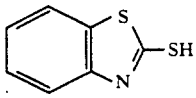

(D-37)

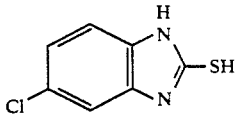

(D-38)

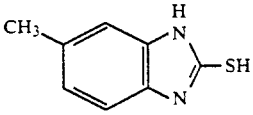

(D-39)

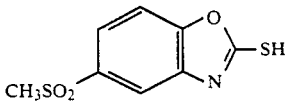

-continued (D-40)

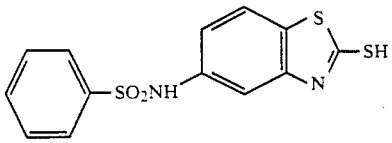

(D-41)

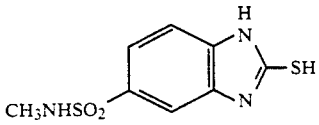

(D-42)

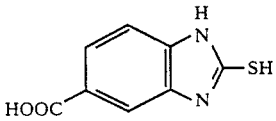

(D-43)

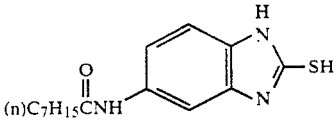

(D-44)

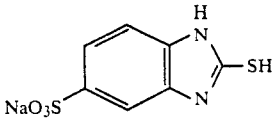

(D-45)

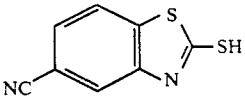

The compounds represented by general formula (II) which can be used in the present invention can be prepared easily on the basis of the synthesis examples described, for example, in J. Van Allan & B. D. Deacon, *Org. Synth IV*, 569 (1963), in J. Bunner, Ber., 9, 465 (1876), and in L. B. Sebrell & C. E. Boord, *J. Am. Chem. Soc.*, 45, 2390 (1923).

The amount of the compound represented by general formula (II) present is preferably from $1\times10^{-5}$ to $5\times10^{-2}$ mol, and most desirably from $1\times10^{-4}$ to $1\times10^{-2}$, per mol of silver halide.

The effect of this present invention can be achieved satisfactorily using compounds represented by the general formula (II) alone or in combination.

The most desirable combinations are those in which at least one compound represented by each of general formulae (C) and (D) are combined. The preferred combining ratio (mol ratio) is between 1:9 and 9:1, more desirably between 2:8 and 8:2, and most desirably between 3:7 and 7:3.

The addition of the compounds represented by general formula (II) can be made at any time from immediately after grain formation, before chemical ripening, during ripening or after chemical ripening, but the addition is preferably made after chemical ripening, and addition after the addition of the compound of general formula (I) has been completed is most effective.

The use of combinations with anti-foggants or stabilizers outside the scope of the invention is preferred. The use of aldehydes is especially desirable in this present invention. Actual compounds are indicated below as examples.

(E-1)

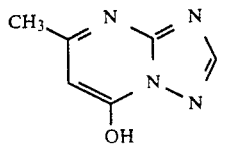

(E-2)

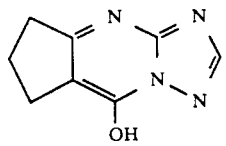

(E-3)

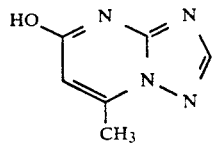

(E-4)

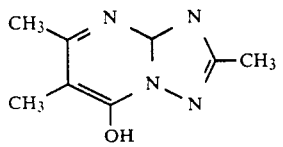

(E-5)

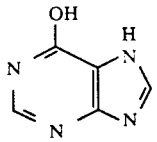

(E-6)

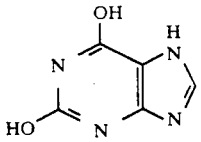

(E-7)

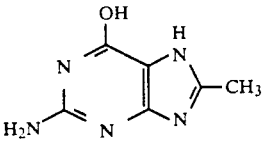

(E-8)

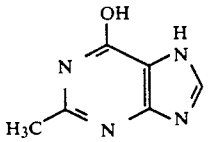

(E-9)

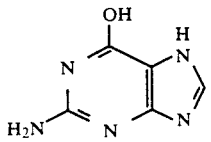

(E-10)

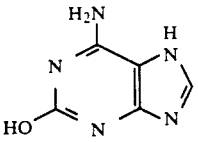

-continued (E-11)

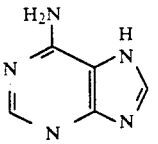

The compounds represented by general formula (III) are described in detail below.

Examples of alkyl groups represented by $R_{11}$ in general formula (III) include methyl, butyl, tridecyl, cyclohexyl and allyl groups, examples of aryl groups represented by $R_{11}$ include phenyl and naphthyl groups, and examples of heterocyclic groups represented by $R_{11}$ include 2-pyridyl and 2-furyl groups.

$R_{11}$ may be substituted with substituent groups selected from alkyl groups, alkyl or aryloxy groups (for example, methoxy, dodecyloxy, methoxyethoxy, phenyloxy, 2,4-di-tert-amylphenoxy, 3-tert-butyl-4-hydroxyphenyloxy, naphthyloxy), a carboxyl group, alkyl or aryl carbonyl groups (for example, acetyl, dodecanoyl, benzoyl), alkyl or aryl oxycarbonyl groups (for example, methoxycarbonyl, phenoxycarbonyl), acyloxy groups (for example, acetoxy, benzoyloxy), sulfamoyl groups (for example N-ethylsulfamoyl, N-octadecylsulfamoyl), carbamoyl groups (for example, N-ethylcarbamoyl, N-methyl-dodecylcarbamoyl), sulfonamido groups (for example, methanesulfonamido, benzenesulfonamido), acylamino groups (for example, acetylamino, benzamido, ethoxycarbonylamino, phenylaminocarbonylamino), imido groups (for example, succinimido, hydantoinyl), sulfonyl groups (for example, methanesulfonyl), hydroxyl group, cyano group, nitro group and halogen atoms.

Z in general formula (III) represents a hydrogen atom or a coupling leaving group, for example, a halogen atom (for example, fluorine, chlorine, bromine), an alkoxy group (for example, dodecyloxy, methoxycarbamoylmethoxy, carboxypropyloxy, methylsulfonylethoxy), an aryloxy group (for example, 4-chlorophenoxy, 4-methoxyphenoxy), an acyloxy group (for example, acetoxy, tetradecanoyloxy, benzoyloxy), a sulfonyloxy group (for example, methansulfonyloxy, toluenesulfonyloxy), an amido group (for example, dichloroacetylamino, methanesulfonylamino, toluenesulfonylamino), an alkoxycarbonyloxy group (for example, ethoxycarbonyloxy, benzyloxycarbonyloxy), an aryloxycarbonyloxy group (for example, phenoxycarbonyloxy), an aliphatic or aromatic thio group (for example, phenylthio, 2-butoxy-5-tert-octylphenylthio, tetrazolylthio), an imido group (for example, succinimido, hydantoinyl), an N-heterocyclic group (for example 1-pyrazolyl, 1-benztriazolyl), or an aromatic azo group (for example, phenylazo). These leaving groups may contain photographically useful groups.

The acylamino groups represented by $R_{12}$ in general formula (III) include, for example, acetylamino, benzamido, 2,4-di-tert-amylphenoxyacetamido, α-(2,4-di-tert-amylphenoxy)butylamido, α-(2,4-di-tert-amylphenoxy)-β-methylbutylamido, α-(2-chloro-4-tert-amylphenoxy)octanamido, α-(2-chlorophenoxy)tetradecanamido, and α-(3-pentadecylphenoxy)-butylamido, and alkyl groups which have at least one carbon atom represented by $R_{12}$ include methyl, ethyl, propyl, tert-butyl, pentadecyl and benzyl, but alkyl groups which have at least two carbon atoms are preferred.

$R_{13}$ in general formula (III) represents a hydrogen atom, a halogen atom (for example fluorine, chlorine, bromine), an alkyl group (for example methyl, ethyl, n-butyl, tert-butyl, n-octyl, n-tetradecyl), or an alkoxy group (for example, methoxy, 2-ethylhexyloxy, n-octyloxy, n-dodecyloxy).

Dimers or larger oligomers can be formed via $R_{11}$ or $R_{12}$ in general formula (III). Furthermore, $R_{12}$ and $R_{13}$ may be condensed to form a nitrogen containing heterocyclic ring (which is preferably a five to seven membered ring).

Preferred examples of cyan couplers for this present invention are indicated below, but the invention is not limited to these examples.

(III-1)

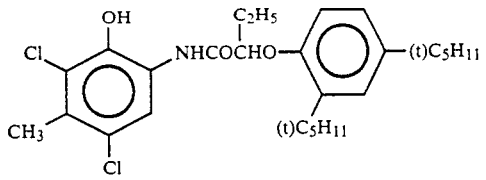

(III-2)

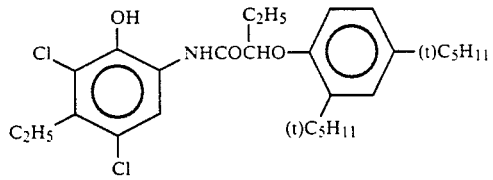

(III-3)

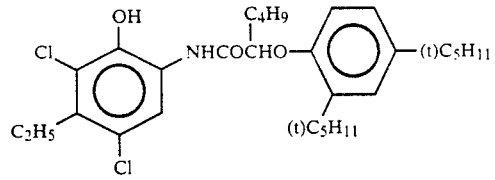

(III-4)

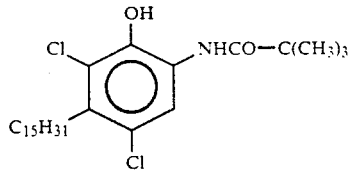

(III-5)

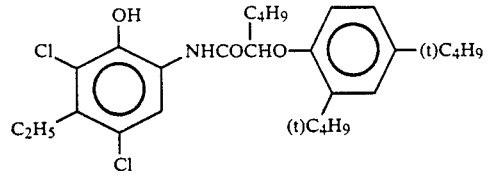

(III-6)

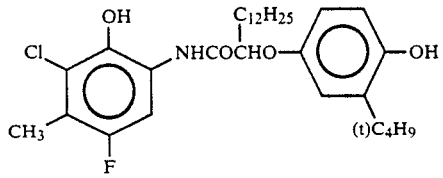

(III-7)

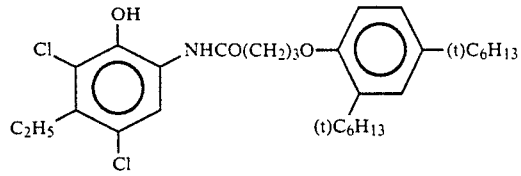

-continued
(III-8)
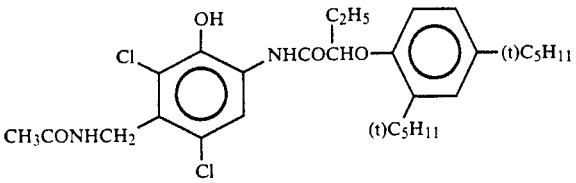
(III-9)
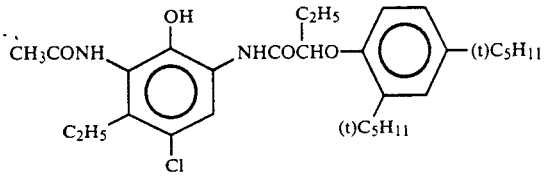
(III-10)
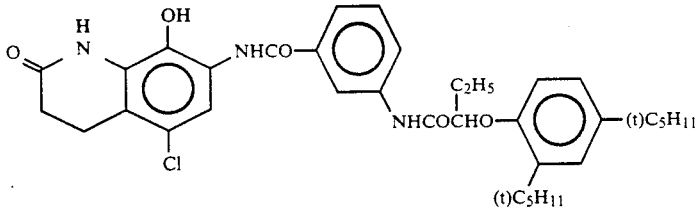
(III-11)
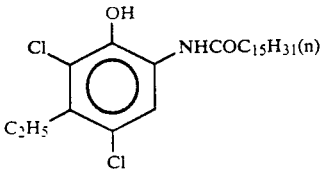
(III-12)
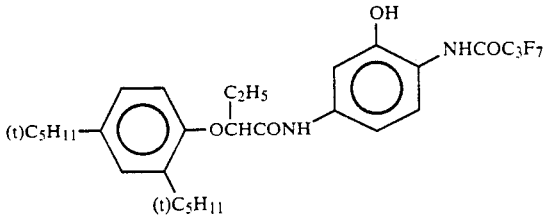
(III-13)
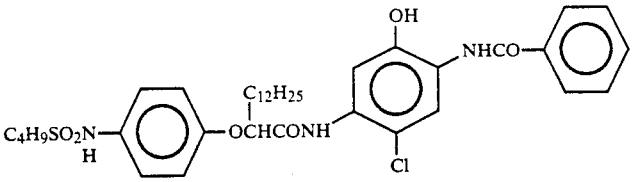
(III-14)
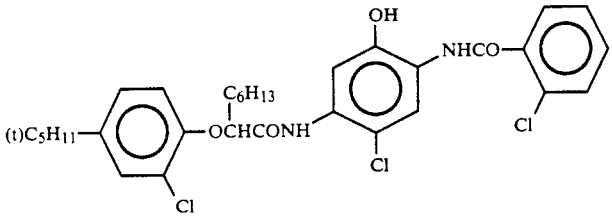
(III-15)
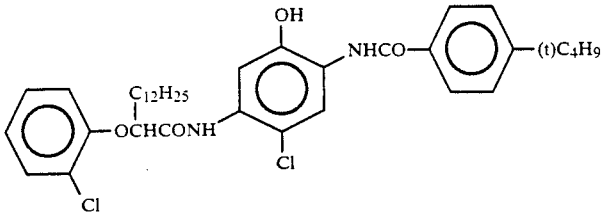

-continued
(III-16)
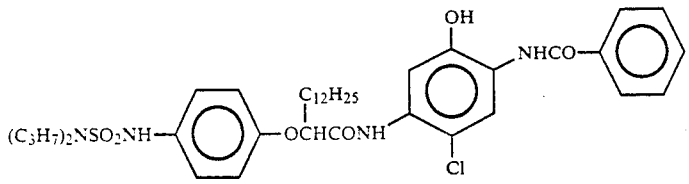
(III-17)
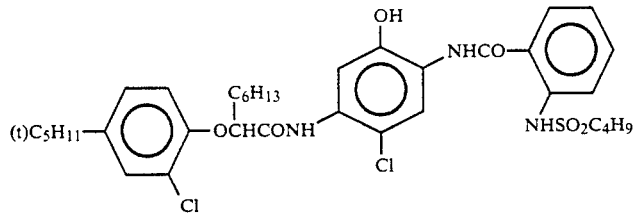
(III-18)
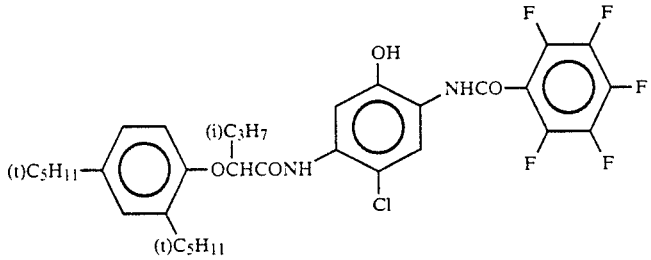
(III-19)
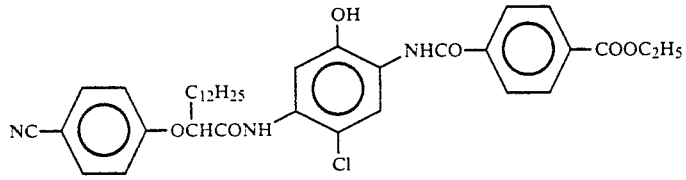
(III-20)
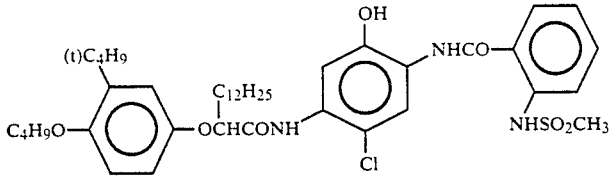
(III-21)
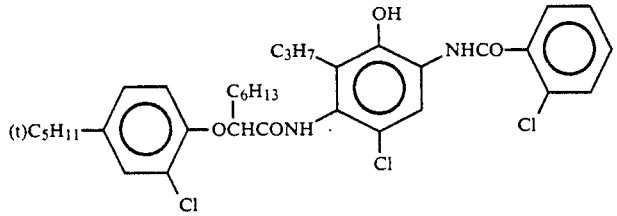
(III-22)
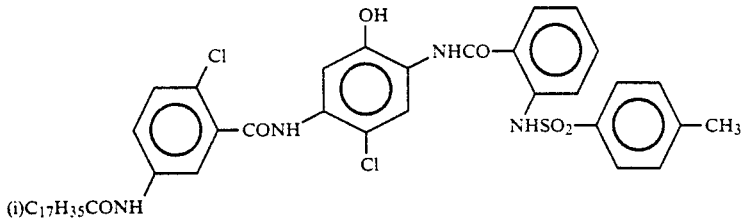

-continued
(III-23)
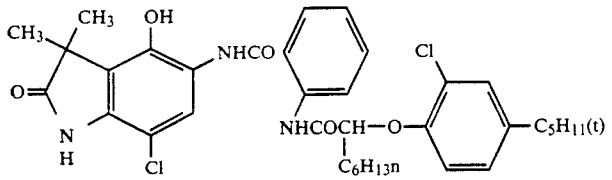
(III-24)
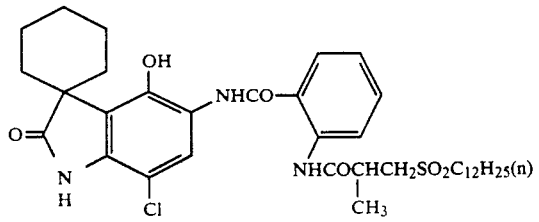
(III-25)
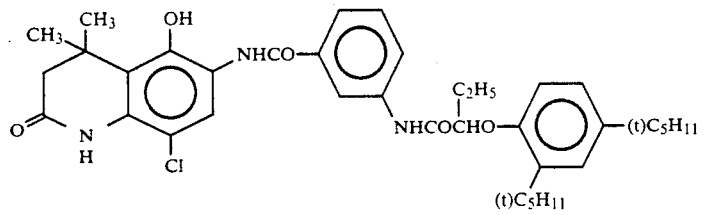
(III-26)
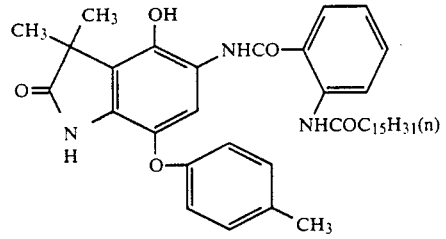
(III-27)
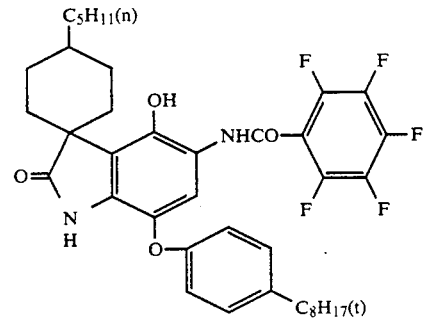
(III-28)
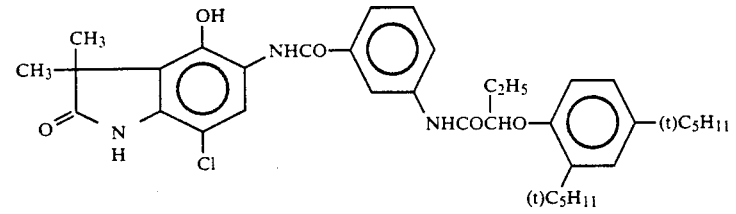

-continued
(III-29)
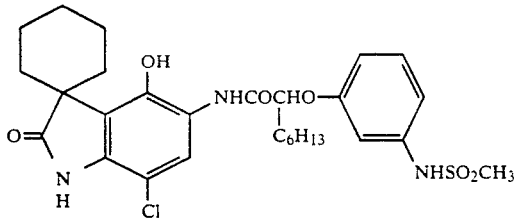
(III-30)
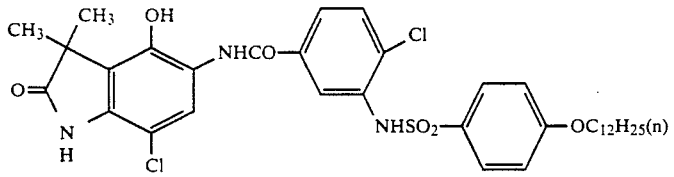
(III-31)
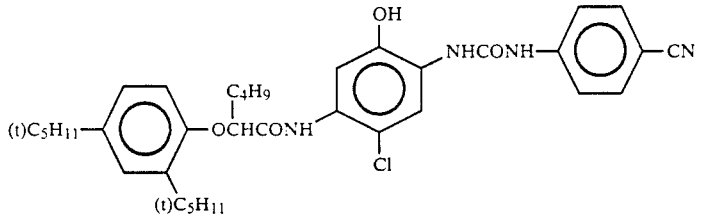
(III-32)
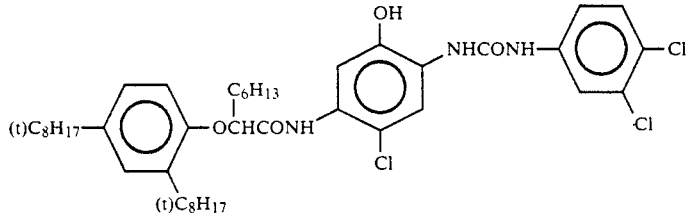
(III-33)
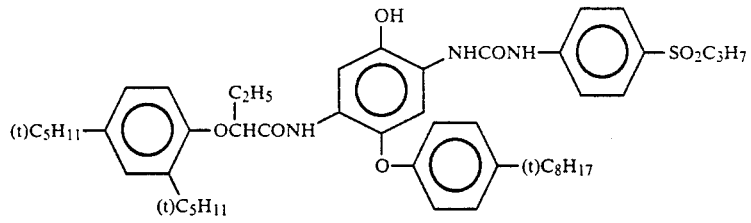
(III-34)
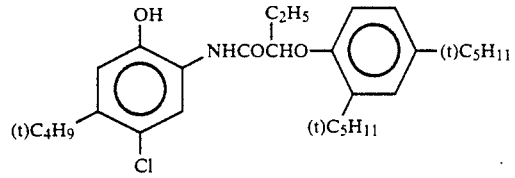
(III-35)
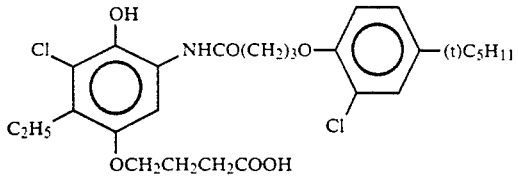

-continued
(III-36)
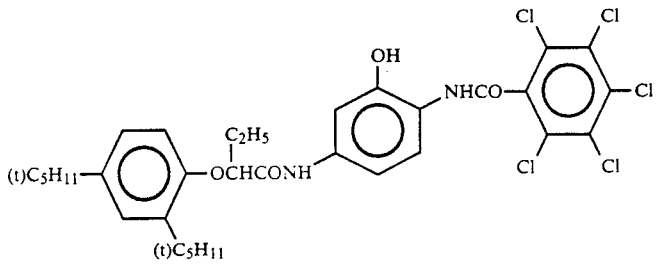
(III-37)
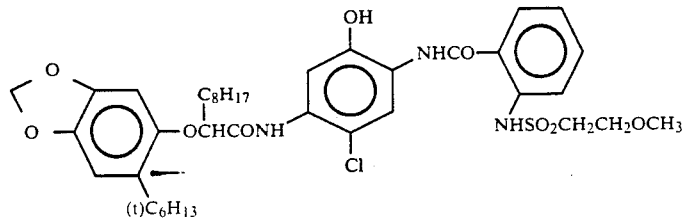
(III-38)
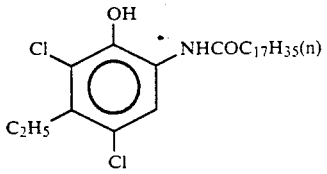
(III-39)
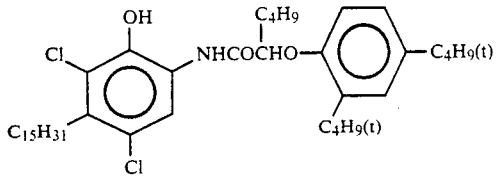
(III-40)
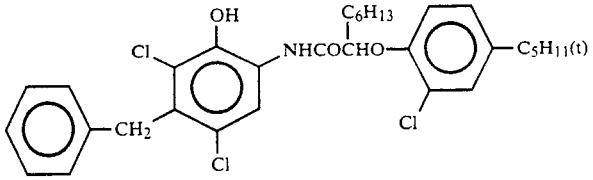
(III-41)
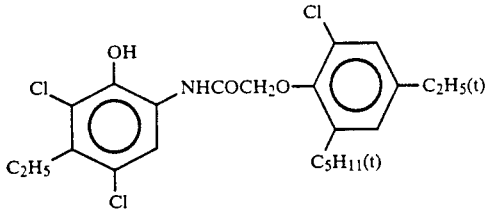
(III-42)
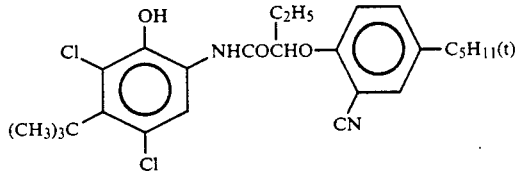
(III-43)
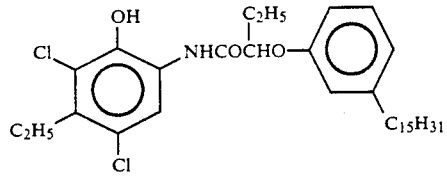

-continued (III-44)

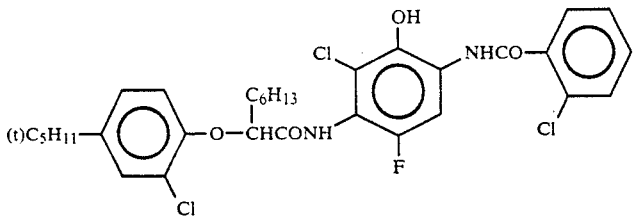

(III-45)

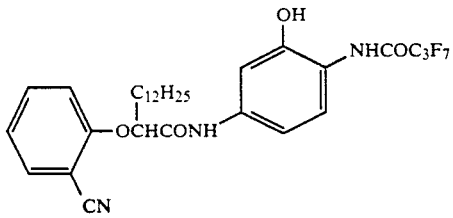

(III-46)

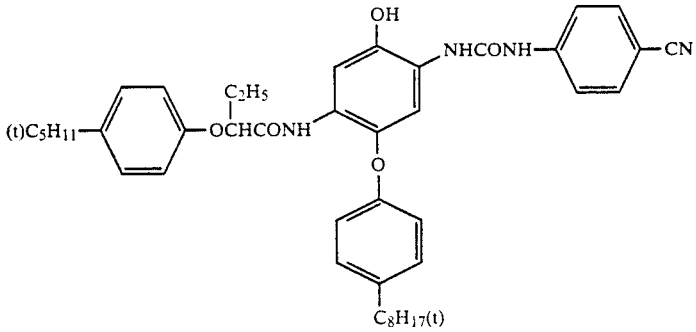

The amount of the aforementioned compound of general formula (III) used is within the range from 1/10 to 1 mol per mol of silver.

Any polymers can be used for the polymers which are used in this present invention provided that they are water insoluble and soluble in organic solvents as disclosed in WO88/00723, but polymers in which the repeating units have a $$-\overset{O}{\overset{\|}{C}}-$$

group are preferred from the point of view of the color forming properties and the improving effect on color fading for example.

Furthermore, monomers from which the polymers of the present invention are formed are preferably monomers of which the homo-polymers (molecular weight at least 20,000) have a glass transition point ($T_g$) of at least 50° C. More specifically, although there is a distinct improvement on image fastness under severe conditions (at high temperatures (above 80° C.) when polymers formed with monomers of which the $T_g$ value of homopolymers is less than 50° C., the effect is minimal under conditions close to room temperature, and the image fastness approaches that observed when no polymer has been added. On the other hand, the improvement under conditions approaching room temperature is similar to, or better than, that observed under severe conditions at high temperature (above 80° C.) when polymers formed from monomers of which the $T_g$ value of the homopolymers is greater than about 50° C. are used. There is an especially pronounced improvement under conditions close to room temperature when polymers formed from monomers of which the $T_g$ of the homopolymers is at least 80° C are used. This trend is especially notable when acrylamide based polymers and methacrylamide based polymers are used, and this is very desirable. Furthermore, polymers which have a pronounced heat fastness improving effect also tend to have a pronounced improving effect on light fastness, and the improving effect is especially pronounced in low density regions. Furthermore, the content of repeating units formed from the monomers described above in the polymers of this present invention is at least 35 mol %, preferably at least 50 mol %, and most desirably from 70 mol % to 100 mol %. Specific examples of polymers which are in accordance with the invention are described below, but the invention is not to be construed as being limited to these examples.

(A) Vinyl Polymers

Examples of monomers which can form vinyl polymers useful in the present invention include acrylic acid esters, for example, methyl acrylate, ethyl acrylate, n-propyl acrylate, iso-propyl acrylate, n-butyl acrylate, iso-butyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxy-polyethyleneglycol acrylate (number of mol added n=9), 1-bromo-2-methoxyethyl acrylate and 1,1-dichloro-2-ethoxyethyl acrylate.

The monomers indicated below can also be used to form vinyl polymers:

Methacrylic acid esters: specific examples include methyl methacrylate, ethyl methacrylate, n-propyl methacrylate, iso-propyl methacrylate, n-butyl methacrylate, iso-butyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxymethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2(2-ethoxyethoxy)ethyl methacrylate, 2-(2-butoxyethoxy)ethyl methacrylate, ω-methoxypolyethyleneglycol methacrylate, (number of mol added n=6), allyl methacrylate, and the dimethylaminoethylmethyl chloride salt of methacrylic acid;

Vinyl esters: specific examples include vinyl acetate, vinyl propionate, vinyl butyrate, vinyl isobutyrate, vinyl methoxyacetate, vinylphenyl acetate, vinyl benzoate and vinyl salicylate;

Acrylamides: for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethyl acrylamide, dimethylaminoethylacrylamide, phenylacrylamide, dimethylacrylamide, diethylacrylamide, β-cyanoethylacrylamide, N-(2-acetoacetoxyethyl)acrylamide, diacetoneacrylamide and tert-octylacrylamide;

Methacrylamides: for example, methacrylamide, methylmethacrylamide, ethylmethacrylam.ide, propylmethacrylamide, butylmethacrylamide, tert-butyl-methacrylamide, cyclohexylmethacrylamide, benzylmethacrylamide, hydroxymethylmethacrylamide, hydroxyethylmethacrylamide, dimethylaminoethylmethacrylamide, phenylmethacrylamide, dimethylmethacrylamide, diethylmethacrylamide, β-cyanoethylmethacrylamide and N-(2-acetoacetoxyethyl)methacrylamide;

Olefins: for example, dicyclopentadiene, ethylene, propylene, 1-butene, 1-pentene, vinyl chloride, vinylidene chloride, isoprene, chloroprene, butadiene, 2,3-dimethylbutadine: Styrenes: For example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and the methyl ethyl ester of vinyl salicylic acid; and Vinyl ethers: for example, methyl vinyl ether, butyl vinyl ether, hexyl vinyl ether, methoxyethyl vinyl ether, and dimethylaminoethyl vinyl ether;

Others: for example, butyl crotonate, hexyl crotonate, dimethyl itaconate, dibutyl itaconate, diethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile and vinylidene.

Two or more of the monomers which are used in the polymers of this present invention (for example, the monomers indicated above) can be used in combination as co-monomers for various purposes (for example, for improving solubility). Furthermore, monomers which have acid groups such as those indicated below can also be used as copolymers within a range such that the copolymer does not become water soluble in order to control color forming properties and solubility.

Acrylic acid; methacrylic acid; itaconic acid; maleic acid; monoalkyl itaconates, for example, monomethyl itaconate, monoethyl itaconate, monobutyl itaconate; monoalkyl maleates, for example momomethyl maleate, monoethyl maleate, monobutyl maleate; citraconic acid; styrenesulfonic acid; vinylbenzylsulfonic acid; vinylsulfonic acid; acryloyloxyalkylsulfonic acids, for example, acryloyloxymethylsulfonic acid, acryloyloxyethylsulfonic acid, acryloyloxypropylsulfonic acid; methacryloyloxyalkylsulfonic acids, for example, methacryloyloxymethylsulfonic acid, methacryloyloxyethylsulfonic acid, methacryloyloxypropylsulfonic acid; acrylamidoalkylsulfonic acids, for example, 2-acrylamido-2-methylethanesulfonic acid, 2-acrylamido-2-methylpropanesulfonic acid, 2-acrylamido-2-methylbutanesulfonic acid; methacrylamidoalkylsulfonic acids, for example, 2-methacrylamido-2-methanesulfonic acid, 2-methacrylamido-2-methylpropanesulfonic acid, 2-methacrylamido-2-methylbutanesulfonic acid; and the alkali metal (for example Na, K) or ammonium ion salts of these acids can be used.

In those cases in which the vinyl monomers indicated above and the other hydrophilic monomers among the vinyl monomers which can be used in the invention (referred to herein as monomers of which the homopolymers are water soluble) are used as co-monomers, no particular limitation is imposed upon the proportion of hydrophilic monomer in the copolymer provided that the copolymer does not become water soluble, but under normal circumstances the proportion is preferably not more than 40 mol %, more desirably not more than 20 mol %, and most desirably not more that 10 mol.%. Furthermore, in those cases in which the hydrophilic comonomer which is copolymerized with a monomer of the present invention having an acid group, the proportion in the copolymer of the co-monomer which has the acid group is usually not more than 20 mol %, and preferably not more than 10 mol %, from the point of view of the image storage properties, as mentioned earlier, and the absence of such comonomers is most desirable.

Methacrylate based polymers, acrylamide based polymers and methacrylamide based polymers are preferred as the polymers in which these monomers are used in the present invention. Of these, acrylamide based polymers and methacrylamide based polymers are the most desirable.

(B) Polymers Obtained by Condensation and Addition Reactions

Polyesters obtained from poly-hydric alcohols and polybasic acids, and polyamides obtained from diamines and dibasic acids, and ε-amino-ε'-carboxylic acids, for example, are generally known as polymers obtained by condensation, and polyurethanes, for example, obtained from diisocyanates and dihydric alcohols are known as polymers obtained by means of an addition reaction.

Glycols which have an HO—$R_a$—OH structure (where $R_a$ is a hydrocarbon chain, especially an aliphatic hydrocarbon chain which has from 2 to 12 carbon atoms, or polyalkylene glycols, are effective as polyhydric alcohols, and dibasic acids which have an HOOC—$R_b$—COOH structure (where $R_b$ may represent a single bond or a hydrocarbon chain which has from 1 to about 12 carbon atoms) are effective as the poly-basic acids.

Specific examples of polyhydric alcohols include ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerin, diglycerin, triglycerin, 1-methylglycerin, erythritol, mannitol and sorbitol.

Specific examples of polybasic acids include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, iso-phthalic acid, terephthalic acid, tetrachlorophthalic acid, metaconic acid, iso-pimelic acid, cyclopentadiene/maleic anhydride adduct and rosin/-maleic acid adduct.

Examples of diamines include hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene and di(4-aminophenyl)ether.

Examples of -amino- -carboxylic acids include glycine, β-alanine, 3-aminopropionic acid, 4-aminobutanoic acid, 5-aminopentanoic acid, 11-aminododecanoic acid, 4-aminobenzoic acid, 4-(2-aminoethyl)benzoic acid and 4-(4-aminophenyl)-butanoic acid.

Examples of isocyanates include ethylenediisocyanate, hexamethylenediisocyanate, m-phenylenediisocyanate, p-phenylenediisocyanate, p-xylenediisocyanate, and 1,5-naphthyldiisocyanate.

(C) Others

For example, polyesters and polyamides obtained by means of a ring opening polymerization:

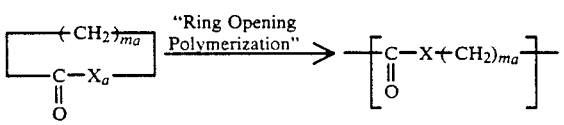

In this formula, $X_a$ represents —O— or —NH—, and $m_a$ represents an integer of value from 4 to 7. Moreover, the —$CH_2$— groups may include branching. Examples of such monomers include β-propiolactone, ε-caprolactone, dimethylpropiolactone, α-pyrrolidone, α-piperidone, ε-caprolactam, and α-methyl-ε-caprolactam.

Optionally, two or more types of polymer of the present invention as described above can be used in combination.

The molecular weight or degree of polymerization of the polymers of this present invention does not greatly affect the effect of the invention in practice, but problems arise with the time taken when dissolving the polymers in auxiliary solvents as the molecular weight increases, emulsification and dispersion become more difficult as a result of the increased solution viscosity, the particles become coarser with a consequent adverse effect on the color forming properties, and problems are also likely to arise as a result of coating failure. The use of larger amounts of auxiliary solvent to reduce the viscosity and so overcome these problems causes problems. From the viewpoint of the above problems, the viscosity when 30 grams of the polymer is dissolved in 100 cc of the auxiliary solvent which is to be used is preferably not more than 5000 cps, and most desirably not more than 2000 cps. The molecular weight of the polymers which can be used in the invention is preferably 5000 to 150,000, and most desirably 10,000 to 100,000.

The water insoluble polymers in this present invention are polymers of which not more than 3 grams, and preferably not more than 1 gram, can be dissolved in 100 grams of distilled water at 40° C.

The proportion of polymer of the invention to auxiliary solvent differs depending on the type of polymer which is being used, and varies across a wide range depending on the solubility in the auxiliary solvent and the degree of polymerization, for example, and on the solubility of the coupler present etc. Normally, the amount of auxiliary solvent required to reduce the viscosity of a solution obtained by dissolving at least the coupler, the high boiling point solvent and the polymer in the auxiliary solvent sufficiently so that it can be dispersed easily in water or in an aqueous hydrophilic colloid solution is used. The solution viscosity increases as the degree of polymerization of the polymer increases and so it is difficult to formulate a general rule for the proportion of polymer with respect to the auxiliary solvent for all polymers, but a proportion within the range from 1:1 to 1:5 (by weight) is usually preferred. The proportion of the polymer of the invention with respect to the coupler (by weight) is preferably from 1:20 to 20:1, and most desirably from 1:10 to 10:1.

Some specific examples of polymers which can be used in the present invention are shown below, but the present invention is not to be construed as being limited by these examples. In the examples, below the ratio of monomers shown in parentheses is the molar ratio of the monomers.

| Example | Polymer Type |
|---|---|
| (P-1) | Poly(vinyl acetate) |
| (P-2) | Poly(vinyl propionate) |
| (P-3) | Poly(methyl methacrylate) |
| (P-4) | Poly(ethyl methacrylate) |
| (P-5) | Poly(ethyl acrylate) |
| (P-6) | Vinyl acetate/vinyl alcohol copolymer (95:5) |
| (P-7) | Poly(n-butyl acrylate) |
| (P-8) | Poly(n-butyl methacrylate) |
| (P-9) | Poly(isobutyl methacrylate) |
| (P-10) | Poly(isopropyl methacrylate) |
| (P-11) | Poly(decyl methacrylate) |
| (P-12) | n-Butyl acrylate/acrylamide copolymer (95:5) |
| (P-13) | Poly(methyl chloroacrylate) |
| (P-14) | 1,4-Butanediol/adipic acid polyester |
| (P-15) | Ethylene glycol/sebacic acid polyester |
| (P-16) | Polycaprolactone |
| (P-17) | Poly(2-tert-butylphenyl acrylate) |
| (P-18) | Poly(4-tert-butylphenyl acrylate) |
| (P-19) | n-Butyl methacrylate/N-vinyl-2-pyrrolidone |

-continued

| Example | Polymer Type |
|---|---|
| | copolymer(90:10) |
| (P-20) | Methyl methacrylate/vinyl chloride copolymer (70:30) |
| (P-21) | Methyl methacrylate/styrene copolymer (90:10) |
| (P-22) | Methyl methacrylate/ethyl acrylate copolymer (50:50) |
| (P-23) | n-Butyl methacrylate/methyl methacrylate/styrene copolymer (50:30:20) |
| (P-24) | Vinyl acetate/acrylamide copolymer (85:15) |
| (P-25) | Vinyl chloride/vinyl acetate copolymer (65:35) |
| (P-26) | Methyl methacrylate/acrylonitrile copolymer (65:35) |
| (P-27) | Diacetoneacrylamide/methyl methacrylate copolymer (50:50) |
| (P-28) | Vinyl methyl ketone/isobutyl methacrylate copolymer (55:45) |
| (P-29) | Ethyl methacrylate/n-butyl acrylate copolymer (70:30) |
| (P-30) | Diacetoneacrylamide/n-butyl acrylate copolymer (60:40) |
| (P-31) | Methyl methacrylate/cyclohexyl methacrylate copolymer (50:50) |
| (P-32) | n-Butyl acrylate/styrene methacrylate/diacetone-acrylamide copolymer (70:20:10) |
| (P-33) | N-tert-butylacrylamide/methyl methacrylate/acrylic acid copolymer (60:30:10) |
| (P-34) | Methyl methacrylate/styrene/vinylsulfonamide copolymer (70:20:10) |
| (P-35) | Methyl methacrylate/phenyl vinyl ketone copolymer (70:30) |
| (P-36) | n-Butyl acrylate/methyl methacrylate/n-butyl methacrylate copolymer (35:35:30) |
| (P-37) | n-Butyl methacrylate/pentyl methacrylate/N-vinyl-2-pyrrolidone copolymer (38:38:24) |
| (P-38) | Methyl methacrylate/n-butyl methacrylate/isobutyl methacrylate/acrylic acid copolymer (37:29:25:9) |
| (P-39) | n-Butyl methacrylate/acrylic acid copolymer (95:5) |
| (P-40) | Methyl methacrylate/acrylic acid copolymer (95:5) |
| (P-41) | Benzyl methacrylate/acrylic acid copolymer (90:10) |
| (P-42) | n-Butyl methacrylate/methyl methacrylate/benzyl methacrylate/acrylic acid copolymer (35:35:25:5) |
| (P-43) | n-Butyl methacrylate/methyl methacrylate/benzyl methacrylate copolymer (35:35:30) |
| (P-44) | Poly(3-pentyl acrylate) |
| (P-45) | Cyclohexyl methacrylate/methyl methacrylate/n-propyl methacrylate copolymer (37:29:34) |
| (P-46) | Poly(pentyl methacrylate) |
| (P-47) | Methyl methacrylate/n-butyl methacrylate copolymer (65:35) |
| (P-48) | Vinyl acetate/vinyl propionate copolymer (75:25) |
| (P-49) | n-Butyl methacrylate/5-acryloxybutane-1-sulfonic acid, sodium salt, copolymer (97:3) |
| (P-50) | n-Butyl methacrylate/methyl methacrylate/acrylamide copolymer (35:35:30) |
| (P-51) | n-Butyl methacrylate/methyl methacrylate/vinyl chloride copolymer (37:36:27) |
| (P-52) | n-Butyl methacrylate/styrene copolymer (90:10) |
| (P-53) | Methyl methacrylate/N-vinyl-2-pyrrolidone copolymer (90:10) |
| (P-54) | n-Butyl methacrylate/vinyl chloride copolymer (90:10) |
| (P-55) | n-Butyl methacrylate/styrene copolymer (70:30) |
| (P-56) | Poly(N-sec-butylacrylamide) |
| (P-57) | Poly(N-tert-butylacrylamide) |
| (P-58) | Diacetoneacrylamide/methyl methacrylate copolymer (62:38) |
| (P-59) | Poly(Cyclohexyl methacrylate)/methyl acrylate copolymer (60:40) |
| (P-60) | N-tert-butyl acrylamide/methyl methacrylate copolymer (40:60) |
| (P-61) | Poly(N-n-butylacrylamide) |
| (P-62) | Poly(tert-butyl methacrylate)/N-tert-butylacrylamide copolymer (50:50) |
| (P-63) | Tert-butyl methacrylate/methyl methacrylate copolymer (70:30) |
| (P-64) | Poly(N-tert-butylmethacrylamide) |
| (P-65) | N-tert-acrylamide/methyl methacrylate copolymer (60:40) |
| (P-66) | Methyl methacrylate/acrylonitrile copolymer (70:30) |
| (P-67) | Methyl methacrylate/vinyl methyl ketone copolymer (38:62) |
| (P-68) | Methyl methacrylate/styrene copolymer (75:25) |
| (P-69) | Methyl methacrylate/hexyl methacrylate copolymer (70:30) |
| (P-70) | Poly(benzyl acrylate) |

-continued

| Example | Polymer Type |
|---|---|
| (P-71) | Poly(4-biphenyl acrylate) |
| (P-72) | Poly(4-butoxycarbonylphenyl acrylate) |
| (P-73) | Poly(sec-butyl acrylate) |
| (P-74) | Poly(tert-butyl acrylate) |
| (P-75) | Poly(3-chloro-2,2-bis{chloromethyl}propyl acrylate) |
| (P-76) | Poly(2-chlorophenyl acrylate) |
| (P-77) | Poly(4-chlorophenyl acrylate) |
| (P-78) | Poly(pentachlorophenyl acrylate) |
| (P-79) | Poly(4-cyanobenzyl acrylate) |
| (P-80) | Poly(cyanoethyl acrylate) |
| (P-81) | Poly(4-cyanophenyl acrylate) |
| (P-82) | Poly(4-cyano-3-thiabutyl acrylate) |
| (P-83) | Poly(cyclohexyl acrylate) |
| (P-84) | Poly(2-ethoxycarbonylphenyl acrylate) |
| (P-85) | Poly(3-ethoxycarbonylphenyl acrylate) |
| (P-86) | Poly(4-ethoxycarbonylphenyl acrylate) |
| (P-87) | Poly(2-ethoxyethyl acrylate) |
| (P-88) | Poly(3-ethoxypropyl acrylate) |
| (P-89) | Poly(1H,1H,5H-octafluoropentyl acrylate) |
| (P-90) | Poly(heptyl acrylate) |
| (P-91) | Poly(hexadecyl acrylate) |
| (P-92) | Poly(hexyl acrylate) |
| (P-93) | Poly(isobutyl acrylate) |
| (P-94) | Poly(isopropyl acrylate) |
| (P-95) | Poly(3-methoxybutyl acrylate) |
| (P-96) | Poly(2-methoxycarbonylphenyl acrylate) |
| (P-97) | Poly(3-methoxycarbonylphenyl acrylate) |
| (P-98) | Poly(4-methoxycarbonylphenyl acrylate) |
| (P-99) | Poly(2-methoxyethyl acrylate) |
| (P-100) | Poly(4-methoxyphenyl acrylate) |
| (P-101) | Poly(3-methoxypropyl acrylate) |
| (P-102) | Poly(3,5-dimethyladamantyl acrylate) |
| (P-103) | Poly(3-dimethylaminophenyl acrylate) |
| (P-104) | Poly(vinyl tert-butyrate) |
| (P-105) | Poly(2-methylbutyl acrylate) |
| (P-106) | Poly(3-methylbutyl acrylate) |
| (P-107) | Poly(1,3-dimethylbutyl acrylate) |
| (P-108) | Poly(2-methylpentyl acrylate) |
| (P-109) | Poly(2-naphthyl acrylate) |
| (P-110) | Poly(phenyl methacrylate) |
| (P-111) | Poly(propyl acrylate) |
| (P-112) | Poly(m-tolyl acrylate) |
| (P-113) | Poly(o-tolyl acrylate) |
| (P-114) | Poly(p-tolyl acrylate) |
| (P-115) | Poly(N,N-dibutylacrylamide) |
| (P-116) | Poly(isohexylacrylamide) |
| (P-117) | Poly(iso-octylacrylamide) |
| (P-118) | Poly(N-methyl-N-phenylacrylamide) |
| (P-119) | Poly(adamantyl methacrylate) |
| (P-120) | Poly(benzyl methacrylate) |
| (P-121) | Poly(2-bromoethyl methacrylate) |
| (P-122) | Poly(2-N-tert-butylaminoethyl methacrylate) |
| (P-123) | Poly(sec-butyl methacrylate) |
| (P-124) | Poly(tert-butyl methacrylate) |
| (P-125) | Poly(2-chloroethyl methacrylate) |
| (P-126) | Poly(cyanoethyl methacrylate) |
| (P-127) | Poly(2-cyanomethylphenyl methacrylate) |
| (P-128) | Poly(4-cyanophenyl methacrylate) |
| (P-129) | Poly(cyclohexyl methacrylate) |
| (P-130) | Poly(dodecyl methacrylate) |
| (P-131) | Poly(diethylaminoethyl methacrylate) |
| (P-132) | Poly(2-ethylsulfinylethyl methacrylate) |
| (P-133) | Poly(hexadecyl methacrylate) |
| (P-134) | Poly(hexyl methacrylate) |
| (P-135) | Poly(2-hydroxypropyl methacrylate), |
| (P-136) | Poly(4-methoxycarbonylphenyl methacrylate) |
| (P-137) | Poly(3,5-dimethyladamantyl methacrylate) |
| (P-138) | Poly(dimethylaminoethyl methacrylate) |
| (P-139) | Poly(3,3-dimethylbutyl methacrylate) |
| (P-140) | Poly(3,3-dimethyl-2-butyl methacrylate) |
| (P-141) | Poly(3,5,5-trimethylhexyl methacrylate) |
| (P-142) | Poly(octadecyl methacrylate) |
| (P-143) | Poly(tetradecyl methacrylate) |
| (P-144) | Poly(4-butoxycarbonylphenylmethacrylamide) |
| (P-145) | Poly(4-carboxyphenylmethacrylamide) |
| (P-146) | Poly(4-ethoxycarbonylphenylmethacrylamide) |
| (P-147) | Poly(4-methoxycarbonylphenylmethacrylamide) |
| (P-148) | Poly(butylbutoxycarbonyl methacrylate) |
| (P-149) | Poly(butyl chloroacrylate) |
| (P-150) | Poly(butyl cyanoacrylate) |

-continued

| Example | Polymer Type |
|---|---|
| (P-151) | Poly(cyclohexyl chloroacrylate) |
| (P-152) | Poly(ethyl chloroacrylate) |
| (P-153) | Poly(ethyl ethoxycarbonylmethacrylate) |
| (P-154) | Poly(ethyl ethacrylate) |
| (P-155) | Poly(Ethyl fluoromethacrylate) |
| (P-156) | Poly(hexyl hexyloxycarbonylmethacrylate) |
| (P-157) | Poly(isobutyl chloroacrylate) |
| (P-158) | Poly(isopropyl chloroacrylate) |
| (P-159) | Trimethylenediamine/glutaric acid polyamide |
| (P-160) | Hexamethylenediamine/adipic acid polyamide |
| (P-161) | Poly(α-pyrrolidone) |
| (P-162) | Poly(ε-caprolactam) |
| (P-163) | Hexamethylenediisocyanate/1,4-butanediol polyurethane |
| (P-164) | p-(Phenylenediisocyanate/ethylene glycol polyurethane |

Those of the above mentioned polymers which have a relative fluorescence yield as defined in Japanese Patent Application No. 63-12075 of at least 0.2 are preferred.

In the following examples of syntheses of polymers used in the present invention, unless otherwise indicated herein, all parts, percents, ratios and the like are by weight.

SYNTHESIS EXAMPLE (1)

Precaration of Methyl Methacrylate Polymer P-3

Methyl methacrylate (50.0 grams), 0.5 gram of poly(-sodium acrylate) and 200 ml of distilled water were introduced into a three necked flask of capacity 500 ml and heated to 80° C. with stirring under a blanket of nitrogen. Next, 500 mg of azobis(dimethylisobutyrate) was added as a polymerization initiator and polymerization commenced.

The polymerization mixture was cooled after polymerizing for a period of 2 hours, and 48.7 grams of the Polymer P-3 was obtained by recovering the polymer beads and washing them with water.

SYNTHESIS EXAMPLE (2)

Preparation of t-Butylacrylamide Polymer P-57

A mixture comprising 50.0 grams of t-butylacrylamide and 250 ml of toluene was introduced into a three necked flask of 500 ml capacity and heated to 80° C. with stirring under a blanket of nitrogen.

Next, 10 ml of a toluene solution which contained 500 mg of azobisisobutyronitrile was added as a polymerization initiator and polymerization commenced. The polymerization mixture was cooled after polymerizing for a period of 3 hours, and 47.9 grams of Polymer p-57 was obtained by pouring the reaction mixture into 1 liter of hexane, recovering the solid which precipitated out by filtration, washing with hexane and drying by heating under reduced pressure.

Dispersions of fine lipophilic particles which contain couplers, high boiling point solvents and polymers, of the present invention, can be prepared in the following way.

Thus, the polymers of this present invention which are so-called linear polymers, prepared by solution polymerization, emulsion polymerization or suspension polymerization, for example, with no crosslinking, the high boiling point coupler solvents and the couplers are dissolved completely in an auxiliary organic solvent, after which the solution is dispersed in the form of fine particles, using ultrasonics or a colloid mill, for example, with the aid of a dispersing agent, in water or, preferably, in an aqueous hydrophilic colloid solution or, most desirably, in an aqueous gelatin solution, and then added to the silver halide emulsion. Alternatively, water or an aqueous hydrophilic colloid solution such as an aqueous gelatin solution can be added to an auxiliary organic solvent which contains a dispersion promotor such as a surfactant, a polymer of this present invention, a high boiling point coupler solvent and a coupler, and an oil in water dispersion can be obtained by phase reversal. The auxiliary organic solvent is then removed from the dispersion by distillation, noodle washing or ultrafiltration, for example, after which the dispersion is mixed with the photographic emulsion. Here, the auxiliary organic solvent is an organic solvent which is useful during emulsification and dispersion and which can be essentially removed from the photosensitive material ultimately during the drying process at the time of coating or by using the methods mentioned above, and these solvents may have a low boiling point or they have a ceratin degree of solubility in water so that they can be removed by washing with water for example. Thus, acetates of lower alcohol such as ethyl acetate, butyl acetate, etc., ethyl propionate, sec-butyl alcohol, methyl ethyl ketone, methyl isobutyl ketone, β-ethoxyethyl acetate, methylcellosolve acetate and cyclohexanone can be used, for example, as auxiliary organic solvents.

Moreover, solvents which are completely miscible with water, for example methyl alcohol, ethyl alcohol, acetone and tetrahydrofuran, can be used conjointly, as required.

Furthermore, combinations of two or more of these solvents can be used.

The average particle size of the fine lipophilic particles obtained in this way is preferably from 0.04μ to 2μ, and most desirably from 0.06μ to 0.4μ. The average particle size of the lipophilic particles can be measured using a measuring device such as a Nano-Sizer made by the British Coulter Co.

In the present invention, the preferred combinations comprise a cyan coupler of general formula (III) and a polymer formed with at least 50% of a monomer of which the $T_g$ of the homopolymer is at least 50° C., more desirable combinations comprise a cyan coupler of general formula (III) and a polymer formed with at least 70 mol % of a monomer of which the $T_g$ of the homopolymer is at least 80° C., and the most desirable combinations comprise a cyan coupler of general formula (III) in which $R_{12}$ is an alkyl group which has from 2 to 4 carbon atoms and a polymer of which at least 70 mol.% is formed of an acrylamide based monomer and/or methacrylamide based monomer of which the $T_g$ value(s) of the homopolymer(s) is above 80° C.

High boiling point coupler solvents which are immiscible with water, and low boiling point organic auxiliary solvents, can be used when preparing the dispersions of fine lipophilic particles which contain a coupler and a polymer of the present invention. The high boiling point coupler solvents are compounds having a melting point less than 100° C. and having a boiling point at least 140° C. which are immiscible with water, and known solvents of this type can be used provided that they are good solvents for the coupler.

The amount of high boiling point coupler solvent used in the present invention can vary over a wide range, depending on the type and amount of coupler and polymer, but the high boiling point coupler solvent-/coupler weight ratio is preferably from 0.05 to 20, and most desirably from 0.1 to 10, and the high boiling point coupler solvent/polymer weight ratio is preferably from 0.02 to 40, and most desirably from 0.05 to 20. Furthermore, high boiling point coupler solvents can be used alone, or a plurality of such solvents can be used in the form of a mixture.

Various photographically useful hydrophobic substances can be present in the fine lipophilic particles of the present invention. Examples of photographically useful hydrophobic substances include colored couplers, non-color forming couplers, developing agents, developing agent precursors, development inhibitor precursors, ultraviolet absorbers, development accelerators, gradation controlling agents such as hydroquinones, dyes, dye releasing agents, antioxidants, fluorescent whiteners and anti-color fading agents. Furthermore, these hydrophobic substances can be used in combination, if desired.

The inclusion of a halogen conversion laminated type silver chlorobromide emulsion as described earlier and at least one compound represented by each of the general formulae (I) and (II) is essential to achieve the objects of this present invention. The improvement in long term storage properties after manufacture (slight loss of speed and change in fog level) in addition to the high speed, high image quality (high contrast) and reduced difference between production lots which are the objects of the present invention was completely unpredictable on the basis of the prior art, and these effects were first obtained with the present invention.

It has been found that the effect of the present invention is especially pronounced when dispersions of a cyan coupler represented by general formula (III) and a polymer described earlier are present in the same emulsion layer. The reason for this in unclear, but it is thought that desorption of the sensitizing dye which has been adsorbed on the silver halide and dissolution in the couplers and oils etc. which are present in the fine particle dispersion is prevented to a remarkable extent by the constitution of the invention.

The present invention can be applied to the so-called multi-layer color print photosensitive materials which contain, on a support, at least three photosensitive silver halide emulsion layers which have different color sensitivities. In such a case the constitution of this present invention is preferably applied to the red sensitive silver halide emulsion layer.

The use in the blue sensitive, green sensitive or infrared sensitive photosensitive emulsion layers of a layer type silver chlorobromide emulsion which has been subjected to halogen conversion as included in the present invention is most desirable, but silver halide emulsions known in the past can be used in these layers.

That is to say, silver bromide, silver iodobromides, silver iodochlorobromides, silver chlorobromides or silver chloride can be used for the silver halide. The use of silver chlorobromides which contain at least 90 mol % (and preferably at least 98 mol.%) of silver chloride is preferred where rapid processing is intended. A small amount of silver iodide may be present in the silver chlorobromide, but the complete absence of silver iodide is preferred.

The average grain size of the silver halide grains in the photographic emulsion (the average based on projected areas, taking the grain diameter in the case of spherical grains or grains which are approximately spherical, or the edge length in the case of cubic grains, for the grain size) is not particularly limited, but an average grain size of not more than 2 μm is preferred, and an average grain size of from 0.2 μm to 1.5 μm is especially desirable.

The silver halide grains in the photographic emulsions may have a regular crystalline form such as a cubic, tetradecahedral or octahedral form (normal crystal emulsions) or they may have an irregular crystalline form such as a spherical or plate-like form, or they may have a form which is a composite of such forms. The photographic emulsions may also comprise mixtures of grains which have various crystalline forms. The use of normal crystal emulsions is preferred.

Emulsions in which tabular silver halide grains of which the grain diameter is at least five times the grain thickness account for at least 50% of the total projected area of the grains can also be used.

The silver halide emulsion which is present in at least one photosensitive layer is a mono-disperse emulsion of variation constant (the value, expressed as a percentage, obtained by dividing the statistical standard deviation by the average grain size) is not more than 15% (and preferably not more than 10%).

Such mono-disperse emulsions may be emulsions which independently have a variation constant as indicated above, or they may be emulsions comprised of a mixture of two or more separately prepared mono-disperse emulsions of different average grain sizes of which the variation coefficients are not more than 15% (and preferably not more than 10%). The difference in grain size and the mixing ratio can be selected optionally, but the use of emulsions with an average grain size difference of at least 0.2 μm but not more than 1 μm is preferred.

The aforementioned variation coefficient and a method for its measurement are disclosed in T. H. James, *The Theory of the Photographic Process,* Third Edition, page 39, published by the Macmillan Co., (1966).

The silver halide grains may be such that the interior and surface layer consist of different phases.

Cadmium salts, zinc salts, thallium salts, lead salts, iridium salts or complex salts thereof, rhodium salts or complex salts thereof and iron salts and complex salts thereof may be present during the formation or physical ripening of the silver halide grains.

The silver halide emulsions are usually subjected to chemical sensitization. Normal methods of chemical sensitization can be used, and details are disclosed between line 8 of the lower left hand column and line 16 of the lower right hand column of page 12 of the specification of JP-A-62-215272.

Furthermore, the silver halide emulsions are normally subjected to spectral sensitization. Conventional methine dyes can be used for spectral sensitization purposes, and details are disclosed between the third line from the bottom of the upper right hand column on page 22 and page 38 of the specification of JP-A-62-215272, and on the separate paper (B) of the procedural amendment thereto dated 16th March 1987.

Various compounds can be present in the photographic emulsions which are used in the present invention to prevent the occurrence of fogging during manufacture, storage or photographic processing of the photosensitive materials, or to stabilize photographic performance. Thus, many compounds which are known as anti-foggants or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole, for example); mercaptopyrimidines; mercaptotriazines; thioketo compounds such as oxazolinthione; azaindenes, for example, triazaindene, tetra-azaindenes (especially 4-hydroxy substituted 1,3,3a,7-tetra-azaindenes) and penta-azaindenes; benzenethiosulfonic acid, benzenesulfinic acid and benzenesulfonic acid amide, can be used for this purpose.

Suitable yellow and magenta couplers which can be used in the present invention are described below. The various color couplers may preferably added in the photosensitive materials of this present invention. Here, the term "color coupler" signifies a compound which can undergo a coupling reaction with the oxidization product of a primary aromatic amine developing agent and form a dye. Pyrazolone and pyrazoloazole based compounds, and open chain or heterocyclic ketomethylene compounds are typical examples of useful color couplers. Specific examples of magenta and yellow couplers which can be used in this present invention are disclosed in the patents cited in *Research Disclosure* (RD) 17643 (December 1978), Section VII-D, and ibid, 18717 (November 1979).

The colored couplers used in this present invention are preferably rendered fast to diffusion by having ballast groups or by polymerization. Two-equivalent color couplers which are substituted with a leaving group at the active coupling position enable the amount of silver coated to be reduced relative to that required with a four-equivalent coupler which has a hydrogen atom at the active coupling position. Couplers of which the colored dye formed has a suitable degree of diffusibility, non-color forming couplers or DIR couplers which release development inhibitors as the coupling reaction proceeds, or couplers which release development accelerators as the coupling reaction proceeds can also be used.

The oil protected type acylacetamide based couplers are typical of yellow couplers which can be used in this present invention. Specific examples are disclosed, for example, in U.S. Pat. Nos. 2,407,210, 2,875,057 and 3,265,506. The use of two-equivalent yellow couplers is preferred in the present invention, and typical examples include the oxygen atom elimination type yellow couplers disclosed, for example, in U.S. Pat. Nos. 3,408,194, 3,447,928, 3,933,501 and 4,022,620, and the nitrogen atom elimination type yellow couplers disclosed, for example, in JP-B-55-10739, U.S. Pat. Nos. 4,401,752 and 4,326,024, *Research Disclosure* 18053 (April 1979), British Patent 1,425,020, West German Patent Application Laid Open Nos. 2,219,917, 2,261,361, 2,329,587 and 2,433,812, and JP-A-62-240965. Moreover, α-pivaloylacetanilide based couplers provide dyes which have excellent fastness, especially light fastness, and α-benzoylacetanilide based couplers provide high color densities.

Oil protected type indazolone based or cyanoacetyl based, and preferably 5-pyrazolone based and pyrazoloazole, for example, pyrazolotriazole, based couplers are preferred as magenta couplers which are used in the present invention. The 5-pyrazolone based couplers which have an arylamino group or an acylamino group substituted in the 3-position are preferred from the standpoint of the hue of the dye which is formed and the color density. Typical examples are disclosed, for example, in U.S. Pat. Nos. 2,311,082, 2,343,703, 2,600,788, 2,908,573, 3,062,653, 3,152,896 and 3,936,015. The nitrogen atom leaving groups disclosed in U.S. Pat. No. 4,310,619 and the arylthio groups disclosed in U.S. Pat. No. 4,351,897 and WO (PCT) 88/04795 are preferred leaving groups for two-equivalent 5-pyrazolone based couplers. Furthermore, the 5-pyrazolone based couplers which have ballast groups disclosed in European Patent 73,636 provide high color densities.

The pyrazolobenzimidazoles disclosed in U.S. Pat. No. 3,369,879, and especially the pyrazolo[5,1-c][1,2,4]triazoles disclosed in U.S. Pat. No. 3,725,067, the pyrazolotetrazoles disclosed in *Research Disclosure* 24220 (June 1984) and the pyrazolopyrazoles disclosed in *Research Disclosure* 24230 (June, 1984) are the preferred pyrazoloazole based couplers. The imidazo[1,2-b]pyrazoles disclosed in European Patent 119,741 are preferred from the standpoint of the slight absorbance on the yellow side, and the light fastness, of the colored dye, and the pyrazolo[1,5-b][1,2,4]triazoles disclosed in European Patent 119,860 are especially desirable in this respect.

Preferred magenta couplers and yellow couplers for use in this present invention can be represented by the general formulae [VI], [VII] and [VIII] below.

General Formula [VI] (VI)

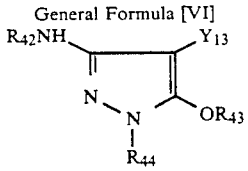

General Formula [VII] (VIII)

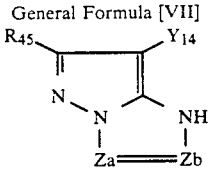

General Formula [VIII] (VIII)

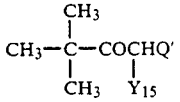

In these formulae, $R_{42}$ and $R_{44}$ each represents a substituted or unsubstituted phenyl group, $R_{43}$ represents a hydrogen atom, an aliphatic or aromatic acyl group, or an aliphatic or aromatic sulfonyl group, $R_{45}$ represents a hydrogen atom or a substituent group, Q' represents a substituted or unsubstituted N-phenylcarbamoyl group, Za and Zb represent a methine, substituted methine or =N— group, $Y_{13}$ represents a hydrogen atom or a group which can be eliminated at the time of a coupling reaction with the oxidation product of a developing agent (referred to hereinafter as a leaving group), $Y_{14}$ represents a halogen atom or a leaving group, and $Y_{15}$ represents a leaving group. Moreover, oligomers comprising dimers or larger units can be formed via $R_{42}$, $R_{43}$, $R_{44}$ or $Y_{13}$; via $R_{45}$, Za, Zb or $Y_{14}$; or via Q or $Y_{13}$.

The details concerning $R_{42}$, $R_{43}$, $R_{44}$, $R_{45}$, Za, Zb, Q, $Y_{13}$, $Y_{14}$ and $Y_{15}$ in the aforementioned general formulae (VI), (VII) and (VIII) are the same as those relating to general formulae (III), (IV) and (V) disclosed in the specification of JP-A-63-11939, which disclosure is herein incorporated by reference.
Specific examples of these color couplers include those disclosed as (M-1)–(M-42), and (Y-1)–(Y-46) in the specification of the aforementioned JP-A-63-11939, but the compounds shown below are preferred.
(M-1)
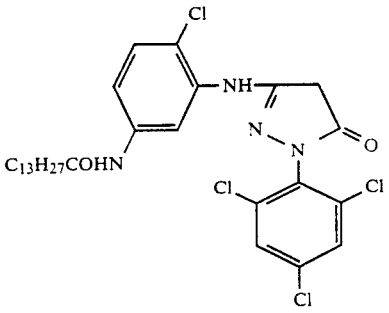
(M-2)
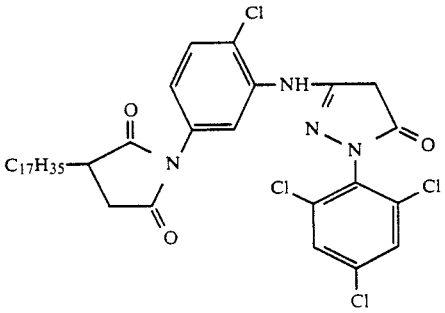
(M-3)
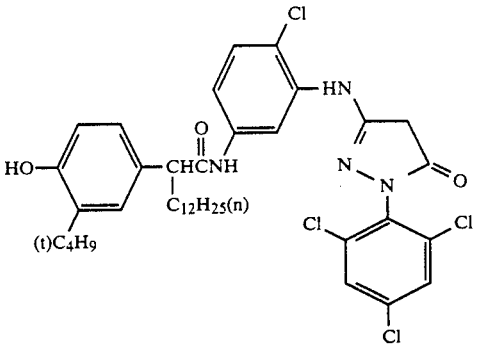
(M-4)
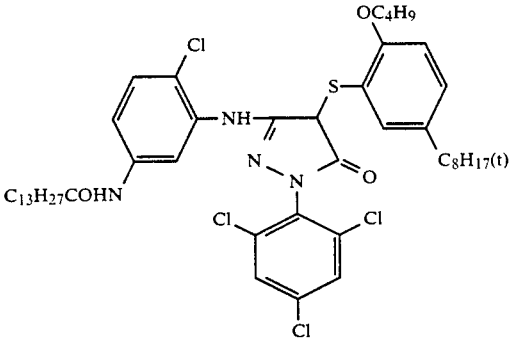

-continued
(M-5)
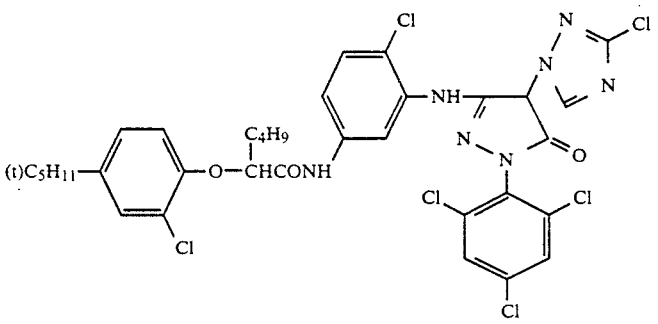
(M-6)
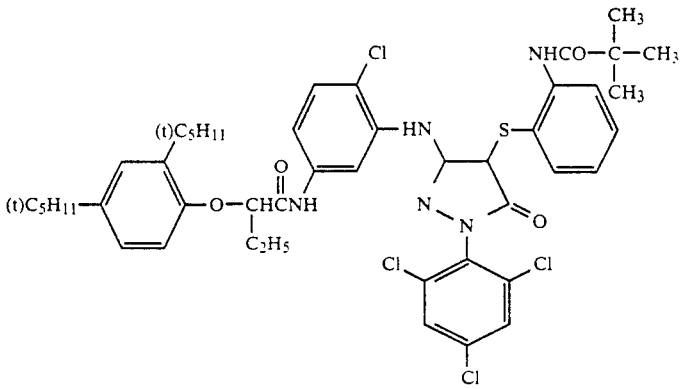
(M-7)
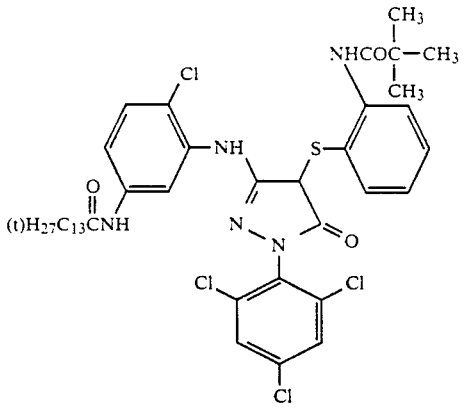
(M-8)
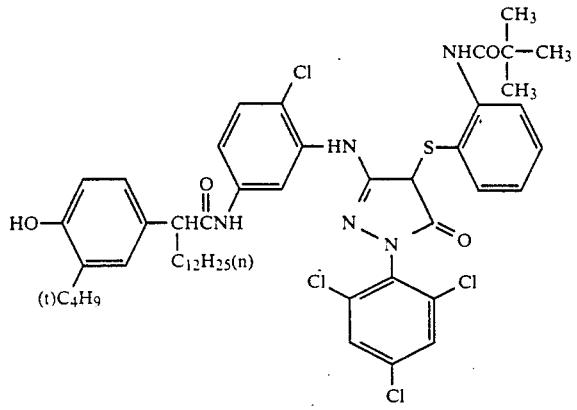

-continued
(M-9)
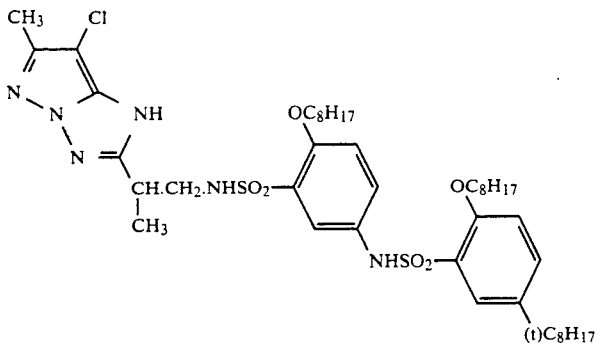
(M-10)
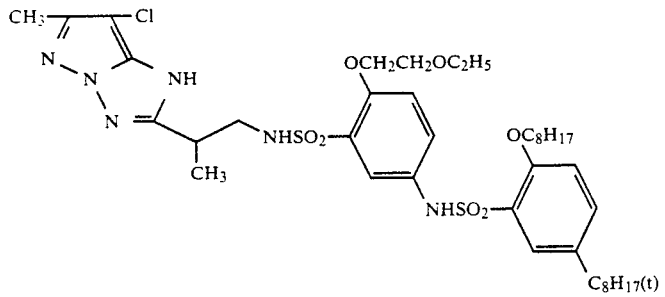
(M-11)
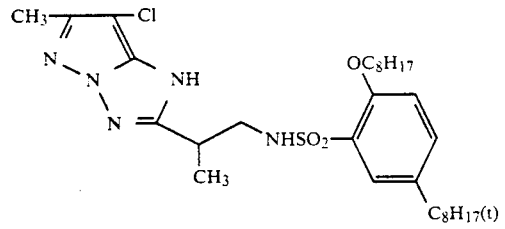
(M-12)
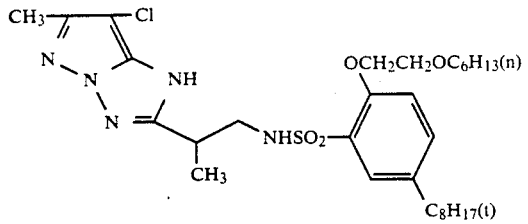
(M-13)
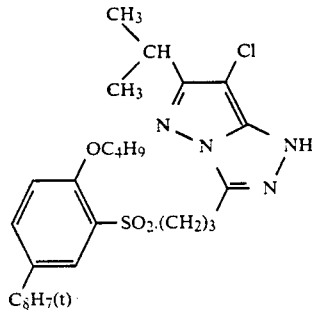

-continued
(M-14)
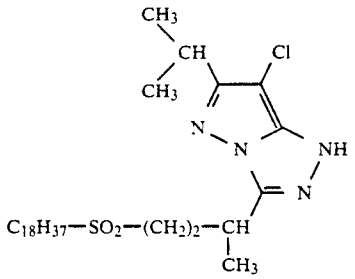
(M-15)
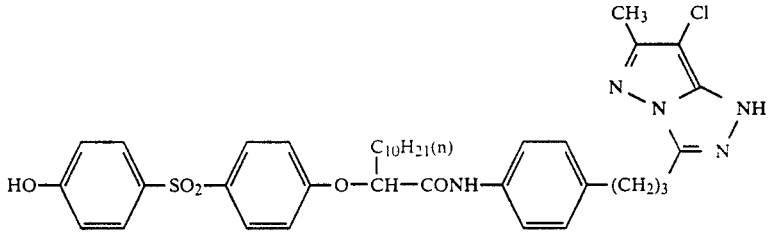
(M-16)
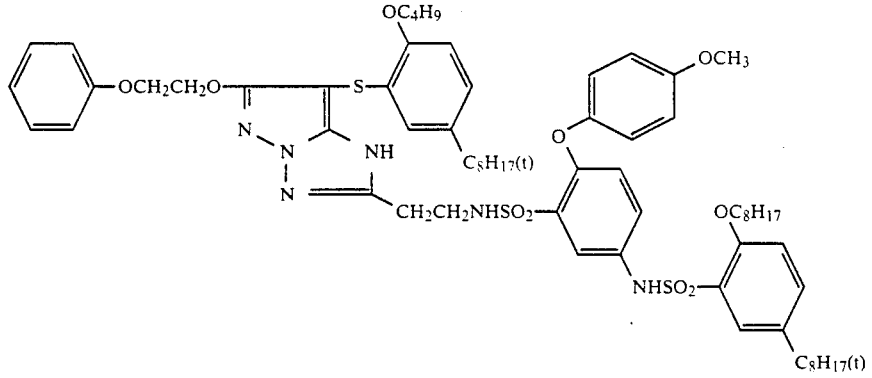
(M-17)
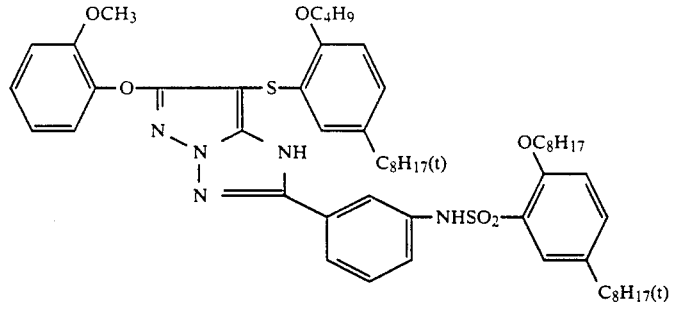
(M-18)
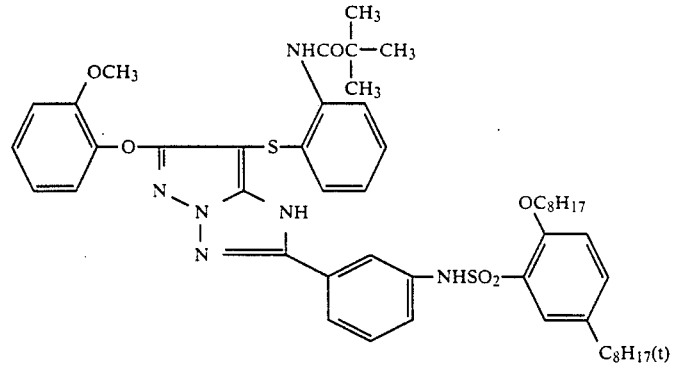

-continued
(Y-1)
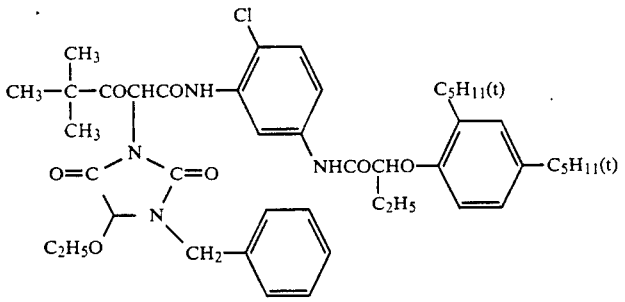
(Y-2)
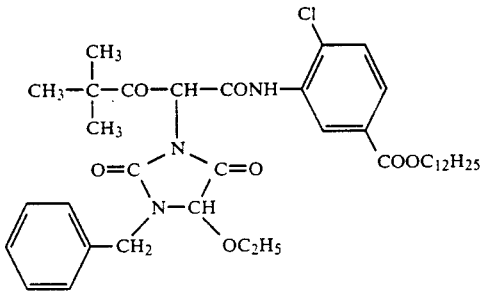
(Y-3)
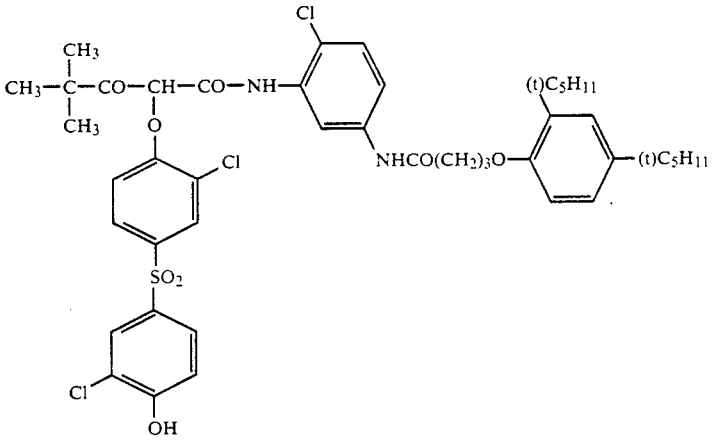
(Y-4)
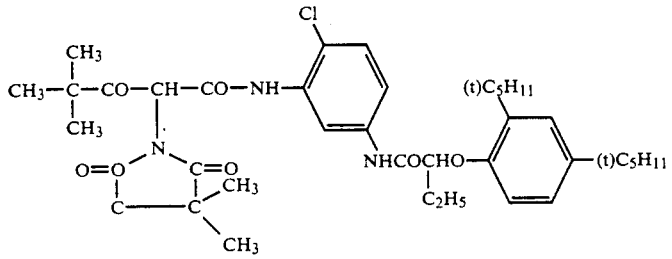
(Y-5)
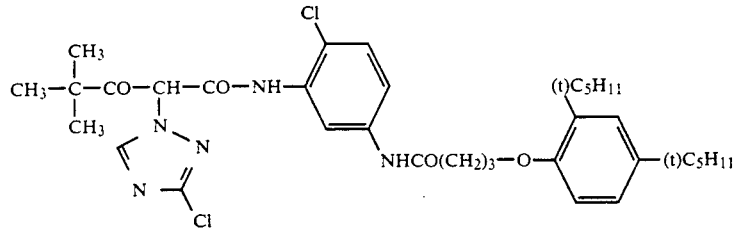

-continued (Y-6)

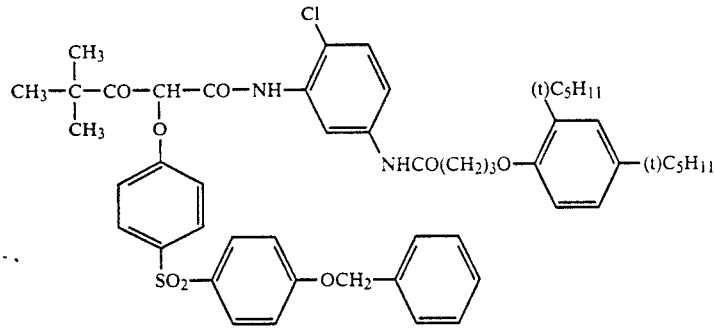

(Y-7)

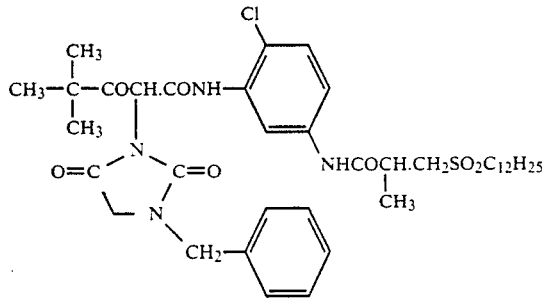

(Y-8)

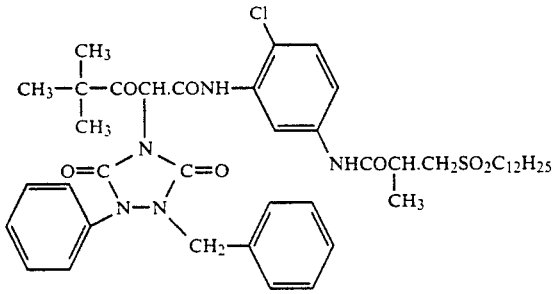

The couplers represented by the above mentioned general formulae (VI), (VII) and (VIII) are normally included in the silver halide emulsion layers which form the photosensitive layer in an amount of from 0.1 to 1.0 mol, and preferably of from 0.1 to 0.5 mol, per mol of silver halide.

A variety of known techniques can be used to add the cyan, magenta and yellow couplers which are used in the present invention to the photosensitive layer. Normally, they can be added as oil protected systems using the known oil in water dispersion method, and after dissolution in a solvent they are emulsified and dispersed in an aqueous gelatin solution which contains a surfactant for this purpose. Alternatively, water, or an aqueous gelatin solution, can be added to a coupler solvent which contains a surfactant, and an oil in water emulsion can be formed by phase reversal. Furthermore, alkali soluble couplers can be dispersed using the Fisher dispersion method. The coupler dispersions can be mixed with the photographic emulsions after the removal of low boiling point organic solvents by distillation, noodle washing or ultrafiltration, for example.

The use of high boiling point organic solvents which have a dielectric constant (25° C.) of from 2 to 20 and a refractive index (25° C.) of from 1.3 to 1.7 and/or water insoluble polymeric compounds for the coupler dispersion media is preferred.

The use of high boiling point organic solvents which can be represented by the general formulae (F)-(J) indicated below is preferred.

General Formula [F] (F)

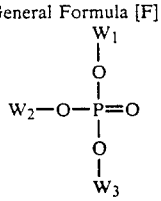

General Formula [G]

$W_1—COO—W_2$ (G)

General Formula [H] (H)

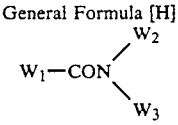

General Formula [I] (I)

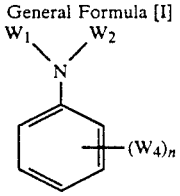

General Formula [J]

$W_1—O—W_2$ (J)

In these formulae, $W_1$, $W_2$ and $W_3$, which may be the same or different, each represents a substituted or unsubstituted alkyl group, a cycloalkyl group, an alkenyl group, an aryl group or a heterocyclic group, $W_4$ represents $W_1$, O–$W_1$ or S–$W_1$, and n represents an integer of a value from 1 to 5, and when n has a value of 2 or more the $W_4$ groups may be the same or different. Moreover, $W_1$ and $W_2$ in general formula (J) may form a condensed ring.

Water immiscible compounds with a melting point below 100° C. and a boiling point at least 140° C. other than those of general formulae (F)–(J) can be used as the high boiling point organic solvents which are used in the invention provided that the coupler has a good solubility therein. The melting point of the high boiling point organic solvent is preferably not more than 80° C. Moreover, the boiling point of the high boiling point organic solvent is preferably at least 160° C., and most desirably at least 170° C.

For example, high boiling point organic solvents with a boiling point of at least 160° C., such as alkyl esters of phthalic acid (for example, dibutyl phthalate, dioctyl phthalate), phosphate esters (for example, diphenyl phosphate, triphenyl phosphate, tricresyl phosphate, dioctyl butyl phosphate), citrate esters (for example, tributyl acetylcitrate), benzoate esters (for example, octyl benzoate), alkylamides (for example, diethyllaurylamide), fatty acid esters (for example, dibutoxyethyl succinate, dioctyl azelate), and phenols (for example, 2,4-di-tert-amylphenol) can be used for this purpose. Furthermore, the water insoluble polymeric compounds are vinyl polymers (including homopolymers and copolymers) which include the compounds disclosed in columns 18–21 of JP-B-60-18978, and acrylamides and methacrylamides as one of the monomer components.

Specific examples include poly(methyl methacrylate), poly(ethyl acrylate), poly(butyl methacrylate), poly(cyclohexyl methacrylate) and poly(t-butylacrylamide). Furthermore, low boiling point organic solvents with a boiling point of from 30° C. to 150° C., for example, lower alkyl acetates, such as ethyl acetate and butyl acetate, ethyl propionate, sec-butyl alcohol, methyl isobutyl ketone, β-ethoxyethyl acetate and methylcellosolve acetate, can be used alone or in the form of mixtures thereof, as desired, together with the above mentioned high boiling point organic solvents and/or water insoluble polymeric compounds.

Ultraviolet absorbers can be added to any layer in the present invention. Ultraviolet absorbers are preferably present in the layers which contain the compounds represented by the general formula (I), (II) or (III), or in layers adjacent thereto. The compounds described in *Research Disclosure*, 17643, Section VIII C can be used as ultraviolet absorbers in the present invention, but the use of benzotriazole derivatives represented by general formula (XI) below is preferred.

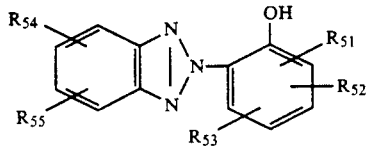

(XI)

In this formula, $R_{51}$, $R_{52}$, $R_{53}$, $R_{54}$ and $R_{55}$ may be the same or differmnt, and each represents a hydrogen atom or an aromatic group. These may be substituted with the substituent groups described for $R_1$, and $R_{54}$ and $R_{55}$ may undergo ring closure to form a five or six membered aromatic ring comprised of carbon atoms. Those groups which can have substituent groups may be further substituted with substituent groups as described for $R_1$.

The compounds represented by the above mentioned general formula (XI) can be used alone, or in the form of mixtures of two or more thereof.

Methods for the synthesis of compounds represented by the aforementioned general formula (XI) and other illustrative compounds are disclosed, for example, in JP-B-44-29620, JP-A-50-151149, JP-A-54-95233, U.S. Pat. No. 3,766,205, EP 0057160, *Research Disclosure* 22519 (1983, No. 225) and JP-A-61-190537. Furthermore, the high molecular weight ultraviolet absorbers disclosed in JP-A-58-11194 and Japanese Patent Application Nos. 57-61937, 57-63602, 57-129780 and 57-133371 can also be used. Low molecular weight and polymeric ultraviolet absorbers can also be used conjointly.

The aforementioned ultraviolet absorbers can be dissolved in individual or mixtures of high boiling point organic solvents and low boiling point organic solvents at the same time as the coupler and dispersed in a hydrophilic colloid in the same way as the couplers. No particular limitation is imposed on the amounts of high boiling point organic solvent or ultraviolet absorber, but an amount of high boiling point organic solvent within the range from 0% to 300% with respect to the weight of ultraviolet absorber is normally used. The individual or combined use of compounds which are liquids at normal temperature is preferred.

There is an improvement in the storage properties, and especially in the light fastness, of the colored dye images, and especially of the cyan image, in those cases where ultraviolet absorbers of the aforementioned general formula (XI) are used in combination with combinations of couplers of this present invention. The ultraviolet absorbers and cyan couplers can be co-emulsified.

The coated weight of ultraviolet absorber should be sufficient to render the cyan dye image light stable, but the use of too much ultraviolet absorber can result in a yellowing of the unexposed parts (white base parts) of the color photographic material and so the coated weight is normally within the range from $1\times10^{-4}$ to $2\times10^{-3}$ mol/m$^2$, and preferably within the range from $5\times10^{-4}$ to $1.5\times10^{-3}$ mol/m$^2$.

Ultraviolet absorbers are normally present in at least the layer on one side, and preferably in the layers on both sides, adjacent the red sensitive emulsion layer which contains the cyan coupler. The ultraviolet absorbers may be co-emulsified with anti-color fading agents when they are added to intermediate layers which are located between the green and red sensitive layers. In those cases where an ultraviolet absorber is added to a protective layer, it is preferably coated in a separate protective layer as the outermost layer. This protective layer can also contain particle type matting agents if desired.

Various organic based and metal complex salt based anti-color fading agents can be used in combination in order to improve the storage properties of the color dye images, and especially of the yellow and magenta images. Examples of organic based anti-color fading agents include hydroquinones, gallic acid derivatives, p-alkoxyphenols and p-oxyphenols, and dye image stabilizers, anti-staining agents and antioxidants are described in the patents disclosed in *Research Disclosure* 17643, VIII I to J. Furthermore, metal complex salt based anti-color fading agents are disclosed, for example, in *Research Disclosure* 15162.

The use of compounds such as those indicated below together with the couplers described earlier is preferred in the present invention. The combined use of these compounds with pyrazoloazole couplers is especially desirable.

Thus, the use of compounds of the general formula (Q) which bond chemically with the aromatic amine based developing agents remaining after color development processing and form compounds which are chemically inert and essentially colorless, and/or compounds of the formula (R) which bond chemically with the oxidization product of the aromatic amine based color developing agents remaining after color development processing and form compounds which are chemically inert and essentially colorless either simultaneously or individually is desirable for preventing the occurrence of staining and other side effects due to colored dye formation resulting from the reaction of couplers with color developing agents or oxidized forms thereof which remain in the film on storage after processing, for example.

Compounds which react with p-anisidine with a second order reaction rate constant $k_2$ (measured in trioctyl phosphate at 80° C.) within the range from 1.0 liter/mol.sec to $1\times10^{-5}$ liter/mol.sec are preferred for the compounds of the formula (Q). Moreover, second order reaction rate constants can be measured using the method disclosed in JP-A-63-158545.

The compounds themselves are unstable if $K_2$ has a value above this range, and they will react with gelatin or water and be decomposed. On the other hand, if the value of $k_2$ is below this range, the reaction with the residual aromatic amine based developing agent is slow, and consequently it is not possible to prevent the occurrence of the side effects of the residual aromatic amine based developing agent which is the purpose of the invention.

The preferred compounds of the formula (Q) of this type can be represented by the general formulae [Q-I]and [Q-II] which are shown below.

General Formula [QI]

$$R_1-(A)_n-X \qquad \text{(Q-I)}$$

General Formula [QII]

$$R_2-\underset{\underset{B}{|}}{C}=Y \qquad \text{(Q-II)}$$

In these formulae (Q-I) and (Q-II), $R_1$ and $R_2$ which may be the same or different, each represents an aliphatic group, an aromatic group or a heterocyclic group. Moreover, n represents 1 or 0. A represents a group which reacts with an aromatic amine based developing agent and forms a chemical bond, and X represents a group which is eliminated by reaction with an aromatic amine based developing agent. B represents a hydrogen atom, an aliphatic group, an aromatic group, a heterocyclic group, an acyl group or a sulfonyl group, and Y represents a group which accelerates the addition of the aromatic amine based developing agent to the compound of general formula [Q-II]. Here, $R_1$ and X, and Y and $R_2$ or B, can be combined together to form a cyclic structure.

Substitution reactions and addition reactions are typical of the reactions by which the residual aromatic amine based developing agent is chemically bound.

Specific examples of compounds represented by the general formulae (Q-I) and (Q-II) all disclosed, for example, in JP-A-63-158545, JP-A-62-283338 and European Patents 298321 and 277589 are preferred.

On the other hand, preferred compounds of the formula (R) which chemically bond with the oxidization product of aromatic amine based developing agents which remain after color development processing and form compounds which are chemically inert and colorless can be represented by the general formula (R-I) indicated below.

General Formula [RI]

$$R_0-Z_0 \qquad \text{(R-I)}$$

$R_0$ in this formula represents an aliphatic group, an aromatic group or a heterocyclic group. $Z_0$ represents a nucleophilic group or a group which breaks down in the photosensitive material and releases a nucleophilic group. The compounds represented by the general formula (R-I) are preferably compounds in which $Z_0$ is a group of which the Pearson nucleophilicity $^{n}CH_3I$ value (R. G. Pearson et al., *J. Am. Chem. Soc.*, 90, 319 (1968) is at least 5, or a group derived therefrom.

Specific examples of compounds represented by general formula [R-I] disclosed, for example, in European Patents 298321 and 277589, European Patent Laid Open No. 55,722, JP-A-62-143048, JP-A-62-229145 and Japanese Patent Application Nos. 63-136724, and 62-214681 are preferred.

Furthermore, details of combinations of the aforementioned compounds of the formula (R) and compounds of the formula (Q) are disclosed in European Patent Laid Open No. 277,589.

Many compounds such as phenols, hydroquinones, hydroxychromans, hydroxycoumarins, hindered amines and the alkyl and aryl ethers or hydrolyzable precursor derivatives thereof can be used in order to improve the fastness of the yellow image to heat and light, and the compounds represented by the general formulae (XVIII) and (XIX) below are effective for improving both the heat and light fastness of the yellow images obtained from couplers.

[XVIII]

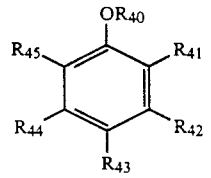

[XIX]

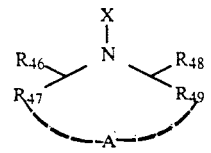

In general formula (XVIII) and (XIX), $R_{40}$ represents a hydrogen atom, an aliphatic group, an aromatic group, a heterocyclic group, or a

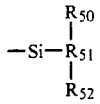

group, where $R_{50}$, $R_{51}$ and $R_{52}$ may be the same or different, and each represents an aliphatic group, an aromatic group, an aliphatic oxy group or an aromatic oxy group, and these groups may be substituted with the substituent groups described above for $R_1$. $R_{41}$, $R_{42}$, $R_{43}$, $R_{44}$ and $R_{45}$ may be the same or different and each represents a hydrogen atom, an alkyl group, an aryl group, an alkoxy group, a hydroxyl group, a mono- or di-alkylamino group, an imino group or an acylamino group. $R_{46}$, $R_{47}$, $R_{48}$ and $R_{49}$ may be the same or different and each represents a hydrogen atom or an alkyl group. X represents a hydrogen atom, an aliphatic group, an acyl group, an aliphatic or aromatic sulfonyl group, an aliphatic or aromatic sulfinyl group, an oxyradical group or a hydroxyl group. A represents a group of non-metal atoms which is required to form a five, six or seven membered ring.

Methods for the preparation of compounds of the general formula (XVIII) or (XIX), and examples of compounds outside the scope of these formulae are disclosed in British Patents 1,326,889, 1,354,313 and 1,410,846, U.S. Pat. Nos. 3,336,135 and 4,268,593, JP-B-51-1420, JP-B-52-6623, JP-A-58-114036 and JP-A-59-5246.

Two or more compounds represented by general formulae (XVIII) and (XIX) can be used together, and they can also be used in combination with known anti-color fading agents.

The amounts of the compounds of general formulae (XVIII) and (XIX) used differs depending on the type of yellow coupler with which they are combined and used, but the intended purpose can be achieved using an amount of from 0.5 to 200 wt.%, and preferably of some 2 to 150 wt %, with respect to the yellow coupler. Co-emulsification of with a yellow coupler of general formula (VIII) is preferred.

The various aforementioned dye image stabilizers, anti-staining agents and antioxidants also have a good effect on the magenta dyes obtained from couplers represented by the general formulae (VI) and (VII) above, but the group of compounds represented by the general formulae (XX), (XXI), (XXII), (XXIII), (XXIV) and (XXV) below provide a great improvement in light fastness in particular and are preferred

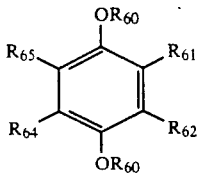

(XX)

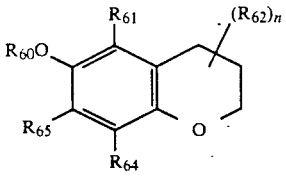

(XXI)

-continued

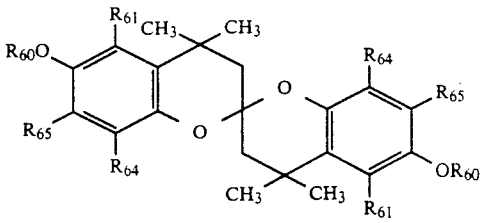

(XXII)

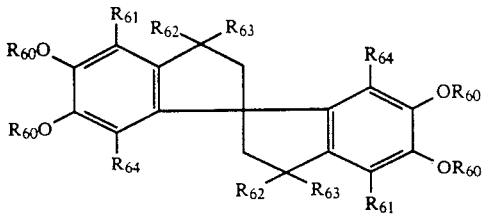

(XXIII)

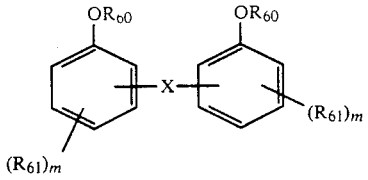

(XXIV)

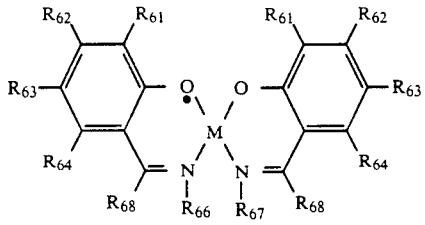

(XXV)

In the above mentioned general formulae (XX) to (XXV), $R_{60}$ has the same meaning as $R_{40}$ in general formula (XVIII), and $R_{61}$, $R_{62}$, $R_{63}$, $R_{64}$ and $R_{65}$ may be the same or different, and each represents a hydrogen atom, an aliphatic group, an aromatic group, an acylamino group, a mono- or dialkylamino group, an aliphatic or aromatic thio group, an aliphatic or aromatic oxycarbonyl group or an —$OR_{40}$ group. $R_{60}$ and $R_{61}$ may combine together to form a five or six membered ring. Furthermore, $R_{61}$ and $R_{62}$ may form a five or six membered ring. X represents a divalent linking group. $R_{66}$ and $R_{67}$ may be the same or different, and each represents a hydrogen atom, an aliphatic group, an aromatic group or a hydroxyl group. $R_{68}$ represents a hydrogen atom, an aliphatic group or an aromatic group. $R_{66}$ and $R_{67}$ may combine and form a five or six membered ring. M represents Cu, Co, Ni, Pd or Pt. Where the substituent groups from $R_{61}$ to $R_{68}$ are aliphatic groups or aromatic groups they can be substituted with the substituent groups described for $R_1$. Moreover, n represents an integer of a value of from 0 to 3 and m represents an integer of a value of from 0 to 4 signifying the number of the substituent groups $R_{62}$ and $R_{61}$, and when the values are 2 or more the groups represented by $R_{62}$ and $R_{61}$ may be the same or different.

Specific preferred examples of X in general formula (XXIV) include

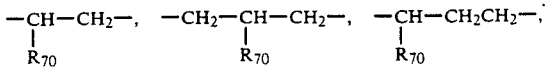

-continued

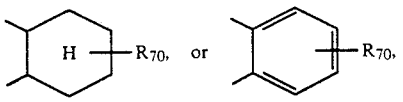

where $R_{70}$ represents a hydrogen atom or an alkyl group.

$R_{61}$ in general formula (XXV) is preferably a group which can form hydrogen bonds. Compounds in which at least one of the groups represented by $R_{62}$, $R_{63}$ and $R_{64}$ is a hydrogen atom, a hydroxyl group, an alkyl group or an alkoxy group are preferred, and the substituent groups from $R_{61}$ to $R_{68}$ are preferably substituent groups which each contain a total of at least 4 carbon atoms.

Methods for the preparation of these compounds and compounds other than those described above are disclosed in the specifications of U.S. Pat. Nos. 3,336,135, 3,432,300, 3,573,050, 3,574,627, 3,700,455, 3,764,337, 3,935,016, 3,982,944, 4,254,216 and 4,279,990, British Patents 1,347,556, 2,062,888, 2,066,975 and 2,077,455, JP-A-60-97353, JP-A-52-152225, JP-A-53-17729, JP-A-53-20327, JP-A-54-145530, JP-A-55-6321, JP-A-55-21004, JP-A-58-24141, JP-A-59-10539, JP-B-48-31625 and JP-B-54-12337.

Those of the anti-color fading agents which are used conveniently in this present invention represented by the general formulae (XX)-(XXIV) are used in an amount of from 10 to 200 mol %, and preferably in an amount of from 30-100 mol %, with respect to the magenta coupler used in the invention. On the other hand, the compounds represented by the general formula (XXV) are used in an amount of from 1 to 100 mol %, and preferably in an amount of from 5 to 40 mol %, with respect to the magenta coupler used in the invention. These compounds are preferably co-emulsified with the magenta couplers.

Techniques whereby the dye image is enclosed by means of an oxygen barrier layer comprising of a substance which has a low oxygen permeability are disclosed, for example, in JP-A-49-11330 and JP-A-50-57223, and the establishment of a layer of which the oxygen permeability is not more than 20 $ml/m^2 \cdot hr \cdot atom$ on the support side of the colored image forming layer of a color photographic material is disclosed in JP-A-56-85747, and these techniques can be used in this present invention as well.

Any transparent support such as poly(ethylene terephthalate) and cellulose triacetate, or reflective support as described hereinafter can be used as the support in this present invention. Reflective supports are preferred, and examples of such supports include baryta paper, polyethylene covered paper, polypropylene based synthetic paper and transparent supports on which a reflective layer has been established or in which a reflective material has been used, such as glass plates, polyester films, for example cellulose triacetate and cellulose nitrate films, polyamide films, polycarbonate films and polystyrene films, and an appropriate selection can be made from these supports in accordance with the intended application of the photographic material.

Auxiliary layers, such as under-layers, intermediate layers and protective layers, can be established in color photographic photosensitive materials of this present invention in addition to the structural layers aforementioned. Furthermore, a second ultraviolet absorbing layer may be positioned between the red sensitive and green sensitive silver halide emulsion layers, as required. The use of the ultraviolet absorbers aforementioned in this ultraviolet absorbing layer is preferred, but other known ultraviolet absorbers can be used for this purpose as well.

Gelatin is convenient as the binding agent or protective colloid for photographic emulsions, but other hydrophilic colloids can be used for this purposes.

For example, gelatin derivatives, graft polymers of other polymers with gelatin, proteins such as albumin and casein; cellulose derivatives such as hydroxyethylcellulose, carboxymethylcellulose and cellulose sulfate esters, sodium alginate, sugar derivatives such as starch derivatives, and a large numbers of synthetic hydrophilic polymer materials, including homopolymers such as poly(vinyl alcohol), partially acetalated poly(vinyl alcohol), poly-N-vinylpyrrolidone, poly(acrylic acid), poly(methacrylic acid), polyacrylamide, polyvinylimidazole and polyvinylpyrazole, and related copolymers, can be used for this purpose.

In addition to lime treated gelatins, acid treated gelatins and enzyme treated gelatins as described in *Bull. Soc. Sci. Phot. Japan,* No.16, p.30 (1966) can be used as the gelatin, and hydrolyzed and enzymatically degraded gelatins can also be used.

Whiteners, such as stilbene based, triazine based, oxazole based or coumarin based whiteners, may be present in the photographic emulsion layers or other hydrophilic colloid layers in the photosensitive materials of the present invention. These may be water soluble, or water insoluble whiteners may be used in the form of a dispersion. Specific examples of fluorescent whiteners are disclosed, for example, in U.S. Pat. Nos. 2,632,701, 3,269,840 and 3,359,102, British Patents 852,075 and 1,319,763, and under Brighteners in lines 9-36 on page 24 of *Research Disclosure,* Vol.176, 17643 (published December 1978).

In those cases in which dyes or ultraviolet absorbers etc. are included in a hydrophilic colloid layer in a photosensitive material of the present invention they may be mordanted using a cationic polymer. For example, use can be made of the polymers disclosed in British Patent 685,475, U.S. Pat. Nos. 2,675,316, 2,839,401, 2,882,156, 3,048,487, 3,184,309 and 3,445,231, West German Patent Application (OLS) 1,914,362, JP-A-50-47624 and JP-A-50-71332.

Hydroquinone derivatives, aminophenol derivatives, gallic acid derivatives and ascorbic acid derivatives, for example, can also be present in the photosensitive materials of the present invention as anti-color fogging agents, and specific examples are disclosed, for example, in U.S. Pat. Nos. 2,360,290, 2,336,327, 2,403,721, 2,418,613, 2,675,314, 2,701,197, 2,704,713, 2,728,659, 2,732,300 and 2,735,765, JP-A- 50-92988, JP-A-50-92989, JP-A-50-93928, JP-A-50-110337, JP-A-52-146235 and JP-B-50-23813.

The use of dyes such as those described below, for example, is desirable in the present invention for preventing irradiation during exposure or printing, for reducing sensitivity with a view to increasing safety under safelighting, so as to prevent any worsening of latent image storage properties, or on other aspects of photographic performance, and to prevent any loss of quality due to residual coloration after processing.

Anthraquinone based dyes, for example, can also be used as well as these pyrazolone oxonol dyes.

The use of pyrazolone oxonol dyes which can be represented by the general formula (K) indicated below is preferred.

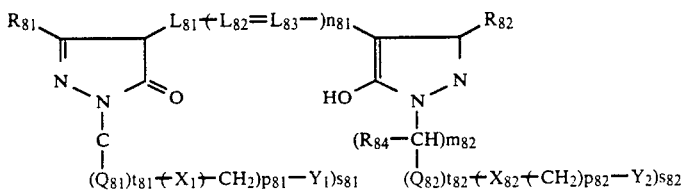

(K)

In this formula (K), $R_{81}$ and $R_{83}$, which may be the same or different, each represents $$-COOR_5 \quad \text{or} \quad -\underset{\underset{R_{86}}{|}}{CON}-R_{85}.$$

$R_{83}$ and $R_{84}$ each represent a hydrogen atom or an alkyl group or substituted alkyl group (for example, methyl, ethyl, butyl, hydroxyethyl), and $R_{85}$ and $R_{86}$ which may be the same or different each represents a hydrogen atom, an alkyl group or substituted alkyl group (for example, methyl, ethyl, butyl, hydroxyethyl, phenethyl), or an aryl group or substituted aryl group (for example, phenyl, hydroxyphenyl). $Q_{81}$ and $Q_{82}$, which may be the same or different, each represents an aryl group (for example, phenyl, naphthyl). $X_{81}$ and $X_{82}$ represent bonds or divalent linking groups, and $Y_{81}$ and $Y_{82}$ each represent a sulfo group or a carboxyl group. $L_{81}$, $L_{82}$ and $L_{83}$ each represents a methine group. Moremover, $m_{81}$ and $m_{82}$ represent 0, 1 or 2, $n_{81}$ represents 0, 1 or 2, $p_{81}$ and $p_{82}$ each represent 0, 1, 2, 3, or 4, $s_{81}$ and $s_{82}$ each represents 1 or 2, and $t_{81}$ and $t_{82}$ each represent 0 or 1. However, $m_{81}$, $p_{81}$ and $t_{81}$ cannot be zero at the same time as $m_{82}$, $p_{82}$ and $t_{82}$.

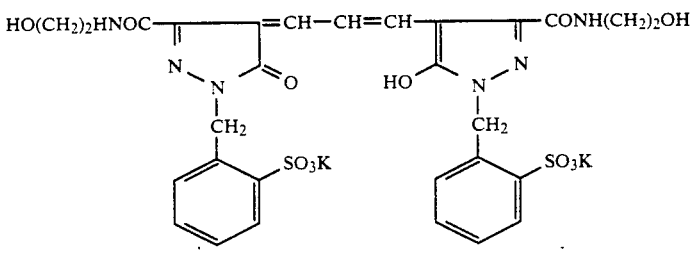

(K-1)

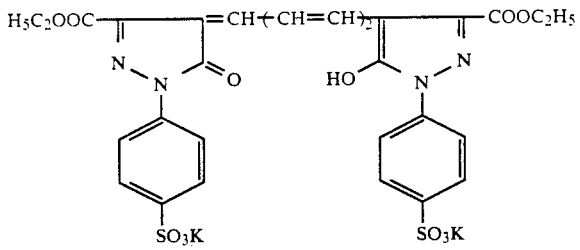

(K-2)

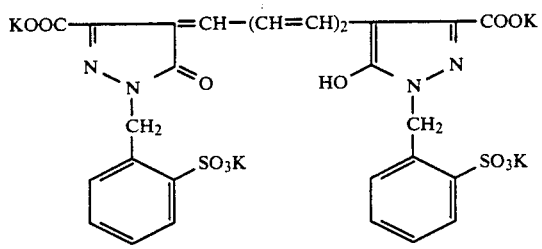

(K-3)

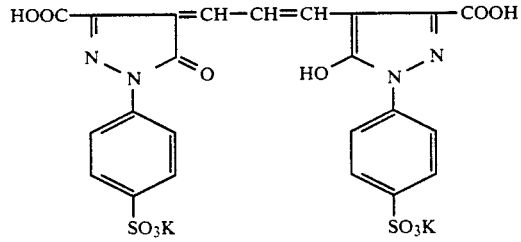

(K-4)

-continued

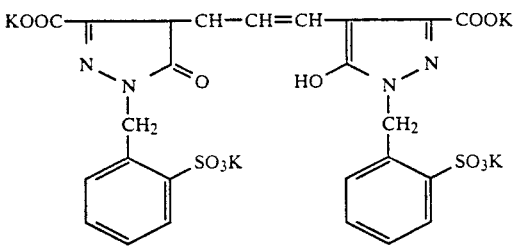

(K-5)

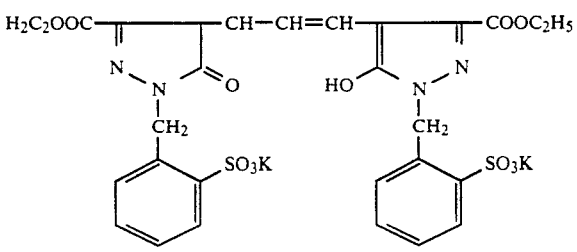

(K-6)

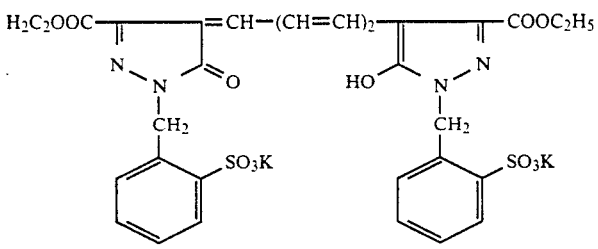

(K-7)

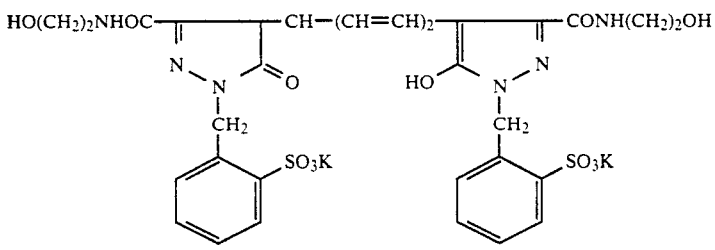

(K-8)

Known film hardening agents can be used in this present invention. The cyanuric chloride based film hardening agents represented by the general formulae (L) and (N) show below are especially desirable, but other film hardening agents, for example vinylsulfone based film hardening agents, can also be used.

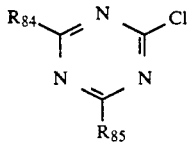

(L)

In this formula (L), $R_{84}$ represents a chlorine atom, a hydroxyl group, an alkyl group, an alkoxy group, an alkylthio group, an —OM group (where M is a univalent metal atom), an $—NR_IR_{II}$ group or an $—NHCOR_{III}$ group (where $R_I$, $R_{II}$ and $R_{III}$ each represents hydrogen atoms, alkyl groups or aryl groups), and $R_{85}$ is the same as $R_{84}$ except that it cannot represent a chlorine atom.

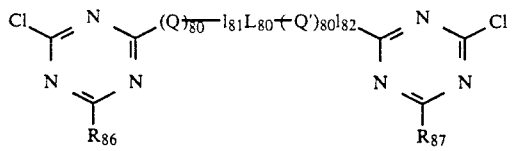

(N)

In this formula (N), $R_{86}$ and $R_{87}$ represent chlorine atoms, hydroxyl groups, alkyl groups, alkoxy groups or —OM groups (where M represents a univalent metal atom. $Q_{80}$ and $Q'_{80}$ are linking groups which represent —O—, —S— or —NH—, and $L_{80}$ represents an alkylene group or an arylene group. Moreover, and $l_{81}$ and $l_{82}$ represent 0 or 1.

The alkyl groups represented by $R_{84}$ and $R_{85}$ in general formula (L) are, for example, methyl, ethyl or butyl groups, and the alkoxy groups represented by $R_{84}$ and $R_{85}$ are, for example, methoxy, ethoxy or butoxy groups. Moreover, the M of the —OM groups represented by $R_{84}$ and $R_{85}$ is, for example, a sodium or potassium atom.

Furthermore, cyanuric chloride based film hardening agents represented by the aforementioned general formula (L) are disclosed in U.S. Pat. No. 3,645,743, JP-B-47-6151, JP-B-47-33380, JP-B-51 9607, JP-A-48-19220, JP-A-51-78788, JP-A-52-60612, JP-A-52-128130, JP-A-52-130326 and JP-A-56-1043, and these can be used on the aforementioned basis.

The alkyl groups $R_{86}$ and $R_{87}$ in general formula (N) are, for example, methyl, ethyl or butyl groups, the alkoxy groups are, for example, methoxy, ethoxy or butoxy groups, and the M of the —OM group is, for example, a sodium or potassium atom.

Furthermore, an alkylene group represented by $L_{80}$ is, for example, a methylene, ethylene or propylene group, and an arylene group represent by $L_{80}$ is, for example, a p-, o- or m-phenylene group.

Cyanuric chloride based film hardening agents represented by the aforementioned general formula (N) are disclosed in Canadian Patent 895,807, JP-B-58-33542 and JP-A-57-40244, and these can be selected and used on the basis of the aforementioned standards.

Specific examples of compounds represented by the general formulae (L) and (N) are indicated below.

Compounds Represented by General Formula (L)

(L-1)

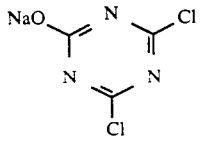

(L-2)

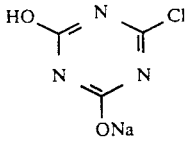

(L-3)

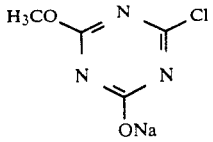

(L-4)

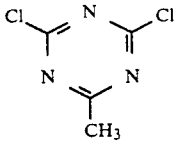

(L-5)

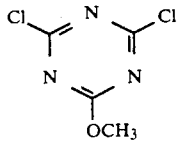

(L-6)

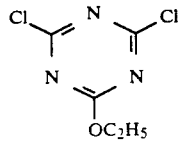

(L-7)

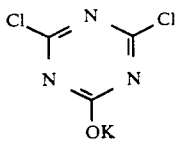

-continued (L-8)

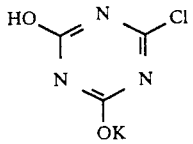

(L-9)

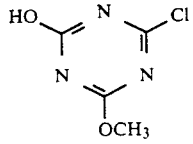

(L-10)

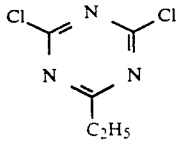

(L-11)

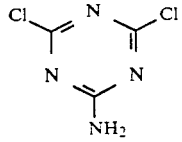

(L-12)

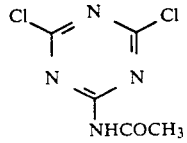

(L-13)

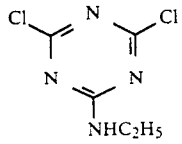

Compounds Represented by General Formula (N)

(N-1)

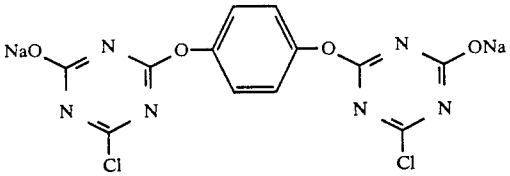

(N-2)

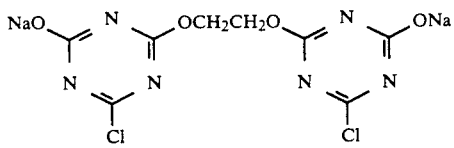

(N-3)

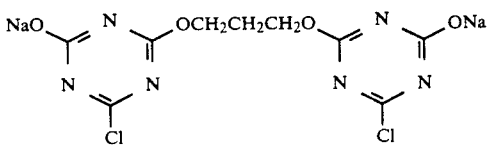

(N-4)

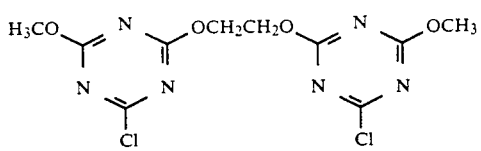

-continued

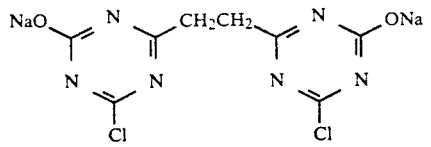
(N-5)

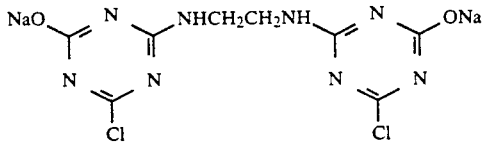
(N-6)

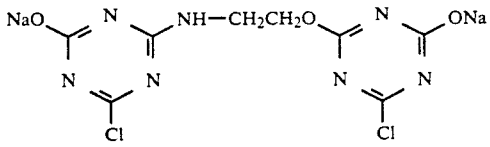
(N-7)

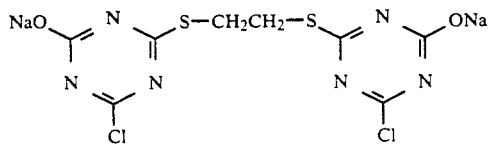
(N-8)

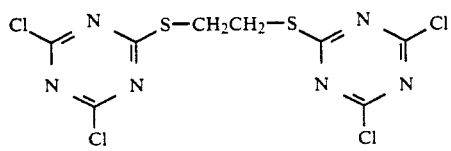
(N-9)

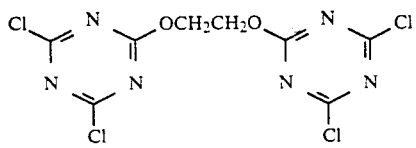
(N-10)

Various photographically useful additives known in fields other than those indicated above, for example, stabilizers, anti-foggants, surfactants, couplers outside the scope of the present invention, filter dyes and developing agents, for example, can be employed as desired in the color photographic photosensitive materials of the present invention.

Moreover, depending on the particular case, fine silver halide emulsions (for example silver chloride, silver bromide or silver chlorobromide emulsions of average grain size not more than 0.20$\mu$) which have essentially no photosensitivity can be present in the silver halide emulsion layers and other hydrophilic colloid layers.

The color development baths used for the development processing of photosensitive materials of this present invention are preferably aqueous alkaline solutions which contain primary aromatic amine based color developing agents as the principal components. Aminophenol based compounds can be used for the color developing agent, but the use of p-phenylenediamine based compounds is preferred. Typical examples of these compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and the sulfates, hydrochlorides and p-toluenesulfonates of these compounds. Two or more of these compounds can be used in combinastion, as desired.

Moreover, pH buffers such as alkali metal carbonates, borates or phosphates, and development inhibitors or anti-foggants such as bromides, iodides, benzimidazoles, benzothiazoles or mercapto compounds are generally present in the color development bath. Various preservatives such as hydroxylamine, diethylhydroxylamine, sulfites, hydrazines, phenylsemicarbazides, triethanolamine, catecholsulfonic acids and triethylenediamine(1,4-diazabicyclo[2,2,2]octane, organic solvents such as ethylene glycol and diethylene glycol, development accelerators such as benzyl alcohol, polyethylene glycol, quaternary ammonium salts and amines, dye forming couplers, competitive couplers, fogging agents such as sodium borohydride, auxiliary developing agents such as 1-phenyl-3-pyrazolidone, viscosity imparting agents, various chelating agents typified by the aminopolycarboxylic acids, aminopolyphosphonic acids, alkylphosphonic acids, phosphonocarboxylic acids, for example, ethylenediamine tetra-acetic acid, nitrilotriacetic acid, diethylenetriamine penta-acetic acid, cyclohexanediamine tetra-acetic acid, hydroxyethylimino diacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof can be used, as required.

Color development is carried out after normal black and white development where reversal processing is being used. Known black and white developing agents such as the dihydroxybenzenes, for example hydroquinone, the 3-pyrazolidones, for example 1-phenyl-3-pyrazolidone, or the aminophenols, for example N-methyl-p-aminophenol, can be used alone or in combination in the black and white development bath.

The rate of replenishment of these color development baths and black and white development baths depends of the color photographic photosensitive material which is being processed, but in general it is not more than 3 liters per square meter of photosensitive material, and it can be less than 500 ml per square meter of photosensitive material if the bromide ion concentration of the replenisher is reduced. It is desirable that the open area of the processing bath should be minimized to prevent evaporation and aerial oxidation of the bath where the rate of replenishment is low. The replenishment rate can be further reduced by using means for preventing the accumulation of bromide ion in the development bath.

The color developed photographic emulsion layer is normally subjected to a bleaching process. The bleaching process can be carried out at the same time as the fixing process or it may be carried out separately. Moreover, a method of processing in which bleach-fixing is carried out after a bleaching process can be used in order to speed up processing. Furthermore, a fixing process can be carried out prior to a bleach-fix process, or a bleaching process may be carried out after a bleach-fix process, in accordance with the intended purpose of the processing. Compounds of polyvalent metals, such as iron(III), cobalt(III), chromium(VI) and copper(II), peracids, quinones and nitro compounds, for example, can be used as bleaching agents. Thus, ferricyanides; dichromates; organic complex salts of iron(III) or cobalt(III), for example, complex salts with aminopolycarboxylic acids such as ethylenediamine tetraacetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid for example; persulfates; bromates; permanganates; and nitrobenzenes can be used as typical bleaching agents. Of these materials, the use of the aminopolycarboxylic acid iron(III) salts, principally ethylenediamine tetra-acetic acid iron(III) salts, and persulfates, is preferred from the points of view of both rapid processing and the prevention of environmental pollution. Moreover, the aminopolycarboxylic acid iron(III) complex salts are especially useful in both independent bleach baths and single bath bleach-fix baths.

Bleaching accelerators can be present, as required, in the bleach baths, bleach-fix baths or bleach or bleach-fix pre-baths. Specific examples of useful bleach accelerators are disclosed in the following specifications: the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630 JP-A-53-95631, JP-A- 53-104232, JP-A-53-124424, JP-A-53-141623, JP-A-53-28426, and *Research Disclosure* No. 17129 (July 1978); the thiazolidine derivatives disclosed in JP-A-50-140129; the thiourea derivatives disclosed JP-B-45-8506, JP-A-52-20832, JP-A-53-32735 and U.S. Pat. No. 3,706,561; the iodides disclosed in West German Patent 1,127,751 and JP-A-58-16235; the polyoxyethylene compounds disclosed in West German Patents 966,410 and 2,748,430; the other compounds disclosed in JP-A-49-42434, JP-A-49-59644, JP-A-53-94927, JP-A-54-35727, JP-A-55-26506 and JP-A-58-163940; and bromide ion. Of these compounds, those which have a mercapto group or a disulfide group are preferred from the standpoint of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleach accelerators may also be present in the photosensitive materials.

Thiosulfates, thiocyanates, thioether based compounds, thioureas and large amounts of iodide can be used, for example, as fixing agents, but thiosulfates are normally used, and ammonium thiosulfate can be used in the widest range of applications. Sulfites, bisulfites, or carbonyl/bisulfite addition compounds are the preferred preservatives for bleach-fix baths.

The silver halide color photographic photosensitive materials of this present invention are generally subjected to a water washing process and/or stabilization process after the de-silvering process. The amount of wash water used in a washing process can vary over a wide range, depending on the characteristics (such as the materials such as couplers which have been used) and application of the photosensitive material, the wash water temperature, the number of water washing tanks (the number of water washing stages), the replenishment system, i.e. whether a counter-flow or sequential flow system is used, and various other factors. The relationship between the amount of water used and the number of washing tanks in a multi-stage counter-flow system can be obtained using the method outlined on pages 248–253 of the *Journal of the Society of Motion Picture and Television Engineers,* Vol. 64 (May 1955).

The amount of wash water can be greatly reduced using the multi-stage counter-flow system noted in the aforementioned literature, but bacteria proliferate due to the increased residence time of the water in the tanks, and problems arise with the suspended matter which is produced becoming attached to the photosensitive material. The method in which the calcium ion and magnesium ion concentrations are reduced, as disclosed in Japanese Patent Application No. 61-131632, can be used very effectively as a means of overcoming this problem when processing color photographic photosensitive materials of this present invention. Furthermore, the isothiazolone compounds disclosed in JP-A-57-8542, thiabendazoles, the chlorine based disinfectants such as chlorinated sodium isocyanurate, and benzotriazole, for example, and the disinfectants disclosed in Horiguchi, *The Chemistry of Biocides and Fungicides* in *Killing Microorganisms, Biocidal and Fungicidal Techniques* published by the Health and Hygiene Technical Society, and in "*A Dictionary of Biocides and Fungicides*" published by the Japanese Biocide and Fungicide Society, can also be used in this connection.

The pH of the wash water when processing photosensitive materials of the present invention is from 4 to 9, and preferably from 5 to 8. The washing water temperature and the washing time can be varied in accordance with the characteristics and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are used. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used in such stabilization processes.

Furthermore, in some cases a stabilization process is carried out following the aforementioned water washing process. Chelating agents and fungicides can be added to these stabilizing baths. The overflow which accompanies replenishment of the above mentioned water washing and/or stabilizing baths can be reused in other processes, such as the de-silvering process.

Color developing agents can be incorporated into a silver halide color photosensitive material of this present invention to simplify and speed up processing. The use of various color developing agent precursors is preferred for incorporation. For example, the indoaniline based compounds disclosed in U.S. Pat. No. 3,342,597, the Schiff's base type compounds disclosed in U.S. Pat. No. 3,342,599 and *Research Disclosure,* No.14850 , ibid, No.15159, the aldol compounds disclosed in *Research Disclosure,* No.13924, the metal complex salts disclosed in U.S. Pat. No. 3,719,492, and the urethane based compounds disclosed in JP-A-53-135628, can be used for this purpose.

Various 1-phenyl-3-pyrazolidones can be incorporated, as required, into the silver halide color photosensitive materials of this present invention to accelerate color development. Typical compounds are disclosed, for example, in JP-A-56-64339, JP-A-57-144547 and JP-A-58-15438.

The various processing baths in this invention are used at a temperature of from 10° C. to 50° C. The standard temperature is normally from 33° C. to 38° C., but accelerated processing and shorter processing times can be achieved at higher temperatures while increased picture quality and improved processing bath stability can be achieved at lower temperatures. Furthermore, processes using cobalt intensification or hydrogen peroxide intensification as disclosed in West German Patent 2,226,770 or U.S. Pat. No. 3,674,499 can be used in order to economize on silver in the photosensitive material.

Heaters, temperature sensors, liquid level sensors, circulating pumps, filters, floating lids, squeegees etc, can be established, as required, in each of the processing baths.

The invention is described in greater detail below by referred to the following examples, but the invention is not to be construed as being limited by these examples.

EXAMPLE 1

A silver halide emulsion (A) for a red sensitive silver halide emulsion layer was prepared in the manner outlined below

| | |
|---|---|
| First Liquid | |
| $H_2O$ | 1000 cc |
| NaCl | 7.1 grams |
| KBr | 0.4 gram |
| Gelatin | 32.0 grams |
| Second Liquid | |
| Compound indicated below (1%) | 3.8 cc |

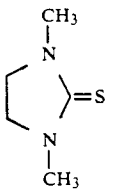

| | |
|---|---|
| Third Liquid | |
| KBr | 63.2 grams |
| NaCl | 10.5 grams |
| $H_2O$ to make up to | 600.0 cc |
| Fourth Liquid | |
| $AgNO_3$ | 120 grams |
| $NH_4NO_3$ (50% aq. soln.) | 1.5 cc |
| $H_2O$ to make up to | 540.0 cc |
| Fifth Liquid | |
| KBr | 19.3 grams |
| NaCl | 7.5 grams |
| $K_2IrCl_6$ (0.001 aq. soln. %) | 17.8 cc |
| $H_2O$ to make up to | 250.0 cc |
| Sixth Liquid | |
| $AgNO_3$ | 40 grams |
| $NH_4NO_3$ (50% aq. soln.) | 0.5 cc |
| $H_2O$ to make up to | 240 cc |

The first liquid was heated to 63° C. and the second liquid was added. Next, the third and fourth liquids were added simultaneously over a period of 40 minutes. After a further period of 10 minutes, the fifth liquid was added over a period of 15.5 minutes and the sixth liquid was added over a period of 12.5 minutes, the two additions being started simultaneously.

The temperature was lowered five minutes after the addition had been completed and the mixture was desalted. Water and dispersed gelatin were then added, the pH was adjusted to 6.40 and the mono-disperse cubic silver chlorobromide Emulsion (A) of an average grain size of 0.48 μm, a variation coefficient (the value obtained by dividing the standard deviation by the average grain size, s/d) of 0.10 and a silver bromide content of 74 mol % was obtained. This emulsion was then subjected to optimal chemical sensitization using triethylthiourea.

Next, Emulsion (B) was obtained using the same method as used to prepare Emulsion (A) except that the time for the addition of the fifth liquid was changed to 12.5 minutes.

Next, Emulsion (C) was obtained using the same method as used to prepare Emulsion (A) except that the amounts of KBr and NaCl in the third liquid were changed to 58.5 grams and 1.9 grams, respectively, and the amounts of KBr and NaCl in the fifth liquid were changed to 24.1 grams and 5.18 grams, respectively.

Furthermore, Emulsion (D) was obtained using the same methods as used to prepare Emulsion (A) except that the temperature of the first liquid was changed to 58° C.

Silver halide Emulsions (E) and (F) for the blue sensitive silver halide emulsion layer and silver halide Emulsions (G) and (H) for the green sensitive silver halide emulsion layer were prepared in the same way as Emulsion (A) by varying the quantities of reagents, the temperatures and the addition times.

The form, average grain size, halogen composition and variation coefficient of the each of the silver halide Emulsions (A)-(H) was as indicated below.

| Emulsion | Form | Average Grain Size (μm) | Halogen Comp. (Br mol. %) | Variation Coefficient |
|---|---|---|---|---|
| (A) | Cubic | 0.48 | 74 | 0.10 |
| (B) | Cubic | 0.48 | 74 | 0.10 |
| (C) | Cubic | 0.48 | 74 | 0.10 |
| (D) | Cubic | 0.34 | 74 | 0.10 |
| (E) | Cubic | 0.88 | 79 | 0.06 |
| (F) | Cubic | 0.65 | 80 | 0.06 |
| (G) | Cubic | 0.46 | 90 | 0.09 |
| (H) | Cubic | 0.35 | 90 | 0.09 |

A multi-layer color photographic photosensitive material (101) of which the layer structure is indicated below was prepared on a paper support which had been laminated on both sides with polyethylene.

The coating liquids were prepared in the following way:

Preparation of the First Layer Coating Liquid

Ethyl acetate (29.9 cc), 3.8 cc of the solvent (Solv-1) and 3.8 cc of the solvent (Solv-2) were added to 19.1 grams of the yellow coupler (ExY), 0.17 gram of the anti-foggant (Cpd-1) and 1.91 grams of the colored image stabilizer (Cpd-2) to form a solution which was then emulsified and dispersed in 135 cc of a 10% aqueous gelatin solution which contained 8 cc of 10% sodium dodecylbenzenesulfonate. On the other hand, 102.5 grams of a 3:7 mixture of the silver halide Emulsions (E) and (F) was mixed with 130 grams of a 10% aqueous gelatin solution, after which 26.7 cc of a 0.1% methanolic solution of the blue sensitizing dye indicated below and 6.9 cc of a 2% aqueous solution of 4-hydroxy-6-methyl-1,3,3a,7-tetra-azaindene were added. Next, the aforementioned emulsified dispersion was added, after which the pH and viscosity were adjusted to provide the first layer coating liquid. Poly(potassium styrenesulfonate) was almost used for viscosity adjustment.

The coating liquids for the second to the seventh layers were prepared using the same method as used for the first layer coating liquid.

Moreover, 1-oxy-3,5-dichloro-s-triazine, sodium salt, was used in each layer as a gelatin hardening agent.

The following spectrally sensitizing dyes were used in the blue, and green sensitive emulsion layers respectively, and the dye shown in Table 1 below was used as spectrally sensitizing dyes in the red sensitive emulsion layer.

Blue Sensitive Emulsion Layer:

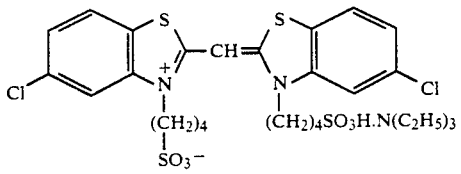

($3.8 \times 10^{-4}$ mol per mol of emulsion)

Green Sensitive Emulsion Layer:

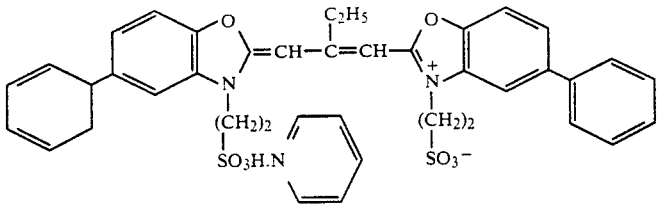

($2.1 \times 10^{-4}$ mol per mol of emulsion)

and

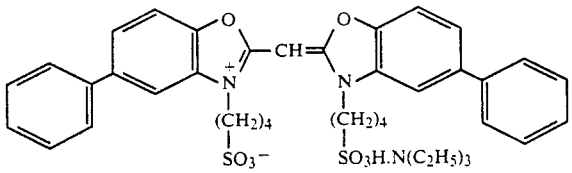

($4.2 \times 10^{-5}$ mol per mol of emulsion)

The compound indicated below was employed in an amount of $2.3 \times 10^{-3}$ mol per mol of silver halide to the red sensitive emulsion layer.

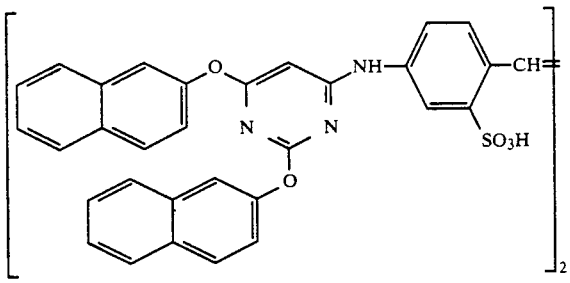

Furthermore, 4-hydroxy-6-methyl-1,3,3a,7-tetraazaindene was added to the blue sensitive and green sensitive emulsion layers at rates of $1.2 \times 10^{-2}$ mol and $1.3 \times 10^{-3}$ mol, per mol of silver halide respectively.

Furthermore, 1-(5-methylureidophenyl)-5-mercaptotetrazole was added to the green sensitive emulsion layer in an amount of $5.0 \times 10^{-4}$ mol per mol of silver halide.

Moreover, the silver halide emulsions, anti-foggants and cyan couplers shown in Table 1 were added to the red sensitive emulsion layer.

Additionally, the following dyes were used as anti-irradiation dyes:

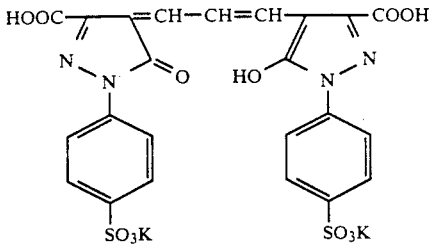

and

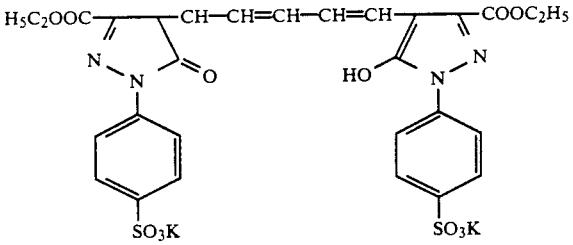

The composition of each layer is indicated below. The numerical values indicate coated weights ($g/m^2$), the coated weight being indicated after calculation as silver in the case of the silver halide emulsions. Furthermore, the compounds disclosed in the preparation of the aforementioned coating liquids have been omitted.

Support

A paper support laminated on both sides with polyethylene.

[white pigment ($TiO_2$) and a blue dye (ultramarine) were present in the polyethylene on the side on which the first layer was coated]

| | |
|---|---|
| First Layer (Blue Sensitive Layer) | |
| Silver Halide Emulsion (E) | 0.09 |
| Silver Halide emulsion (F) | 0.21 |
| Gelatin | 1.28 |
| Yellow Coupler (ExY) | 0.68 |
| Anti-Foggant (Cpd-1) | 0.006 |
| Colored Image Stabilizer (Cpd-2) | 1.07 |
| Solvent (Solv-1) | 0.12 |
| Solvent (Solv-2) | 0.12 |
| Second Layer (Anti-color mixing layer) | |
| Gelatin | 0.34 |
| Anti-Color Mixing Agent (Cpd-3) | 0.04 |
| Solvent (Solv-3) | 0.10 |
| Solvent (Solv-4) | 0.10 |
| Third Layer (Green Sensitive Layer) | |
| Silver Halide Emulsion (G) | 0.05 |
| Silver Halide Emulsion (H) | 0.075 |
| Gelatin | 1.47 |
| Magenta Coupler (ExM-1) | 0.32 |
| Colored Image Stabilizer (Cpd-4) | 0.10 |
| Anti-Staining Agent (Cpd-5) | 0.08 |
| Anti-Ataining Agent (Cpd-6) | 0.03 |
| Solvent (Solv-3) | 0.25 |

-continued

| | |
|---|---|
| Solvent (Solv-5) | 0.40 |
| Fourth Layer (Ultraviolet Absorbing Layer) | |
| Gelatin | 1.43 |
| Ultraviolet Absorber (UV-1) | 0.47 |
| Anti-Color Mixing Agent (Cpd-3) | 0.05 |
| Solvent (Solv-6) | 0.24 |
| Fifth Layer (Red Sensitive Layer) | |
| Anti-Foggant (Cpd-1) | 0.008 |
| Anti-Staining Agent (Cpd-5) | 0.004 |
| Anti-Staining Agent (Cpd-6) | 0.007 |
| Color Image Stabilizer (Cpd-7) | 0.067 |
| Solvent (Solv-1) | 0.16 |
| Sixth Layer (Ultraviolet Absorbing Layer) | |
| Gelatin | 0.38 |
| Ultraviolet Absorber (UV-1) | 0.13 |
| Solvent (Solv-6) | 0.06 |
| Seventh Layer (Protective Layer) | |
| Gelatin | 1.25 |
| Acrylic Modified Poly(vinyl Alcohol) Copolymer (17% modification) | 0.05 |
| Liquid Paraffin | 0.02 |

(ExY) Yellow Coupler

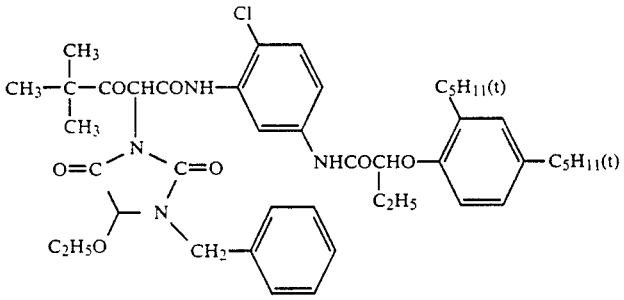

(ExM-1) Magenta Coupler

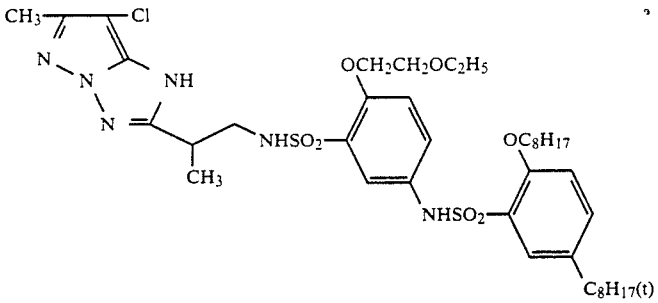

(Cpd-1) Anti-foggant

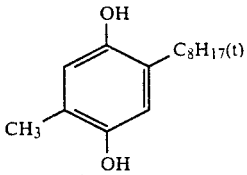

(Cpd-2) Colored Image Stabilizer

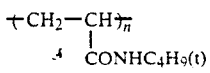

Average Molecular Weight: 60,000

(Cpd-3) Anti-color Mixing Agent

-continued
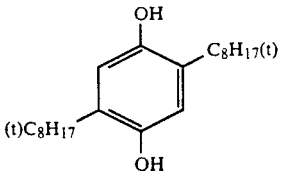
(Cpd-4) Colored Image Stabilizer
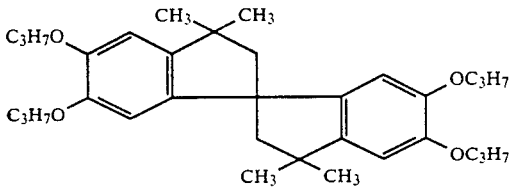
(Cpd-5) Anti-staining Agent
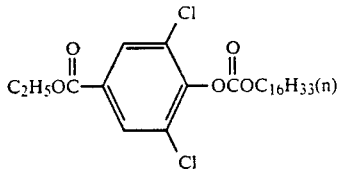
(Cpd-6) Anti-staining Agent
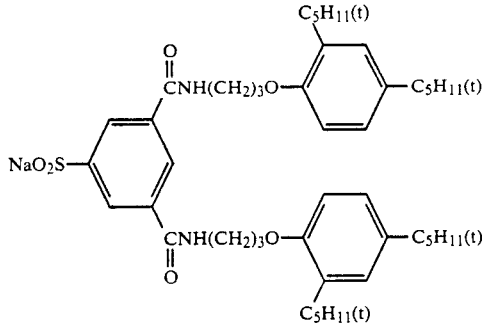
(Cpd-7) Colored Image Stabilizer
A 4:2:5 (by weight) mixture of:
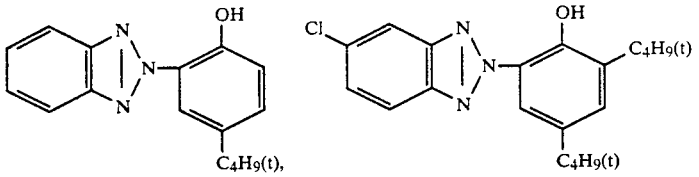
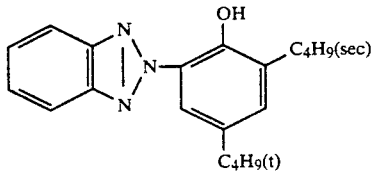
(UV-1) Ultraviolet Absorber
A 12:10:3 (by weight) mixture of:
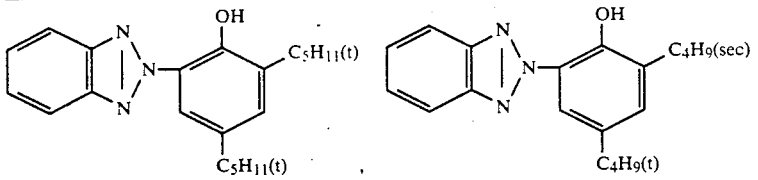

-continued

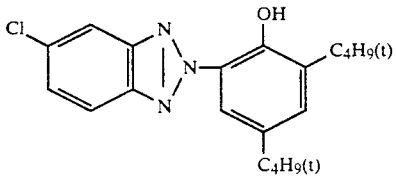

(Solv-1) Solvent

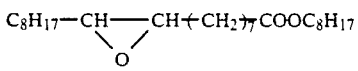

(Solv-2) Solvent $O{=}P{+}O{-}C_9H_{19}\text{-iso})_3$ (Solv-3) Solvent

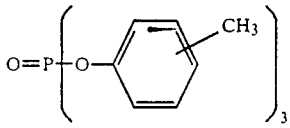

(Solv-4) Solvent

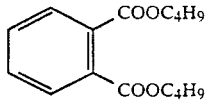

(Solv-5) Solvent $O{=}P{+}OCH_2CH(C_2H_5)C_4H_9)_3$ (Solv-6) Solvent

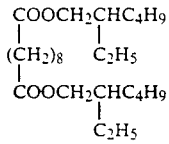

Samples 102 to 109 were prepared on the basis of the layer structure described above by changing the silver halide emulsions, sensitizing dye, anti-foggant, cyan coupler and polymer in the fifth layer in the ways shown in Table 1.

(Comparative Compound-1)

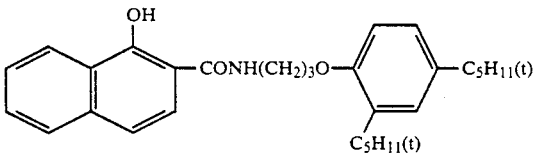

(Comparative Compound-2)

-continued

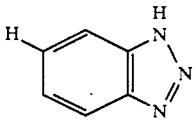

(Comparative Compound-3)

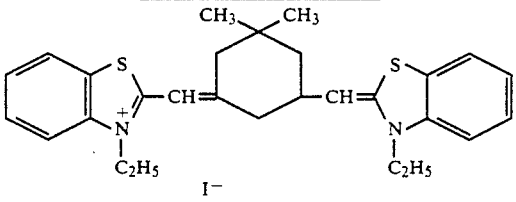

TABLE 1

| Sample No. | Silver Halide Emulsion Type | Silver Halide Emulsion Coated Weight (as silver) | Sensitizing Dye Type | Sensitizing Dye Amount Added per Mol of Silver Halide mol | Antifoggant Type | Antifoggant Amount Added per Mol of Silver Halide mol | Cyan Coupler Type | Cyan Coupler Coated Weight | Polymer Type | Polymer Coated Weight |
|---|---|---|---|---|---|---|---|---|---|---|
| 101 (Invention) | A | 0.06 g/m² | I-6 | $6.1 \times 10^{-5}$ | C-1 | $3.5 \times 10^{-4}$ | III-11 | 0.13 g/m² | P-57 | 0.25 g/m² |
| | D | 0.14 | | | D-43 | $1.7 \times 10^{-4}$ | III-3 | 0.15 | | |
| 102 (Invention) | A | 0.06 g/m² | I-6 | $6.1 \times 10^{-5}$ | C-1 | $3.5 \times 10^{-4}$ | III-11 | 0.13 g/m² | — | — |
| | D | 0.14 | | | D-43 | $1.7 \times 10^{-4}$ | III-3 | 0.15 | | |
| 103 (Inven- | A | 0.06 g/m² | I-6 | $6.1 \times 10^{-5}$ | C-1 | $3.5 \times 10^{-4}$ | Compara- | 0.30 | P-57 | 0.25 |

TABLE 1-continued

| Sample No. | Silver Halide Emulsion Type | Silver Halide Emulsion Coated Weight (as silver) | Sensitizing Dye Type | Sensitizing Dye Amount Added per Mol of Silver Halide mol | Antifoggant Type | Antifoggant Amount Added per Mol of Silver Halide mol | Cyan Coupler Type | Cyan Coupler Coated Weight | Polymer Type | Polymer Coated Weight |
|---|---|---|---|---|---|---|---|---|---|---|
| tion) | D | 0.14 | | | D-43 | $1.7 \times 10^{-4}$ | tive Com-pound-1 | | | |
| 104 (Comparative Example) | A<br>D | 0.06 g/m$^2$<br>0.14 | I-6 | $6.1 \times 10^{-5}$ | — | — | II-11<br>III-3 | 0.13<br>0.15 | P-57 | 0.25 |
| 105 (Comparative Example) | A<br>D | 0.06 g/m$^2$<br>0.14 | I-6 | $6.1 \times 10^{-5}$ | Comparative Compound-2 | $5.2 \times 10^{-4}$ | II-11<br>III-3 | 0.13<br>0.15 | P-57 | 0.25 |
| 106 (Comparative Example) | A<br>D | 0.06 g/m$^2$<br>0.14 | Comparative Compound-3 | $6.1 \times 10^{-5}$ | C-I<br>D-43 | $3.5 \times 10^{-4}$<br>$1.7 \times 10^{-4}$ | II-11<br>III-3 | 0.13<br>0.15 | P-57 | 0.25 |
| 107 (Invention) | A | 0.20 | I-6 | $4.8 \times 10^{-5}$ | C-I<br>D-43 | $3.5 \times 10^{-4}$<br>$1.7 \times 10^{-4}$ | II-11<br>III-3 | 0.13<br>0.15 | P-57 | 0.25 |
| 108 (Comparative Example) | B | 0.20 | I-6 | $4.8 \times 10^{-5}$ | C-I<br>D-43 | $3.5 \times 10^{-4}$<br>$1.7 \times 10^{-4}$ | II-11<br>III-3 | 0.13<br>0.15 | P-57 | 0.25 |
| 109 (Comparative Example) | C | 0.20 | I-6 | $4.8 \times 10^{-5}$ | C-I<br>D-43 | $3.5 \times 10^{-4}$<br>$1.7 \times 10^{-4}$ | II-11<br>III-3 | 0.13<br>0.15 | P-57 | 0.25 |

Moreover, the coating liquid for the fifth layer was aged for 6 hours at 40° C. after preparation before coating.

The above mentioned Samples 101–109 were subjected to a graded exposure for sensitometric purposes through a red filter using a sensitometer (model FWH, made by the Fuji Photographic Film Co., Color temperature of the light source: 3200K)

The exposure at this time was made so as to provide a 250 CMS exposure with an exposure time of 0.1 second. After exposure, the samples were processed using the processing operations indicated below.

| Processing Operation | Temperature | Time |
|---|---|---|
| Color Development | 33° C. | 3 minutes 30 seconds |
| Bleach-Fix | 33° C. | 1 minute 30 seconds |
| Water Wash (1) | 30–34° C. | 60 seconds |
| Water Wash (2) | 30–34° C. | 60 seconds |
| Water Wash (3) | 30–34° C. | 60 seconds |
| Drying | 70–80° C. | 50 seconds |

(A three tank counted-flow system from water wash (3) (1) was used)

The compositions of the processing baths were as follows:

| Color Development Bath | |
|---|---|
| Water | 800 ml |
| Diethylenetriamine Penta-acetic Acid | 1.0 gram |
| Nitrilotriacetic Acid | 1.5 grams |

-continued

| | |
|---|---|
| Benzyl Alcohol | 15 ml |
| Diethylene Glycol | 10 ml |
| Sodium Sulfite | 2.0 grams |
| Potassium Bromide | 0.5 grams |
| Potassium Carbonate | 30 grams |
| N-Ethyl-N-(β-methanesulfonamidoethyl)-3-methyl-4-aminoaniline Sulfate | 5.0 grams |
| Hydroxylamine Hydrochloride | 4.0 grams |
| Fluorescent Whitener (WHITEX 4B, made by Sumitomo Chemicals) | 1.0 gram |
| Water to make up to | 1000 ml |
| pH (25° C.) | 10.20 |
| Bleach-fix Bath | |
| Water | 400 ml |
| Ammonium Thiosulfate (70% aq. soln.) | 150 ml |
| Sodium Sulfite | 18 grams |
| Ethylenediamine Tetra-acetic Acid Fe(III) Ammonium Salt | 55 grams |
| Ethylenediamine Tetra-acetic Acid, Di-sodium Salt | 5 grams |
| Water to make up to | 1000 ml |
| pH (25° C.) | 6.70 |

The fog density and relative speed were used for assessing photographic performance, and the assessments were made on two occasions, i.e.,on the seventh and fiftieth days after the samples had been prepared. Moreover, the samples were stored under conditions of 25° C., 60% RH. Furthermore, the speed was expressed in terms of the reciprocal of the exposure required to provide a density of 0.5 above the fog density.

The results obtained are shown in Table 2 below.

TABLE 2

| Sample Number | 7 Days After Sample Preparation Fog Density | 7 Days After Sample Preparation Relative Speed | 50 Days After Sample Preparation Fog Density | 50 Days After Sample Preparation Relative Speed |
|---|---|---|---|---|
| 101 (Invention) | 0.10 | 100 (Standard) | 0.10 | 98 |
| 102 (Invention) | 0.10 | 98 | 0.11 | 95 |
| 103 (Invention) | 0.10 | 97 | 0.11 | 95 |
| 104 (Comp. Ex.) | 0.21 | 75 | 0.29 | 65 |
| 105 (Comp. Ex.) | 0.11 | 80 | 0.19 | 70 |
| 106 (Comp. Ex.) | 0.10 | 50 | 0.12 | 36 |
| 107 (Invention) | 0.11 | 120 | 0.11 | 118 |
| 108 (Comp. Ex) | 0.11 | 60 | 0.12 | 55 |
| 109 (Comp. Ex.) | 0.14 | 60 | 0.16 | 55 |

It is clear from the results in Table 2 that Samples 101–103 and 107 of this invention had a high photographic speed and low fog levels, and that there was very little change in the photographic speed or fog level even when the materials were used after prolonged ageing. Furthermore, with Sample 107 in particular, the photographic speed was very high because the core/-shell grains had been subjected to halogen conversion, and the fog level was also very low (compare with Samples 108 and 109).

EXAMPLE 2

Evaluations were carried out in the same manner as in Example 1 except that the processing operations were changed as indicated below.

| Processing Operation | Temperature | Time |
|---|---|---|
| Color Development | 37° C. | 3 minutes 30 seconds |
| Bleach-Fix | 33° C. | 1 minute 30 seconds |
| Water Wash (1) | 30–34° C. | 60 seconds |
| Water Wash (2) | 30–34° C. | 60 seconds |
| Water Wash (3) | 30–34° C. | 60 seconds |
| Drying | 70–80° C. | 60 seconds |

(A three tank counted-flow system from water wash (3) (1) was used.)

The composition of the processing baths were as follows:

| | |
|---|---|
| Color Development Bath | |
| Water | 800 ml |
| Diethylenetriamine Penta-acetic Acid | 1.0 gram |
| Nitrilotriacetic Acid | 2.0 grams |
| Benzyl Alcohol | 15 ml |
| Diethylene Glycol | 10 ml |
| Sodium Sulfite | 2.0 grams |
| Potassium Bromide | 1.0 grams |
| Potassium Carbonate | 30 grams |
| N-Ethyl-N-(β-methanesulfonamidoethyl)-3-methyl-4-aminoaniline Sulfate | 4.5 grams |
| Hydroxylamine Hydrochloride | 3.0 grams |
| Fluorescent Whitener (WHITEX 4B, made by Sumitomo Chemicals) | 1.0 gram |
| Water to make up to | 1000 ml |
| pH (25° C.) | 10.25 |
| Bleach-fix Bath | |
| Water | 400 ml |
| Ammonium Thiosulfate (70% aq. soln.) | 150 ml |
| Sodium Sulfite | 18 grams |
| Ethylenediamine Tetra-acetic Acid Fe(III) Ammonium Salt | 55 grams |
| Ethylenediamine Tetra-acetic Acid, Di-sodium Salt | 5 grams |
| Water to make up to | 1000 ml |
| pH (25° C.) | 6.70 |

The results obtained were the same as those shown in Table 2, and the superior performance of the invention was confirmed.

EXAMPLE 3

Evaluations were carried out in the same manner as in Example 1 except that the processing operations were changed as indicated below.

| Processing Operation | Temperature | Time |
|---|---|---|
| Color Development | 38° C. | 1 minutes 40 seconds |
| Bleach-Fix | 35° C. | 60 seconds |
| Rinse (1) | 33–35° C. | 20 seconds |
| Rinse (2) | 33–35° C. | 20 seconds |
| Rinse (3) | 33–35° C. | 20 seconds |
| Drying | 70–80° C. | 50 seconds |

The compositions of the processing baths were as follows:

| | |
|---|---|
| Color Development Bath | |
| Water | 800 ml |
| Diethylenetriamine Penta-acetic Acid | 1.0 gram |
| Nitrilotriacetic Acid | 2.0 grams |
| 1-Hydroxyethylidene-1,1-diphosphonic Acid | 2.0 grams |
| Benzyl Alcohol | 16 ml |
| Diethylene Glycol | 10 ml |
| Sodium Sulfite | 2.0 grams |
| Potassium Bromide | 0.5 grams |
| Potassium Carbonate | 30 grams |
| N-Ethyl-N-(β-methanesulfonamidoethyl)-3-methyl-4-aminoaniline Sulfate | 5.5 grams |
| Hydroxylamine Hydrochloride | 2.0 grams |
| Fluorescent Whitener (WHITEX 4B, made by Sumitomo Chemicals) | 1.5 gram |
| Water to make up to | 1000 ml |
| pH (25° C.) | 10.20 |
| Bleach-fix Bath | |
| Water | 400 ml |
| Ammonium Thiosulfate (70% aq. soln.) | 80 ml |
| Sodium Sulfite | 24 grams |
| Ethylenediamine Tetra-acetic Acid Fe(III) Ammonium Salt | 30 grams |
| Ethylenediamine Tetra-acetic Acid, Di-sodium Salt | 5 grams |
| Water to make up to | 1000 ml |
| pH (25° C.) | 6.50 |

The results obtained were the same as those shown in Table 2, and the superior performance of the invention was confirmed.

EXAMPLE 4

Samples 401–409 were prepared in the same manner as in Example 1 except that the structure of the third layer was different from that in Sample 101 and the silver halide emulsions, sensitizing dye, anti-foggant, cyan coupler and polymer shown in Table 3 were added to the red sensitive layer.

| Third Layer (Green Sensitive Layer) | |
|---|---|
| Silver Halide Emulsion (G) | 0.10 |
| Silver Halide Emulsion (H) | 0.20 |
| Gelatin | 1.00 |
| Spectrally Sensitizing Dye (Sen-1,2) | $2.1 \times 10^{-4}$ mol/mol of emulsion |
| Anti-Foggant (Illustrative Compound E-1) | 0.004 |
| Anti-Foggant (Illustrative Compound B-1) | 0.002 |
| Magenta Coupler (ExM-2) | 0.25 |
| Colored Image Stabilizer (Cpd-4) | 0.10 |
| Colored Image Stabilizer (Cpd-8) | 0.05 |
| Colored Image Stabilizer (Cpd-9) | 0.10 |
| Colored Image Stabilizer (Cpd-10) | 0.08 |
| Solvent (Solv-3) | 0.20 |
| Solvent (Solv-5) | 0.16 |

The numerical values unless otherwise specified indicate coated weights (g/m$^2$), the coated weights of the silver halide emulsions being shown as coated weights calculated as silver.

(Sen-1)
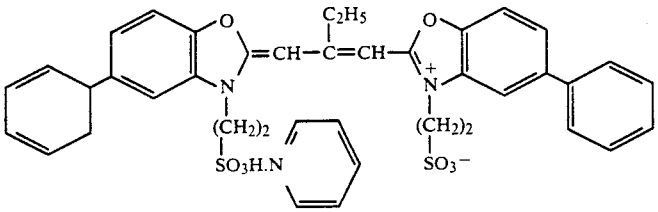
($2.1 \times 10^{-4}$ mol per mol of emulsion)
(Sen-2)
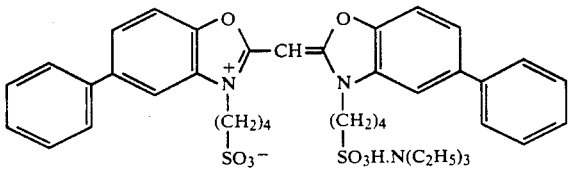
($4.2 \times 10^{-5}$ mol per mol of emulsion)
(ExM-2) Magenta Coupler
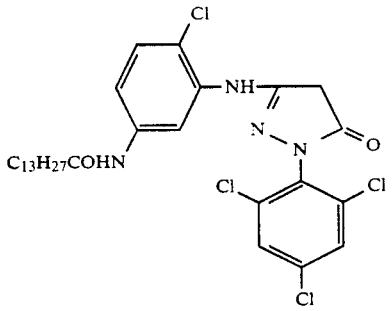
(Cpd-8) Colored Image Stabilizer
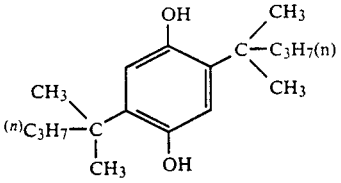
(Cpd-9) Colored Image Stabilizer
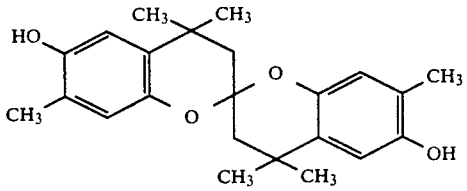
(Cpd-10) Colored Image Stabilizer
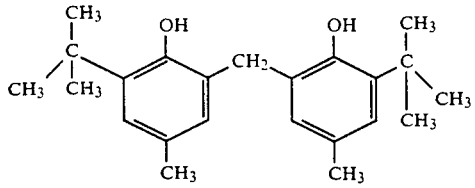

TABLE 1

| Sample No. | Silver Halide Emulsion Type | Silver Halide Emulsion Coated Weight (as silver) | Sensitizing Dye Type | Sensitizing Dye Amount Added per Mol of Silver Halide mol | Antifoggant Type | Antifoggant Amount Added per Mol of Silver Halide mol | Cyan Coupler Type | Cyan Coupler Coated Weight | Polymer Type | Polymer Coated Weight |
|---|---|---|---|---|---|---|---|---|---|---|
| 401 (Invention) | A<br>D | 0.06 g/m$^2$<br>0.14 | I-4 | $6.1 \times 10^{-5}$ | C-1 | $3.5 \times 10^{-4}$ | III-1<br>III-14 g/m$^2$ | 0.13<br>0.15 | P-127 | 0.25 g/m$^2$ |
| 402 (Invention) | A<br>D | 0.06 g/m$^2$<br>0.14 | I-4 | $6.1 \times 10^{-5}$ | C-1 | $3.5 \times 10^{-4}$ | III-1<br>III-14 | 0.13 g/m$^2$<br>0.15 | — | — |
| 403 (Invention) | A<br>D | 0.06 g/m$^2$<br>0.14 | I-4 | $6.1 \times 10^{-5}$ | C-1 | $3.5 \times 10^{-4}$ | Comparative Compound-4 | 0.30 | P-127 | 0.25 |
| 404 (Comparative Example) | A<br>D | 0.06 g/m$^2$<br>0.14 | I-4 | $6.1 \times 10^{-5}$ | — | — | III-1<br>III-14 | 0.13<br>0.15 | P-127 | 0.25 |
| 405 (Comparative Example) | A<br>D | 0.06 g/m$^2$<br>0.14 | I-4 | $6.1 \times 10^{-5}$ | Comparative Compound-5 | $3.5 \times 10^{-4}$ | II-1<br>III-14 | 0.13<br>0.15 | P-127 | 0.25 |
| 406 (Comparative Example) | A<br>D | 0.06 g/m$^2$<br>0.14 | Comparative Compound-6 | $6.1 \times 10^{-5}$ | C-I | $3.5 \times 10^{-4}$ | III-1<br>III-14 | 0.13<br>0.15 | P-127 | 0.25 |
| 407 (Invention) | A | 0.20 | I-4 | $4.8 \times 10^{-5}$ | C-I | $3.5 \times 10^{-4}$ | III-1<br>III-14 | 0.13<br>0.15 | P-127 | 0.25 |
| 408 (Comparative Example) | B | 0.20 | I-4 | $4.8 \times 10^{-5}$ | C-I | $3.5 \times 10^{-4}$ | III-1<br>III-14 | 0.13<br>0.15 | P-127 | 0.25 |
| 409 (Comparative Example) | C | 0.20 | I-4 | $4.8 \times 10^{-5}$ | C-I | $3.5 \times 10^{-4}$ | III-1<br>III-14 | 0.13<br>0.15 | P-127 | 0.25 |

(Comparative Compound-4)

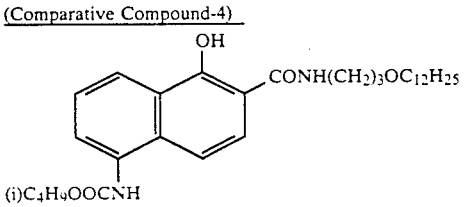

(Comparative Compound-5)

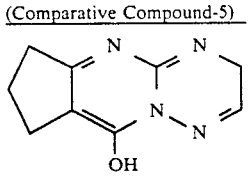

(Comparative Compound-6)

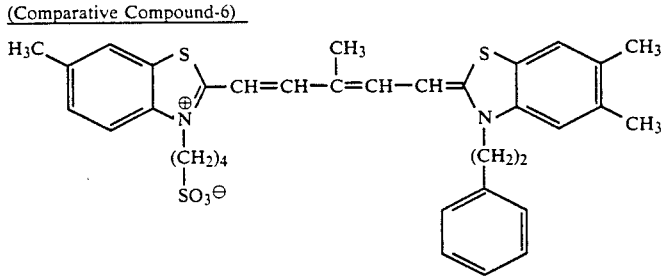

Moreover, the coating liquid for the fifth layer was aged for 6 hours at 40° C. after preparation before coating.

The above mentioned Samples 401 to 409 were evaluated in the same manner as in Example 1. The results are shown in Table 4.

TABLE 4

| Sample Number | 7 Days After Sample Preparation Fog Density | 7 Days After Sample Preparation Relative Speed | 50 Days After Sample Preparation Fog Density | 50 Days After Sample Preparation Relative Speed |
|---|---|---|---|---|
| 401 (Invention) | 0.10 | 100 (Standard) | 0.10 | 98 |
| 402 (Invention) | 0.10 | 99 | 0.11 | 96 |
| 403 (Invention) | 0.10 | 96 | 0.11 | 94 |

TABLE 4-continued

| Sample Number | 7 Days After Sample Preparation | | 50 Days After Sample Preparation | |
|---|---|---|---|---|
| | Fog Density | Relative Speed | Fog Density | Relative Speed |
| 404 (Comp. Ex.) | 0.23 | 77 | 0.28 | 65 |
| 405 (Comp. Ex.) | 0.12 | 80 | 0.18 | 70 |
| 406 (Comp. Ex.) | 0.10 | 55 | 0.11 | 35 |
| 407 (Invention) | 0.11 | 122 | 0.11 | 119 |
| 408 (Comp. Ex) | 0.11 | 62 | 0.12 | 56 |
| 409 (Comp. Ex.) | 0.14 | 65 | 0.15 | 57 |

It is clear that Samples 401 to 403 and 407 had a high photographic speed and low fog level as in the case of Example 1, and that the performance was excellent even after prolonged ageing.

It is possible, with the present invention, to obtain silver halide photographic photosensitive materials which have a high photographic speed, and which have good production stability, and which have superior long term storage properties.

While the invention has been described in detail and with reference to specific embodiments thereof, it will be apparent to one skilled in the art that various changes and modifications can be made therein without departing from the spirit and scope thereof.

What is claimed is:

1. A silver halide photosensitive material comprising a support having thereon at least one silver halide emulsion layer containing silver halide grains obtained by subjecting the surface of silver halide grains which comprise essentially silver iodide free silver chlorobromide and which have a plurality of layers of different halogen compositions within the grains to halogen conversion and containing at least one bridged pentamethine cyanine dye compound represented by the general formula (I) or (I'):

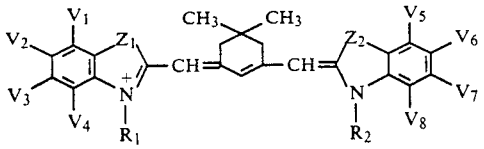

(I)

Xn

Wherein $Z_1$ and $Z_2$, which may be the same or different, each represents a sulfur atom or a selenium atom;

$R_1$ and $R_2$, which may be the same or different, each represents an alkyl group; with the proviso that at least one of the groups represented by $R_1$ and $R_2$ is a butyl group, a pentyl group, a hexyl group, a heptyl group or an octyl group;

$V_1$, $V_2$, $V_3$, $V_4$, $V_5$, $V_6$, $V_7$ and $V_8$, which may be the same or different, each represents a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group or an aryl group, or two of the groups represented by $V_1$–$V_8$ which are bonded to adjacent carbon atoms may combine and form a condensed ring;

X represents an electrical charge balancing counter ion; and n is the value required to neutralize the electrical charge;

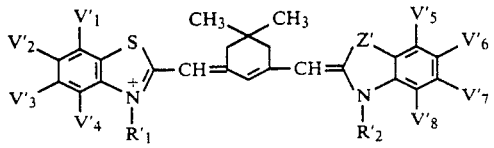

(I')

X'n wherein, Z' represents an oxygen atom or a sulfur atom;

$R'_1$ and $R'_2$, which may be the same or different, each represents a substituted or unsubstituted alkyl groups;

$V'_1$, $V'_2$, $V'_3$, $V'_4$, $V'_5$, $V'_6$, $V'_7$ and $V'_8$, which may be the same or different, each represents a hydrogen atom, an alkyl group, an acyl group, an acyloxy group, an alkoxycarbonyl group a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group or an aryl group, and two of the groups represented by $V'_1$–$V'_8$ which are bonded to adjacent carbon atoms cannot together form a condensed ring, and if the Hammett $\sigma_p$ values are $\sigma_{pi}$ (i=1 to 8) and $Y=\sigma_{p1}+\sigma_{p2}+\sigma_{p3}+\sigma_{p4}+\sigma_{p5}+\sigma_{p6}+\sigma_{p7}+\sigma_{p8}$, then $Y \leqq -0.08$ when Z' is an oxygen atom and $Y \leqq -0.15$ when Z' is a sulfur atom;

X represents an electrical charge balancing counter ion; and n is the value required to neutralize the electrical charge, and at least one compound represented by the general formula (II):

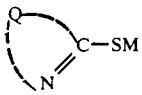

(II)

wherein, Q represents a group of atoms required to form a five or six membered heterocyclic ring which may be condensed with a benzene ring; and M represents a hydrogen atom, an alkali metal atom, an ammonium group or a precursor thereof.

2. The silver halide photosensitive material as in claim 1, wherein the thus obtained silver halide grains are an essentially silver iodide free silver chlorobromide.

3. The silver halide photosensitive material as in claim 1, wherein the silver chlorobromide grains contain 0.3 to 97 mol % silver bromide.

4. The silver halide photosensitive material as in claim 3, wherein the silver chlorobromide grains contain 0.5 to 90 mol % silver bromide.

5. The silver halide photosensitive material as in claim 1, wherein the silver chlorobromide grains contain 0.3 to 10 mol % silver bromide.

6. The silver halide photosensitive material as in claim 1, wherein the silver chlorobromide grains contain 45 to 97 mol % silver bromide.

7. The silver halide photosensitive material as in claim 6, wherein the silver chlorobromide grains contain 60 to 97 mol % silver bromide.

8. The silver halide photosensitive material as in claim 1, wherein said silver halide grains comprises at least two partial constitutions in which the silver bromide content is different in an amount of 10 mol % or more.

9. The silver halide photosensitive material as in claim 8, wherein said silver halide grains are core/shell grains in which the silver bromide content between two parts differs by 10 to 80 mol %.

10. The silver halide photosensitive material as in claim 9, wherein the silver bromide content differs by 10 to 50 mol %.

11. The silver halide photosensitive material as in claim 1, wherein an amount of the halogen conversion is 0.5 to 20 mol % based on a total silver halide.

12. The silver halide photosensitive material as in claim 11, wherein an amount of the halogen conversion is 1 to 15 mol %.

13. The silver halide photosensitive material as in claim 1 wherein said silver halide emulsion additionally contains a dispersion of fine lipophilic particles obtained by emulsification and dispersion of a liquid mixture obtained by dissolving at least one cyan coupler represented by the general formula (III):

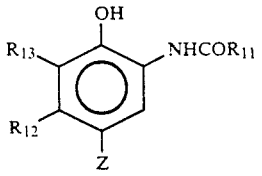

(III)

wherein, $R_{11}$ represents an alkyl group, a cycloalkyl group, an aryl group or a heterocyclic group, $R_{12}$ represents an acylamino group or an alkyl group which has at least one carbon atom, or $R_{12}$ combines with $R_{13}$ to form a nitrogen containing heterocyclic ring;

$R_{13}$ represents a hydrogen atom, a halogen atom, an alkyl group or an alkoxy group, with the proviso that $R_{11}$ represents an aryl group when $R_{12}$ represents an acylamino group;

Z represents a hydrogen atom, or a group or atom which can be eliminated in a reaction with the oxidation product of a primary aromatic amine color developing agent; and at least one homopolymer or copolymer which is water insoluble and soluble in organic solvents.

14. The silver halide photosensitive material as in claim 1, wherein the compound of formula (II) is a mercaptotetrazole based compound represented by formula (B);

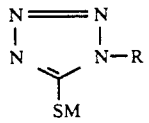

(B)

wherein R represents an alkyl group, an alkenyl group or an aryl group; and M represents a hydrogen atom, an alkali metal atom, an ammonium group or a precursor thereof.

15. The silver halide photosensitive material as in claim 1, wherein the compound of formula (II) is a mercaptothiadiazole compound of formula (C):

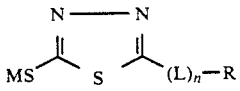

(C)

wherein L represents a divalent linking group; R represents a hydrogen atom, an alkyl group, an alkenyl group or an aryl group; M represents a hydrogen atom, an alkali metal atom, an ammonium group or a precursor thereof; and n is 0 or 1.

16. The silver halide photosensitive material as in claim 1, wherein the compound of formula (II) is a mercaptobenzimidazole, mercaptobenzoxazole or mercaptobenzothiazole compound of formula (D);

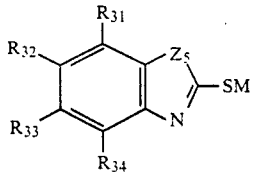

(D)

wherein $Z_5$ represents

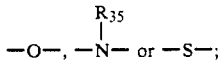

$R_{31}$, $R_{32}$, and $R_{33}$, $R_{34}$ and $R_{35}$ each represents a hydrogen atom or a group capable of being substituted; and M represents a hydrogen atom, an alkali metal atom, an ammonium group or precursor thereof.

* * * * *